US008890019B2

(12) United States Patent
Faulkner

(10) Patent No.: US 8,890,019 B2
(45) Date of Patent: Nov. 18, 2014

(54) COMMUTATING CIRCUIT BREAKER

(76) Inventor: Roger Webster Faulkner, Melrose, MA (US)

( * ) Notice: Subject to any disclaimer, the term of this patent is extended or adjusted under 35 U.S.C. 154(b) by 241 days.

(21) Appl. No.: 13/366,611

(22) Filed: Feb. 6, 2012

(65) Prior Publication Data

US 2012/0199558 A1 Aug. 9, 2012

Related U.S. Application Data

(60) Provisional application No. 61/439,871, filed on Feb. 5, 2011, provisional application No. 61/541,301, filed on Sep. 30, 2011.

(51) Int. Cl.

| | |
|---|---|
| ***H01H 33/16*** | (2006.01) |
| ***H01H 33/59*** | (2006.01) |
| *H01H 33/38* | (2006.01) |
| *H01H 33/32* | (2006.01) |
| *H01H 33/34* | (2006.01) |

(52) U.S. Cl.

CPC ..... *H01H 33/596* (2013.01); *H01H 33/38* (2013.01); *H01H 33/32* (2013.01); *H01H 33/16* (2013.01); *H01H 33/34* (2013.01)

USPC ..... 218/143

(58) Field of Classification Search

CPC ..... H01H 33/161

USPC ..... 218/143

See application file for complete search history.

(56) References Cited

U.S. PATENT DOCUMENTS

| | | | | |
|---|---|---|---|---|
| 2009/0014418 | A1 * | 1/2009 | Jahn et al. | 218/144 |
| 2010/0012624 | A1 * | 1/2010 | Akesson et al. | 218/154 |
| 2010/0219163 | A1 * | 9/2010 | Holaus et al. | 218/143 |
| 2013/0068728 | A1 * | 3/2013 | Pope | 218/154 |
| 2013/0256274 | A1 * | 10/2013 | Faulkner | 218/143 |

* cited by examiner

*Primary Examiner* — Truc Nguyen

(74) *Attorney, Agent, or Firm* — Brian M. Dingman; Dingman, McInnes & McLane, LLP

(57) ABSTRACT

A commutating circuit breaker that progressively inserts increasing resistance into a circuit via physical motion of a shuttle that is linked into the circuit by at least one set of sliding electrical contacts on the shuttle that connect the power through the moving shuttle to a sequence of different resistive paths with increasing resistance; the motion of the shuttle can be either linear or rotary. At no point are the sliding stator electrodes separated from the matching stationary stator electrodes so as to generate a powerful arc, which minimizes damage to the sliding stator electrodes. Instead, the current is commutated from one resistive path to the next with small enough changes in resistance at each step that arcing is suppressed. The variable resistance can either be within the moving shuttle, or the shuttle can comprise a commutating shuttle that moves the current over a series of stationary resistors.

15 Claims, 20 Drawing Sheets

COMMUTATING CIRCUIT BREAKER

CROSS REFERENCE TO RELATED APPLICATIONS

This application claims priority to the following U.S. Provisional Applications, the disclosures of which are incorporated herein by reference:

1. Application No. 61/439,871; Filing Date 5 Feb. 2011
2. Application No. 61/541,301; Filing Date 30 Sep. 2011

FIELD

This invention relates to electrical circuit breakers.

BACKGROUND OF THE INVENTION

In order to open any DC circuit, the inductive energy stored in the magnetic fields due to the flowing current must be absorbed; it can either be stored in capacitors or dissipated in resistors (arcs that form during opening the circuit are in this sense a special case of a resistor). Because of the rapid inrush of current in a dead short, the inductive energy can easily be much greater than just the inductive energy stored in the system at full normal load; if the current goes to double the normal full load amps before being controlled, the inductive energy would be up to four times as large as in the circuit at full load (depending on the location of the short).

Many prior art DC circuit breaker concepts rely on a preliminary commutation of the current from a low loss Switch #1 to a resistor network to dissipate the magnetic energy or a capacitor network to store the energy, or some combination of these. Switch #1 is in all cases a commutating switch, which forces the current through a parallel path through a switched network of resistors and capacitors. In the prior art, switching over multiple different paths through the circuit breaker after the initial commutation is accomplished by separate switches, with the added burden to guarantee exact synchronization of the switching events. Non-linear resistors such as metal oxide varistors (MOVs) or resistors with large positive change of resistance with increasing temperature (positive temperature coefficient "PTC" resistors or "thermistors") have been used in various designs. Preliminary quenching or storage of most of the inductive energy prior to opening the circuit at relatively low current is especially important in HVDC circuits.

The ultimate breaking of the DC current in prior art devices (which occurs after the first commutation away from the low loss connection in the switch where such commutation occurs) relies either on:

1. quenching an arc;
2. diverting the final bit of current through an MOV or another type varistor;
3. diverting the final bit of current into a capacitor or battery for storage.

Examples of fast switches that are used in AC/DC converters and that may also be used in DC circuit breakers include semiconductor switches such as a gate turn-off thyristor (GTO) or an integrated gate bipolar transistor (IGBT) or tube-based switches such as mercury arc valves or cold cathode vacuum tubes, all of which are known in the prior art. These switches do not by themselves comprise a circuit breaker, because the magnetic energy stored in the flowing current must be dissipated. In case of a dead short, the current increases rapidly, until the circuit breaker staunches the inrush of current by means of increasing resistance. The time it takes to cause dI/dt (the change of current with time) to go from being positive to negative is a crucial variable in circuit breakers; I shall refer to this time as the Current Change Reversal time.

Several prior art strategies are known for breaking a high power DC current. Arc chute breakers (U.S. Pat. Nos. 2,270,723; 3,735,074; 7,521,625; 7,541,902 for example) are effective to break DC currents up to 8000 amps at 800 volts (0.8 kV) DC, or 4000 amps at 1600 volts (1.6 kV). One can go to higher voltage in principle with arc chute breakers, but the needed physical separation of the electrodes increases linearly with voltage in such devices, and so they become impractically large at voltage higher than 3.5 kV. One can also go to higher voltage with arc chute breakers by putting two or more arc chute breakers in series, and opening all of them simultaneously. Arc chute breakers can be made more effective by judicious use of magnetic fields, which may be applied either by permanent magnets or electromagnets, or both. Advanced materials are used both for the electrodes and for the surfaces of the arc chutes, to minimize damage caused by the arcs.

The concept behind arc chute breakers is to spread out the arc over a large surface area. Since the arc is quite hot, the higher surface area implies far greater radiative cooling. As the arc cools, it is also elongated; the resistance goes up so high that the arc is ultimately quenched; this process takes a while: 300 milliseconds (ms) is a typical time between striking the arc and arc extinction in an arc chute breaker. This long time to open the circuit has little to do with the speed of motion of the electrodes; in a Gerapid™ circuit breaker from GE, for example, the electrodes are separated within 3 ms (milliseconds), but cooling the arc takes about 100 times as long as that, and the current can continue to increase in case of a dead short for tens of ms in an arc chute circuit breaker before the current inrush due to the dead short is reversed towards zero current. Because of the long time that it takes to extinguish the arc, a lot of energy (far more than just the stored magnetic energy in the circuit at full load) must be dissipated into the arc chutes, which get quite hot. One way to prevent melting of the arc chutes is to arrange a circuit (as in U.S. Pat. No. 3,566,197 for example) that moves the arc from one arc path to the next in such a way as to allow the individual arc paths to cool between periods of use, until the arc is quenched. (Note, though, that the specific design of U.S. Pat. No. 3,566,197 will only work for AC current.)

Another means known in the prior art to create a high power DC circuit breaker is to use the charging or discharging of a capacitor to momentarily reduce the voltage and current to a level that a fast acting AC-type switch can open the circuit. U.S. Pat. No. 3,809,959 describes an arrangement in which two AC-type switches, a resistor, a spark gap, and a capacitor are combined to give an effective DC circuit breaker that can work up to HVDC voltage. Referring to U.S. Pat. No. 3,809,959, a fast Switch #1 opens and commutates most of the current to a single Resistor #4. Depending on the current flowing, Switch #1 may still have an arc between the contacts after diverting most of the current to the resistor. The insertion of the resistor and spark gap through Switch #1 causes the voltage to climb enough to jump over Spark Gap #3 to Capacitor #2. During the period of charging this capacitor, the current goes to nearly zero in the path through the arc in the second AC-type switch, Switch #5 and the arc is extinguished, which opens the circuit. This is faster than an arc chute breaker, and is applicable up to HVDC voltage levels with a reasonably compact design. Later refinements of this idea include pre-charging the capacitor to an opposite polarity compared to the flowing current to be interrupted, so that the voltage is momentarily reversed in Switch #5, forcing the arc there to go through zero current and zero voltage (which increases the chance to interrupt the current). Another known refinement is to use a thermistor for Resistor #4. The device of U.S. Pat. No. 3,809,959 is still used in HVDC AC/DC converter stations to allow for fast isolation of one of the two (+) and (−) poles of the HVDC system in case of a ground fault on one leg of an HVDC bipole system (This type of breaker is called a "metallic return transfer breaker"). In this case, half of the HVDC system can be quickly isolated from the opposite pole, which allows temporary use of one pole with ground return (or metallic return through a low voltage conductor) while the other pole is fixed.

U.S. Pat. No. 3,534,226 describes a particular way to insert resistance and capacitance into a DC circuit, to open the circuit; this patent is included herein by reference in its entirety. The basic concept of switching in resistors to reduce the current in a stepwise manner so as to control the magnitude of voltage transients during opening of a DC circuit is well described in U.S. Pat. No. 3,534,226, which envisions using many individual switches and resistors. The method of U.S. Pat. No. 3,534,226 involves two different kinds of switches that must be opened in a precise sequence: first a low resistance mechanical switch (through which most of the power flows when the circuit breaker is closed) is opened. This is a conventional switch in which the electrical contacts are separated. Although a plasma arc may briefly form between the separating electrodes of the low resistance switch, this arc is quickly extinguished as the current is commutated onto a parallel path through the resistors, which are switched via fast acting switches; these fast acting switches can be mercury arc valves or other types of fast switching tubes, or solid state devices like IGBTs or GTOs that can accomplish switching within 10 microseconds. By the time the last fast acting switch is opened the current has been reduced to less than 10% of its maximum value (which implies that >99% of the magnetic energy has been dissipated), which allows the final capacitor snubber to be relatively small and economical compared to the size it would have to be if it had to absorb most of the magnetic energy stored in the circuit at the time of initial opening. U.S. Pat. No. 3,534,226 forms the basis for several subsequent patents, including U.S. Pat. Nos. 3,611,031 and 3,660,723 (both of which also use a low-loss mechanical switch to commutate the current to a resistive network based on fast electronic switches), and U.S. Pat. No. 6,075,684 which uses a fast electronic switch in place of the commutating mechanical switch.

U.S. Pat. No. 3,777,178 describes a particular way to insert resistance and capacitance into a DC circuit. This design uses at least three switches ($D_1$ and $D_2$ are commutating switches, while $D_3$ is the switch that accomplishes the final opening of the circuit), two capacitors, and two resistors (which are preferably varistors); the switches themselves are not described in detail, but are presumably of prior art designs such as arc chute breakers, gas blast breakers, vacuum circuit breakers, or $SF_6$ gas-insulated switchgear. In the end, the final part of the inductively stored energy must be stored in the capacitors after switch $D_3$ opens.

U.S. Pat. No. 3,777,179 (Hughes Aircraft) describes a particular way to insert resistance and capacitance into a DC circuit.

U.S. Pat. No. 4,300,181(GE) describes a means of breaking a DC current by using a capacitor of minimum size that is charged up prior to breaking the circuit. This circuit breaker design utilizes varistors to absorb the inductive energy that must either be stored or dissipated on opening the circuit.

Several designs of resonant DC circuit breakers are known, for example U.S. Pat. Nos. 4,216,513 and 4,805,062 (Hitachi) and US patent application 2011/0175460 (ABB). These devices create an L-C oscillation (an inductor-capacitor oscillation) that is superimposed on the DC current by placing inductors and capacitors in series connection in such a way that an exponentially decaying "ringing" of the circuit occurs when the capacitor is discharged into the circuit. The ringing of the circuit should ideally have high enough amplitude that the current and voltage cross zero in the first few oscillations. This allows an AC-type circuit breaker to open the circuit. US patent application 2011/0175460 is a particularly elegant configuration, resulting in a fairly compact HVDC circuit breaker which oscillates through zero voltage and current several times during its ringing decay; this ABB patent shows a range of inductance and capacitance where a particular current may be broken by the AC type circuit breaker that is opened to initiate the ringing decay response.

U.S. Pat. No. 6,501,635 describes a particularly fast acting mechanical switch in which a conductive ring has an induced current that interacts with the magnetic field of a stationary electromagnet so that the ring is strongly repelled and therefore moves quite fast (in about one ms) from a closed to an open position within the switch. Such a switch can be used in AC circuit breakers that wait for the next zero crossing to break the circuit. Because the mass of the ring is much less than the mass of all the parts that typically must move when a mechanical circuit breaker opens, this "electrodynamic ring breaker" is fast for a mechanical switch. This switch by itself is not useful as a high power DC circuit breaker; however, it can be combined with a switched array of resistors as in U.S. Pat. No. 3,534,226 to create a DC circuit breaker. A paper by Michael Steurer, Klaus Fröhlich, Walter Holaus, and Kurt Kaltenegger: "A Novel Hybrid Current-Limiting Circuit Breaker for Medium Voltage: Principle and Test Results," IEEE TRANSACTIONS ON POWER DELIVERY, VOL. 18, NO. 2, APRIL 2003 describes a hybrid MVDC circuit breaker based on a similar principle to that of U.S. Pat. No. 3,534,226, except for using a single thermistor rather than a switched array of resistors to clamp down on the surging current in a short. A problem with this design is that the current has to be high enough to heat up the thermistor for the proposed mechanism of Steurer et al to work properly.

SUMMARY OF THE INVENTION

Commutating Circuit Breakers work by switching increasing resistance into a circuit in a pre-determined sequence until the current is sufficiently reduced so that a final circuit opening can be performed using a relatively small snubbing circuit such as a varistor or a capacitor to absorb the last bit of stored magnetic energy. The advantages of a sequential switching circuit breaker are well defined in the prior art U.S. Pat. No. 3,534,226. It is critical for the resistance to increase slowly enough that the inductive energy can be quenched without creating voltage spikes that are above the maximum voltage that the system can tolerate, as will be obvious to a person skilled in the art of circuit breaker design. The novel aspect of Commutating Circuit Breakers compared to prior art methods of switching in resistance is that the sequential switching of resistance into the circuit is accomplished by the motion of a shuttle. As the shuttle moves, the resistance increases because of one of these three Cases:

1. The resistance across a variable resistance shuttle increases as the shuttle moves;

2. The resistance across the circuit breaker increases as a commutating shuttle commutates the current over a sequence of stationary resistors; or,
3. A commutating variable resistance shuttle is used to commutate over a sequence of stationary resistors, but part of the inserted resistance is on board the shuttle.

In any Commutating Circuit Breaker of this invention, the current flows between a first Pole A through a first stator electrode (stator electrode #1) to a first shuttle electrode on the shuttle; this part of the current path from Pole A of the circuit breaker on to the shuttle can be accomplished by any workable means, either via a commutating connection or a stable continuous connection (said stable continuous connection can be accomplished by a flexible wire, a telescoping tube, or a slip ring for example).

In Case (1) above of a Variable Resistance Shuttle, a variable resistance portion of the shuttle connects Pole A of the Commutating Circuit Breaker to Pole B through two stationary stator electrodes. The points of electrical connection between the stationary stator electrodes and the variable resistance shuttle can either be via discrete stator electrodes, each of which is bounded by insulation (as shown in FIG. 1), by a flexible wire connection that remains attached to the shuttle as it moves (on only one side of the shuttle), or a whole portion of the surface of the variable resistance shuttle may comprise a single stator electrode, as will be described subsequently.

In Case (2) above of a commutating shuttle, the resistors remain stationary, and the commutating shuttle delivers the power to different stator electrodes as it moves, which connect the power flow through a sequence of stationary resistors in such a way that resistance increases repeatedly during opening of the Commutating Circuit Breaker. In this case, at least one of the stator electrodes on the commutating shuttle must be a discrete stator electrode which is bounded by insulation. Insofar as the mass of resistors required to open a circuit depends on the total energy that must be absorbed, and can be in the hundreds of kilograms for a Commutating Circuit Breaker designed for a high power, high voltage line, it is preferable in high power applications not to accelerate the resistors as in Case (1), but to rely instead on a commutating shuttle as in Case (2) to commutate the power over a series of stationary resistors. The commutating shuttle can both weigh less and be composed of stronger, stiffer materials than the variable resistance shuttle of Case (1). The lower mass of a commutating shuttle compared to a variable resistance shuttle implies less momentum needs to be transferred to accelerate the shuttle, which minimizes the jolt due to acceleration of the shuttle, and also reduces shock, vibration, and fatigue for the structure that holds the Commutating Circuit Breaker.

A commutating variable resistance shuttle as in Case (3) above is useful for snubbing arc currents that might otherwise arise as the trailing edge of a commutating stator electrode leaves its electrical connection to a particular moving shuttle electrode. Making the last half of a stator electrode and/or a shuttle electrode lower in conductivity compared to the first half can suppress arcing while still preserving a low resistance path through the first half of the stator electrode or shuttle electrode to conduct electricity efficiently when the circuit is closed. Making the trailing edge of a shuttle electrode much more resistive than a metal may imply either placing a portion of the resistance insertion of a Commutating Circuit Breaker on board the shuttle in the trailing portion of the shuttle electrodes, or within the trailing portion of the stator electrodes, or both. This approach helps to suppress arcing as a stator electrode loses contact with a particular shuttle electrode; having the trailing edge of the shuttle electrode and/or stator electrode much less conductive than the main body of the shuttle electrode or stator electrode suppresses formation of an arc as the shuttle electrode and stator electrode separate, by commutating the current to the next parallel connection prior to separation of the electrodes.

There must be at least one commutation zone wherein the movement of the shuttle changes the electrical path through the circuit breaker, so that the current is shunted onto paths of increasing resistance during opening of the circuit breaker. This zone may commutate the power from a shuttle electrode through a series of stationary stator electrodes onto paths having increasing resistance, or the movement of the shuttle may simply place greater resistance between the stator electrodes through the moving variable resistance shuttle. FIGS. 4 and 5 are examples of the simplest possible implementations of a Commutating Shuttle, in which the shuttle is solidly connected to the Pole A on the "power in" side (no commutation zone; in this case via sliding contacts, but this could also be via a flexible wire as in FIG. 11), and has a single commutation zone on the "power out" Pole B side of the shuttle, through a sequence of resistors fed by a moving shuttle electrode.

Commutating Circuit Breakers enable high power DC power transmission and distribution above 3,500 volts. Medium voltage DC (MVDC) power distribution at 2,000-36,000 volts (2-36 kV) would be both capital efficient and energy efficient compared to MVAC power distribution, but has up until now been economically infeasible due the high cost, low efficiency, and/or slow action of prior art DC Commutating Circuit Breakers. MVDC enables microgrids with many different generators, power demands, and storage units tied into a single grid, whereas this is far more difficult to do with AC power.

MVDC allows efficient power distribution in industrial facilities (especially factories and processing plants that use a lot of variable speed motors); on board ships; and at mine sites and other isolated off-grid sites. The provision of DC power to many different variable speed motor drives saves both capital and energy costs compared to the normal mode of operation in which each motor controller for a variable speed drive must first produce DC power from AC power within the drive, then either drive a DC motor or convert to AC at a controlled frequency to drive the variable speed motor. Variable speed drives are less expensive and more efficient if they are powered by MVDC, which has previously been impossible due to the lack of fast, efficient, economical MVDC Commutating Circuit Breakers.

High voltage DC (HVDC) power transmission is now the most efficient way to transmit high power levels, over one gigawatt (GW) for example, for distances greater than 1000 km. Unlike AC power, DC power lines can readily go underground or undersea, and for both reasons (high capacity, efficient transmission and the ability to install HVDC underground or undersea) HVDC is the most efficient and feasible way to transmit vast amounts of renewable electricity from distant wind farms and solar arrays to cities and economical remote energy storage sites, as will be needed to build an efficient energy economy based on renewable energy. Until recently, HVDC power transmission was strictly via "line commutated converters" (LCC) which only work as point-to-point power lines, connecting two nodes of the AC grid, with LCC converters at each end. An LCC HVDC system does not need HVDC Commutating Circuit Breakers, because the current can be broken on the AC side. A newer type of AC/DC converter, "voltage source converters" (VSC) allows for the first time, true multi-terminal HVDC (like the planned Atlantic Wind Connection); however these multi-terminal HVDC systems require HVDC Commutating Circuit Breakers.

Development of multi-terminal HVDC power lines and eventually, the supergrid, has been inhibited by the high cost, low efficiency, and poor reliability of prior art HVDC Commutating Circuit Breakers.

The Commutating Circuit Breaker is a breakthrough in terms of capital cost and operating characteristics (long life, low switching transients) that will enable DC grids all the way from the modest voltage relevant for data centers (~400 volts) to MVDC for microgrids, ships, and factories & processing plants, to HVDC for long distance power sharing.

BRIEF DESCRIPTION OF THE DRAWINGS

FIG. 4 shows the Commutating Circuit Breaker midway through opening.

DESCRIPTION OF EMBODIMENTS

It is essential in a Commutating Circuit Breaker (as in any mechanical switch) to accelerate something; either a variable resistance shuttle as in case (1), or a commutating shuttle as in case (2), or a blending of these cases in which part of the insertion of variable resistance occurs on the shuttle, and part via stationary resistors, as in Case (3).

Figure 1:
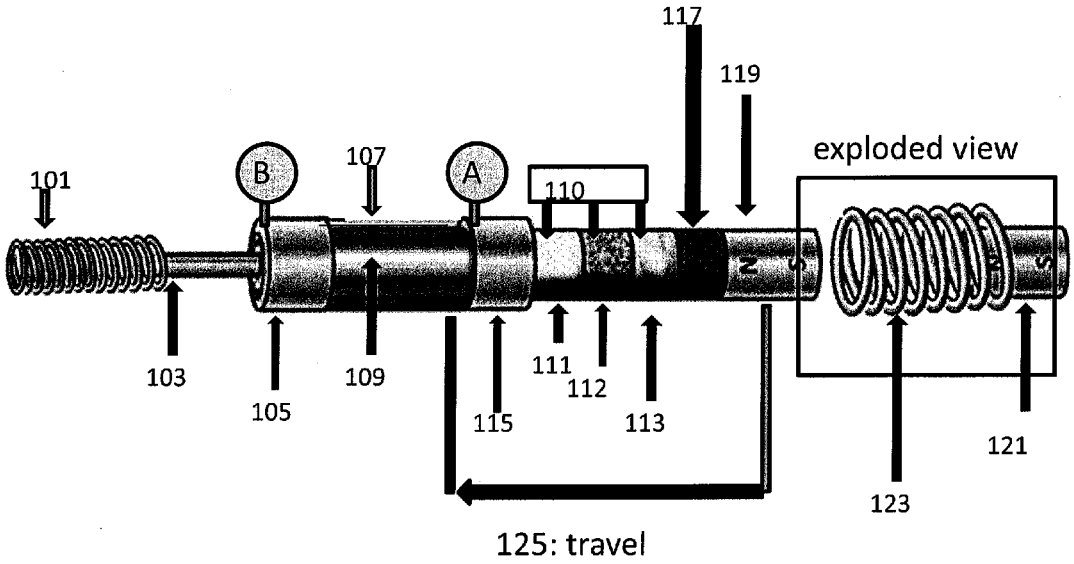
FIG. 1 shows a linear motion ballistic circuit breaker with variable resistance shuttle having step changes of resistivity in the shuttle; stator electrodes are arranged in a circularly symmetrical manner to avoid a Lorentz force torque; there are two sets of stator electrodes at a set distance apart. As the shuttle moves, the resistance increases; when the boundary between different resistivity segments exits the left side of stator electrode 115, there is a sudden change in the slope variable, dI/dt.

Commutating Circuit Breakers for relatively low power circuits (less than about one megawatt, MW) can desirably be made with a variable resistance shuttle that connects between two sets of contacts, as in FIG. 1. This simplifies the design of the circuit breaker mechanism and wiring, but requires fabrication of a fairly complicated shuttle with higher strength than is normally required for resistors. Stronger springs or launching mechanisms are required than for commutating shuttle designs for the same power level because the entire mass of resistors must be accelerated. The variable resistance shuttle as a whole must withstand high acceleration loads, and must have a surface that can slide on the stator electrodes without excessive wear.

In FIG. 1 a spring 101 is under tension, pulling on the shuttle through a non-conductive rod 103; this rod extends to the back end of the shuttle and is connected to permanent magnet 119, the "shuttle magnet." Shuttle magnet 119 is in contact with stator magnet 121 when the circuit breaker is closed, prior to triggering the breaker. Electromagnet coil 123 is oriented to repel the shuttle magnet and to trigger opening of the circuit breaker by the spring when a DC current passes through the coil. This is just one of many prior art methods to trigger a circuit breaker, shown merely as an example of a triggering mechanism, and not meant to limit the invention. Motion of the shuttle could also be propelled by gas or hydraulic pressure, for example. Fastest actuation can be achieved through a combination of both pushing on the shuttle from behind, and pulling it from the front. FIG. 1 shows a variable resistance portion of the shuttle 110 having step changes of resistivity in the shuttle core segment layers 111, 112, and 113. Stator electrodes 105 and 115 are arranged in a circularly symmetrical manner to avoid torque on the shuttle by Lorentz forces. The two circular stator electrodes 105 and 115 are at a set distance apart, far enough to prevent arcing during opening of the circuit breaker.

During the time that a single resistivity layer is exiting stator electrode 115, the resistance increases smoothly due to insertion of a greater length of resistive segments between Pole A and Pole B as the shuttle moves left. As each resistive material boundary passes out of contact with stator electrode 115, there is a discontinuity in the resistance versus time curve, which in turn generates a voltage transient. There will be discontinuities of slope in the resistance vs. time curve, but no step changes in resistance. Although FIG. 1 illustrates the case of a moving resistive core with well defined boundaries between materials with different resistivity, it is also possible that the variable resistance core can be a continuously graded cermet (for example) that has resistance increase from left to right, with no sudden changes in resistivity. This continuously graded resistivity method can eliminate voltage transients due to resistivity boundaries exiting stator electrode 115.

The shuttle in FIG. 1 is shown at its closed circuit position, but an exploded view is applied to the stator magnet 121 and the electromagnet trigger 123 to make it easier to depict. In the closed circuit, power flows from Pole A to the stator electrode 115, then through the portion of the shuttle 109 to stator electrode 105; 109 is composed of a good electrical conductor with low resistivity $\sim 10^{-8}$ ohm-meter. After the shuttle begins to move, the resistance increases sharply as the boundary between material 109 and material 111 exits the left side of stator electrode 115; this is the first commutation. After this, resistance rises smoothly while the 111 material exits the left side of the stator electrode 115, then sharply at the time of the second commutation when the boundary between material 111 and 112 exits the left side of stator contact 115, then again resistance rises smoothly for a while until the boundary between 112 and 113 exits stator electrode 115. The circuit is finally opened when insulating material extends from the left side of electrode 115. When the circuit is finally opened a snubber of some kind, as is familiar to one skilled in the prior art, such as a varistor or a capacitor absorbs the last bit of inductively stored energy. Total travel during opening of the circuit is distance 125. Not shown is the means to arrest the forward motion of the shuttle; there are many known methods in the prior art to do this.

Although FIG. 1 illustrates the case of a moving resistive core 110 with well defined boundaries between materials with different resistivity (111, 112, 113, 117), it is also possible and desirable that the variable resistance core 110 can be a continuously graded cermet that has resistance increase from left to right, with no sudden changes in resistivity. Cermet resistors with stratified resistivity ranging from low to high resistivity can be prepared by known means (see for example, "Functionally Graded Cermets," by L. Jaworska et al, Journal of Achievements in Materials and Manufacturing Engineering; Volume 17, July-August 2006). Such a continuously graded cermet resistor could substitute for the stacks of resistors shown in FIG. 1 (in which the resistors themselves are moving), or in FIG. 4, in which a stationary stack of disc shaped resistors is surrounded by a commutating sleeve that can be rapidly pulled up from around the resistor stack (the sleeve is much lighter and stronger than the resistors). Substituting a continuously graded resistor for step changes in resistance eliminates switching transients, so this is a desirable implementation of the invention that is feasible either with resistors on the shuttle (as in FIG. 1), or stationary resistors (as in FIGS. 4 and 11).

Figure 2:
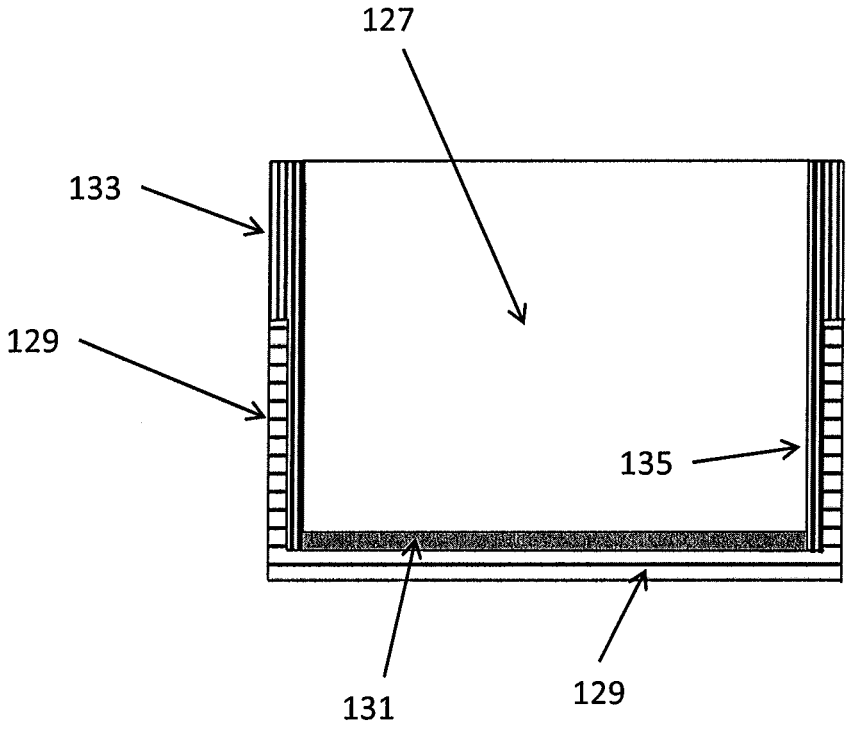
FIG. 2: Disc-shaped resistor in a special container that facilitates commutation.

FIG. 2 shows a resistor cell of a stacked resistor column (shown in FIG. 3) in which a disc-shaped resistor is nestled into a container that facilitates stacking and commutation. One of the most economical types of high voltage resistors are the alumina/carbon resistors, such as those available from HVR Advanced Power Components of Ckeektowaga, N.Y. (http://www.hvrint.com/linearDiscsolid.htm). These resistors can handle pulsed power very well, as is needed during operation of a Commutating Circuit Breaker. The physical properties of this class of resistor (especially density and strength) would not be desirable for a design such as FIG. 1 in which the resistor per se is accelerated to accomplish the circuit opening, and the stator electrodes ride on the surface of the resistor. In FIG. 2, the disc-shaped resistor 127 is attached by conductive adhesive 131 to the bottom of a special container which has a metal bottom which also extends part way up along the sides 129 to which the disc resistor is attached by the conductive adhesive 131, which is desirably a metal brazing compound, a solder, or a conductive epoxy. The outer metal surface of the container makes an electrical connection to the commutating sleeve (the stator electrode). The inner sides of the container are an insulator 135 (this guarantees that current flows vertically in each resistor), and an insulating material with good frictional properties 133 extends to the outer surface of the resistor cell to ride against the commutating shuttle while isolating the mal parts of each cell 129 from the next cell in the stack.

Figure 3:
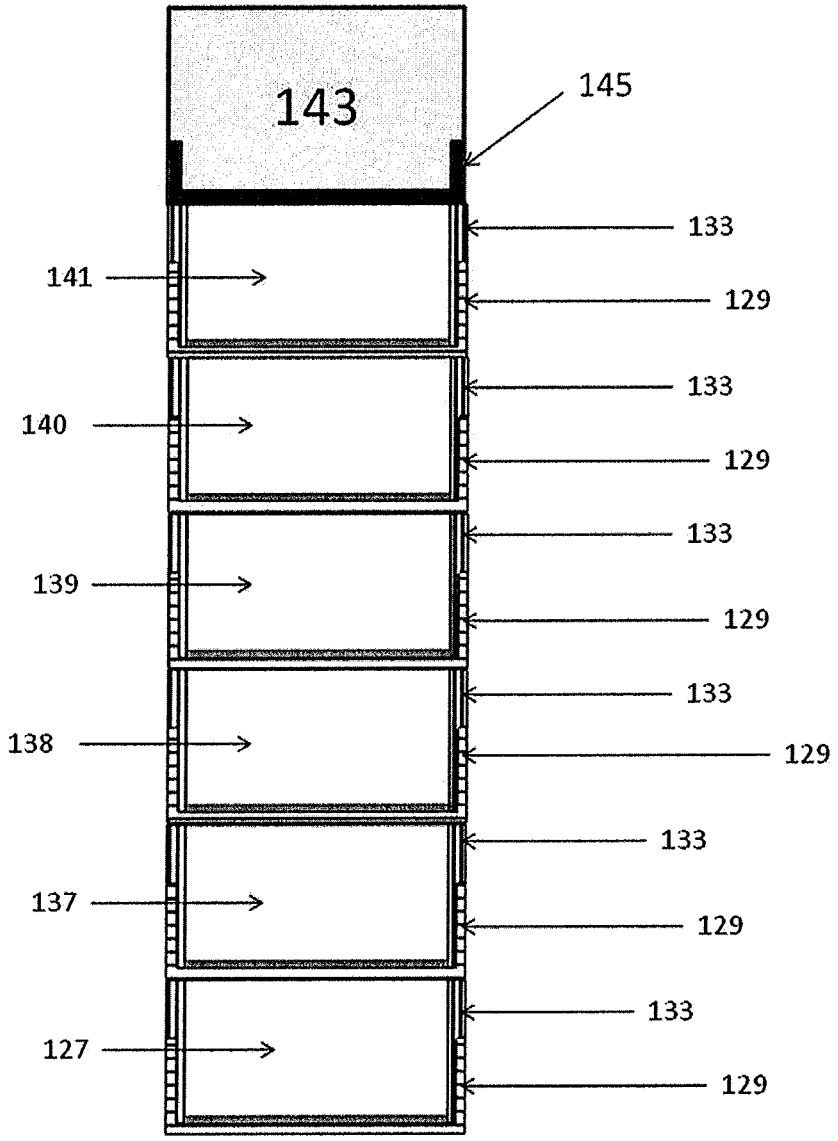
FIG. 3: Stack of disc-shaped resistors as in FIG. 2 that are series connected in such a way as to facilitate commutation by a moving shuttle that fits around the stack as in FIG. 4.

FIG. 3 shows six of the resistor cells of FIG. 2 stacked up to form a column. Disc resistors 127, 137, 138, 139, 140, 141 are inside the six resistor cells. Alternating conductive 129 and insulating 133 stripes appear on the outside of the column forming a classic commutator. At the very top is a highly insulating cell 143, which has a metal base 145 to allow commutation of the current through the topmost resistive cell 141.

Figure 4:
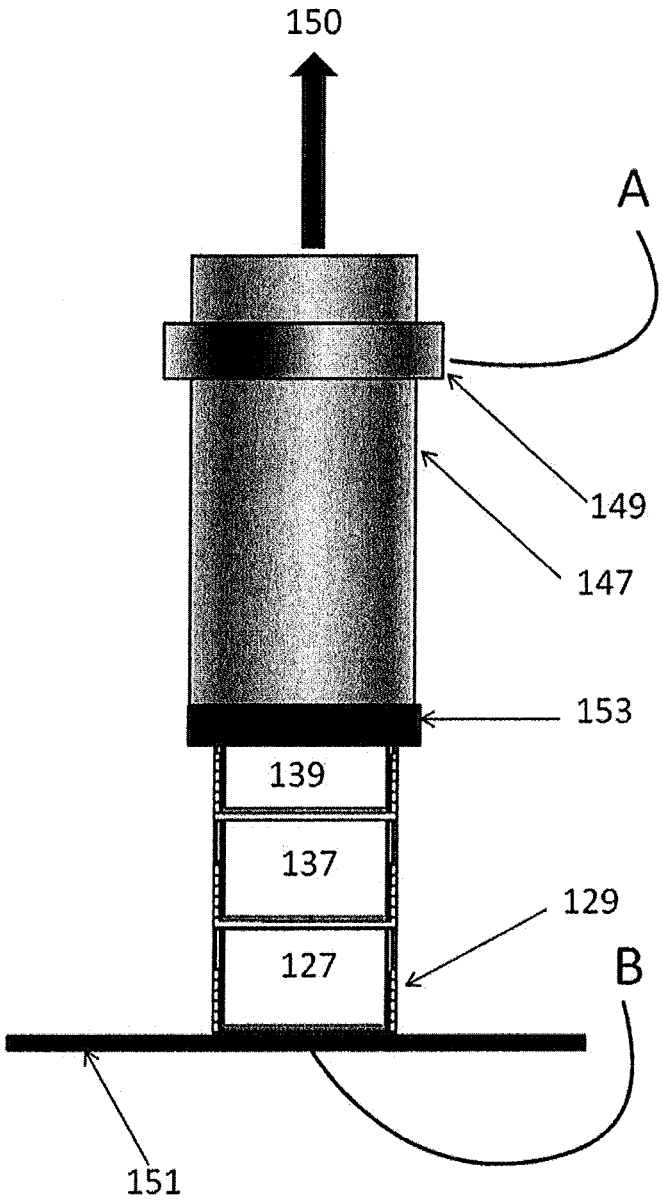
FIG. 4: Linear motion Commutating Circuit Breaker with a pipe-shaped commutating shuttle that fits around a stationary column of disc-shaped resistors. The column of resistors effectively in the circuit becomes longer as the conductive shuttle moves, and therefore its resistance increases.

FIG. 4 shows how the stack of resistor cells of FIG. 3 is combined with a commutating shuttle 147, which in this case takes the form of a metallic sleeve that fits over the column of resistor cells. Note that the metallic sleeve is lower in mass than the column of resistor cells, and therefore takes less force 150 to accelerate. Current flows from Pole A to the shuttle through stator electrode 149 (in this case the entire length of 147 is the shuttle electrode). When the Commutating Circuit Breaker of FIG. 4 is closed, current flows with low resistance from the stator electrode 149 to the metal portion 129 at the bottom of cell 127 through the commutating shuttle 147. The bottom of resistor cell 127 is attached to metal base plate 151, which is electrically connected to Pole B of the Commutating Circuit Breaker. When the circuit breaker is triggered, the commutating shuttle is rapidly accelerated upwards, causing the current to pass first through resistor 127, then 127+137, then 127+137+139 (this is the state illustrated in FIG. 4). The commutating shuttle continues to move upwards until it has moved beyond the last metallic portion of the resistor stack column, 145 of FIG. 3. At the bottom of the commutating shuttle 147 is a semiconductive sleeve that fits closely around the resistor column to suppress arcing when the conductive portion of the commutating shuttle 147 pulls apart from one of the metallic parts 129 found at the bottom of each resistor shell. Not shown in FIG. 4 are the means by which the commutating shuttle is pulled upwards, the sensors to detect a fault condition, and the means of triggering the circuit opening; these functions can all be accomplished by means known in the prior art.

Figure 5:
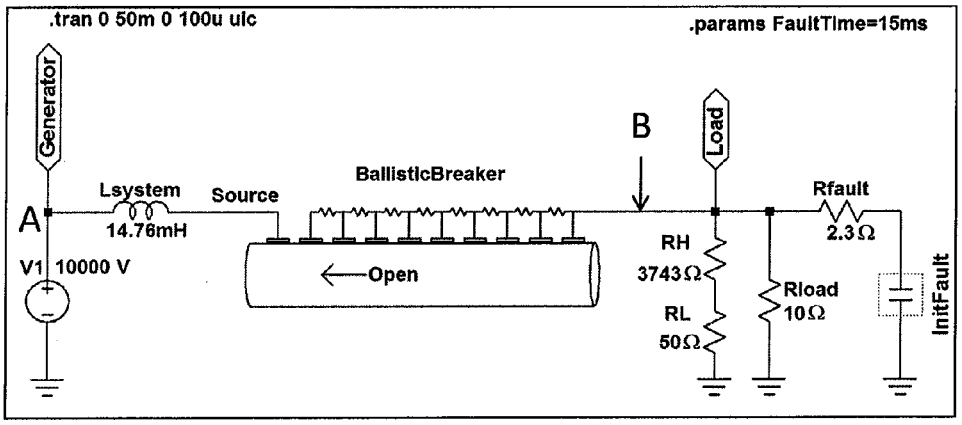
FIG. 5: This figure is a circuit representation from one of many SPICE program runs.

FIG. 5 is a circuit diagram of a realistic 10,000 volt DC circuit that was used in simulating results for a circuit breaker that is essentially like that of FIG. 4.

Figure 6:
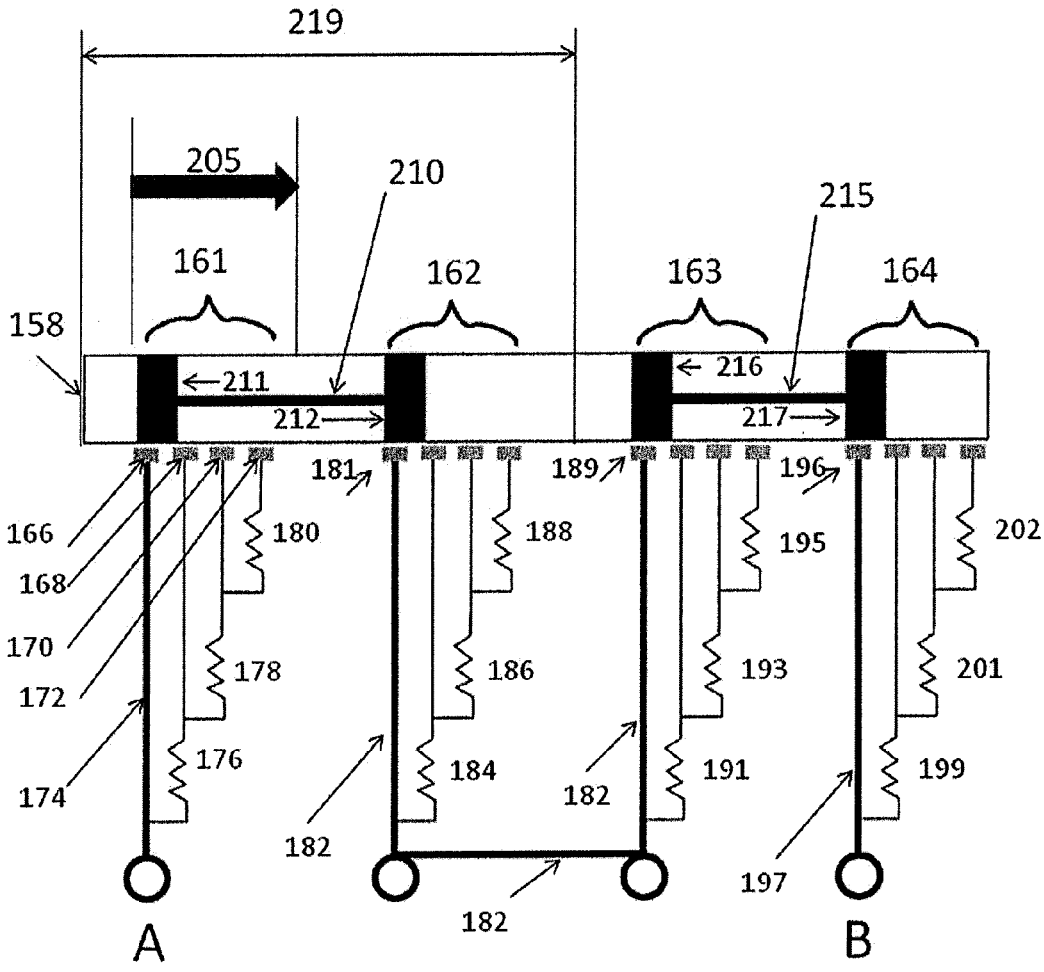
FIG. 6: Linear Motion Multistage Commutating Circuit Breaker that moves along the axis of symmetry, with four commutation zones.

FIG. 6 is a two-stage Commutating Circuit Breaker that has a commutating shuttle 158 that moves a distance 205 to open the circuit. There are four commutation zones 161 to 164: 161 and 162 together form the first stage; 163 and 164 together form the second stage of two-stage Commutating Circuit Breaker. In each of these zones there are four stator electrodes; for example commutation zone 161 contains stator electrodes 166, 168, 170, and 172; stator electrode 168 connects to Pole a through resistor 176; stator electrode 170 connects to Pole a through resistors 178 and 176; stator electrode 172 connects to Pole a through resistors 180, 178, and 176 in series. Stator electrode 166 connects through low resistance conductor 174 to Pole A. When the circuit is closed there is a low resistance path from Pole A to Pole B through the Commutating Circuit Breaker in this way: Pole A connects through stator electrode 166 to shuttle electrode 211, which then connects through insulated conductor 210 to shuttle electrode 212, which then connects to stator electrode 181 and from there through conductor 182 to stator electrode 189, then to shuttle electrode 216, then through insulated conductor 215 to shuttle electrode 217, then to stator electrode 196, then through conductor 197 to Pole B. The commutating shuttle is essentially a rigid body that maintains a set geometric relationship between the four shuttle electrodes 211, 212, 216, and 217 as it moves to the right to open the circuit. It is desirable to have the times at which the four shuttle electrodes lose contact with the four stator electrodes that correspond to a closed circuit (166, 181, 189, and 196) not be simultaneous, since simultaneous commutation in all four sets of electrodes will increase the magnitude of the switching transient. It is optimal to insert the twelve resistors at controlled time intervals. After the twelve resistive insertions implied by FIG. 6, the current is low enough so that the shuttle electrodes can move beyond their last connection through resistors without damaging arcs as the then greatly diminished current is cut off.

A long multistage chain of Commutating Circuit Breakers as in FIG. 6 can be used to break an arbitrarily high voltage. In order to efficiently move a long commutation shuttle such as this implies, it is desirable to use multiple drives along the length of the commutating shuttle, such as multiple springs mounted to the shuttle between the commutating zones, or multiple linear motors acting between the commutating zones. A long multistage breaker with embedded permanent magnets can be driven by known electromagnetic means, for example (however, greater force can be exerted with springs or electromagnets than by coupling to permanent magnets).

Figure 7:
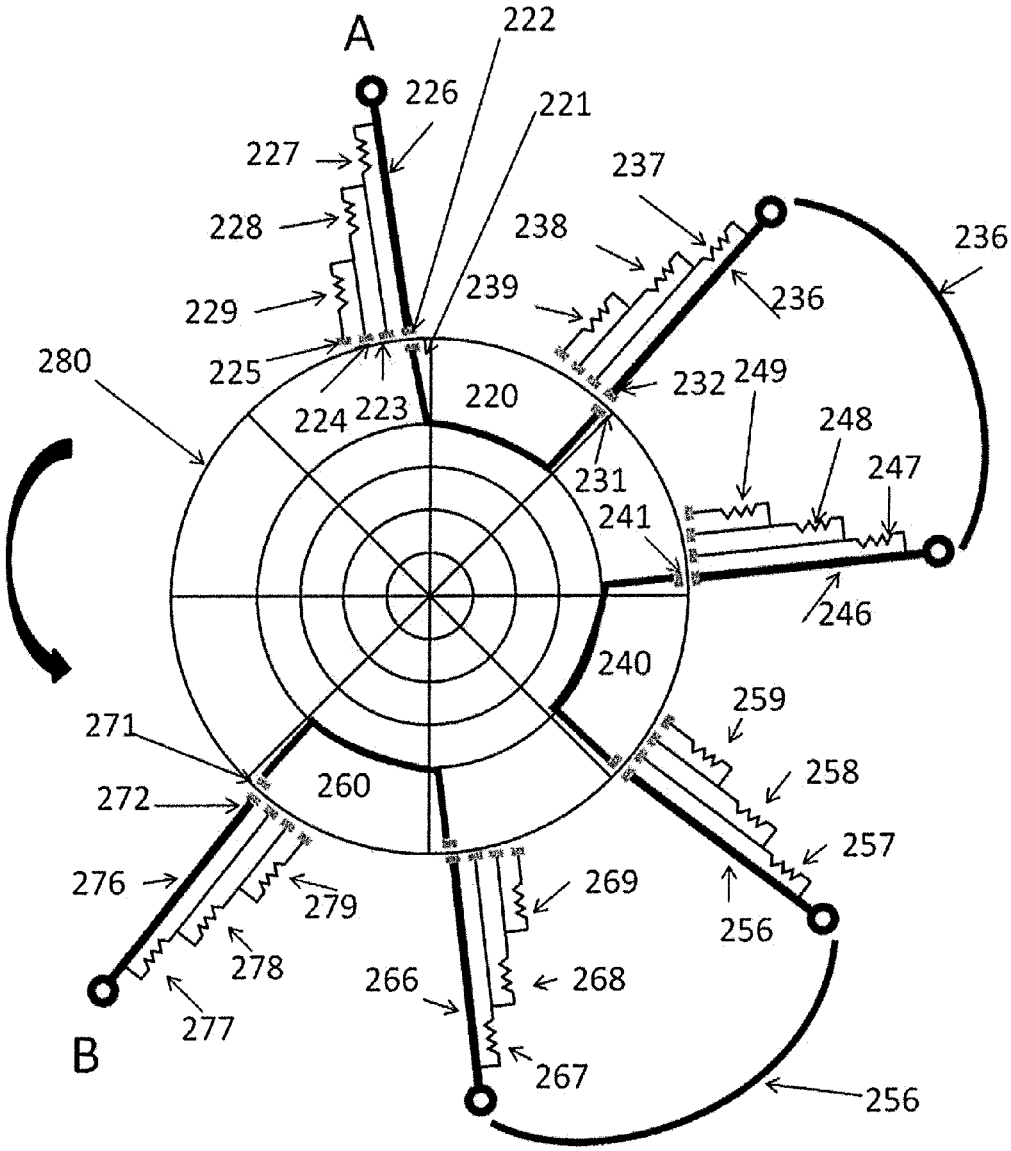
FIG. 7: Rotary Motion Multistage Commutating Circuit Breaker with six commutation zones.

FIG. 7 represents a notional rotary multi-stage Commutating Circuit Breaker design for one pole of a 300 kilovolt (300 kV) DC circuit breaker designed for 2000 amps (2 kA), (600 MW) with waste heat production below one kilowatt (on state losses less than 1.67 E-6 part of the transmitted power at full load). In this case, six commutation stages are shown, 221-229, 231-239; 241-249; 251-259; 261-269; and 271-279. These stages are arranged in pairs: the first commutating array (defined by 221-229 in FIG. 7) is closest to Pole A, and is linked via insulated conductor 220 to the second commutating array (defined by 231-239 in FIG. 7); the first commutating array and the second commutating array together with insulated conductor 220 form the first of three commutation stages in the Commutating Circuit Breaker of FIG. 7. The other two stages include components 240-259 and 260-279.

The multistage rotary Commutating Circuit Breaker of FIG. 7 works in much the same way as the linear multistage Commutating Circuit Breaker of FIG. 6, except that actuation is via rotation of a cylindrical commutating rotor 280 rather than linear motion of a commutating shuttle as in FIG. 6, and there are three stages rather than two as in FIG. 6. (As used herein, "commutating rotor" is a special case of a "commutating shuttle;" a "shuttle electrode" refers to any moving electrode, whether it moves linearly as in FIG. 6, or via rotation, as in FIG. 7.) The circuit breaker of FIG. 7 has six commutation zones, each of which works in the same way as does each of the four linear motion commutation zones of FIG. 6. In this case, the commutating shuttle rotates about 22 degrees counterclockwise to open the circuit. The rotor is composed of strong, electrically insulating materials such as a fiberglass reinforced polymer composite, an engineering grade thermoplastic compound, or a polymer-matrix syntactic foam, except for the shuttle electrodes 221, 231, 241, 251, 261, and 271 and the insulated conductive paths shown with heavy black lines (220, 240, and 260) within the shuttle that connect pairs of shuttle electrodes (such as 221 and 231). The view in FIG. 7 is an end-on view of a commutating shuttle which has the shape of a cylinder. The length of the cylinder (perpendicular to the cross-section shown in FIG. 7) can be adjusted to keep the normal full load amps per $cm^2$ of electrode contact area within design limits; thus, depending on the current, the cylinder 280 can look like a disc or a barrel. The circumferential insulated distance between stator electrodes (for example 222, 223, 224, 225) can be adjusted to deal with the voltage gradient at each commutation; in principle, both the width of each stator electrode and the distance between each next neighbor pair of stator electrodes would be adjusted to reach an optimum design. Neither the distances between stator electrodes, nor the width of the stator electrodes, nor the composition of different stator electrodes needs to be the same for any two stator electrodes.

In the particular design of FIG. 7, the on-state stator electrodes 222, 223, 242, 252, 262, and 272 are in part liquid metal electrodes; these are the only stator electrodes which carry high current in the on state. Liquid electrodes are about $10^4$ times as conductive as sliding electrodes in terms of contact resistance. Liquid metal electrodes can therefore also be narrower than sliding solid contact electrodes, which is a major advantage for the first few commutation steps of a Commutating Circuit Breaker. Let's consider a specific case: in FIG. 7 the liquid metal stator electrodes 222, 223, 242, 252, 262, and 272 can be one tenth as wide as the solid stator electrodes 223, 224, and 225 for example, and still have one thousandth of the contact resistance of the solid stator electrodes. Making the liquid metal stator electrodes 222, 223, 242, 252, 262, and 272 one millimeter (mm) wide in the circumferential direction means that it is possible to achieve the first commutation by only rotating the shuttle 280 by 0.36 degrees if the first stator electrode is aligned with the rotor electrode so that there is only one mm to move to cause the first commutation. This first commutation is very critical in any DC circuit breaker, since as soon as the first resistance is inserted the fault current is controlled. The above discussion around narrow liquid metal electrodes is one way to speed up the first commutation by reducing the distance that must be moved by the commutating shuttle to get to the first commutation. I will discuss other methods below.

A key consideration when using liquid metal electrodes is to avoid oxidized solid metal contacts to connect with the liquid metal electrode. One way to avoid oxidation at the shuttle electrode surface that mates with the liquid metal electrode is to enclose the circuit breaker in a sealed oxygen free environment; in this case, conventional copper- or silver-based shuttle electrodes can be used with a liquid electrode, as long as the liquid metal electrode does not react with copper or silver. Another known method is to use a "noble metal" such as gold, platinum, or palladium in air. A particularly desirable solution is to use a molybdenum-surfaced electrode, since molybdenum does not oxidize in air below 600° Celsius; even though molybdenum has low conductivity for a metal (resistivity 85× that of copper), a thin coating of molybdenum on a substrate metallic electrode results in an oxide-free surface that couples very well with liquid metal electrodes, without the added resistance due to an oxide layer; the resistance through the molybdenum per se is negligible if it is only a mm or less thick on the electrode, as may be obtained by plasma spray or various PVD (physical vapor deposition) processes.

Liquid metal electrodes typically comprise a sintered porous metal structural component formed by a powdered metallurgy processes that is wetted and flooded by a liquid metal such as gallium or a low melting gallium alloy. Sodium, sodium/potassium eutectic, and mercury have also been used in liquid metal electrodes, but are less desirable than gallium-based based liquid metal electrodes. Gallium will oxidize, so gallium-based electrodes must be protected within an oxygen-free container which may contain gas, liquid, or vacuum in addition to the solid movable parts of the rotary motion multi-stage Commutating Circuit Breaker of FIG. 7. The added cost of the gas-tight containment structure in order to be able to use gallium based liquid electrodes is well justified in the case of a 600 MW DC circuit breaker, such as that of FIG. 7. If an oxygen-free environment must be maintained for the gallium, then there is also no need for the sliding surfaces of the non-liquid-metal electrodes to be oxidation resistant materials (the non-liquid-metal electrodes include all the shuttle electrodes and all but one of each commutation zone's stator electrodes); in such a design the sliding electrodes would likely be based on an aluminum, copper, or silver composite, rather than molybdenum.

FIG. 7 represents a 31.5 cm diameter barrel-shaped commutating shuttle and it's mating stator housing (not shown in detail; the stator electrodes are mounted in the stator housing though). The barrel-shaped commutator 280 is 99 cm in circumference and contains 6 conductive shuttle electrodes that take the shape of conductive strips on the outside surface of the barrel, embedded in an insulating material. These six conductive shuttle electrode strips are arranged in pairs, wherein the two shuttle electrode strips in each pair are electrically connected through an insulated conductor (220, 240, or 260) that is located inside the barrel body, behind the commutating shuttle electrodes. Each pair of electrically connected shuttle electrodes defines a stage of the three-stage Commutating Circuit Breaker of FIG. 7. The outermost surface of the shuttle electrodes is best made from a highly conductive metal or composite which is also wear resistant, and which does not oxidize during use. Oxidation can either be prevented by excluding oxygen, or by using an oxidation resistant metal such as gold, platinum, or molybdenum. Where oxygen is excluded, a particulate hard particle/soft metal matrix composite with good electrical conductivity, such as silver- or copper-impregnated porous structures based on sintered metals; for example chromium powder as in U.S. Pat. No. 7,662,208, or tungsten powder, as in commercial electrodes from Mitsubishi Materials C.M.I Co. Ltd. (http://group.mmc.co.jp/cmi/en/010204.html) are suitable. Aluminum/silicon carbide electrodes are also suitable in an oxygen-free environment. Where oxygen is not excluded, Molybdenum is a favored contact surface for all the non-liquid-metal electrodes; molybdenum that is flame sprayed onto aluminum/silicon carbide electrodes is especially favorable. Although a version of the Commutating Circuit Breaker of FIG. 7 could be made to operate in an air environment, it would not be possible in that case to use liquid metal electrodes, and so such an air-matrix Commutating Circuit Breaker would not be able to handle 2000 amps normal full load with only one kW of on state energy loss, if it were the size of the breaker of FIG. 7. Also, such an air matrix breaker would need to have increased spacing between stator electrodes to be able to handle the 300 kV envisioned for the Commutating Circuit Breaker of FIG. 7, so a 300 kV air matrix breaker for 300 kV and 2000 amps would need to be much larger than the 31.5 cm diameter of FIG. 7.

The stator housing of FIG. 7 contains six stator electrode commutating zones; each commutating zone contains a series of four stator electrodes that are connected in a series/parallel arrangement to the moving shuttle electrode as it moves. The first electrode in each group of four neighboring stator electrodes is a liquid metal electrode, and the other three electrodes are sliding metal contacts. Each of the six commutating zones has 4 separated and insulated stator electrodes that connect the power to 4 different resistive paths as the shuttle 280 moves. Take for example the first commutation zone containing individual resistances 226, 227, 228, and 229: as the shuttle moves the resistance through this zone increases approximately through this sequence of resistances: 226 initially, then 227, then 227+228; then 227+228+229; then an open circuit (effectively infinite resistance). This discussion lumps the resistive contribution of the sliding electrodes in with the entire circuit, including lead wires and resistors if any, as well as the sliding electrode resistance. Thus, to be specific, resistance 227 includes resistance of the lead wires and the contact resistance between stator electrode 223 and the shuttle electrode 221.

The six lowest resistances in the six commutation zones of FIG. 7 (226, 236, 246, 256, 266, and 276) are connected through liquid metal stator contacts 222, 232, 242, 252, 262, 272 to minimize on state losses and heat generation. To achieve the target of losing 1.0 kW to on state losses at 2000 amps in the closed circuit condition, the total resistance of the path from Pole A to Pole B in FIG. 7 would be 2.5 E-4 ohms. Even lower resistance than this is feasible and practical. Achieving lower resistance entails using a more massive rotor, which requires more torque to accelerate; there exists an optimum design basis on-state resistance target that needs to be determined for each particular case.

When actuated the commutating shuttle of FIG. 7 rotates 18.2 degrees to open the circuit; then continues to rotate while decelerating to the open circuit position (a total of 31.6 degrees); this is an average rotation of 4.55 degrees per commutation within a particular commutating zone; however it is desirable to control the actual time of each commutation step in order to optimize performance of a Commutating Circuit Breaker. There are two variables that determine the timing of the commutations: the angular position of rotor 280 versus time, and the angular displacement of the rotor at each commutation step, which is a geometrical relationship set by the design of the commutating rotor and the commutating stator. In principle, every stator electrode can have a unique and different circumferential width and the distance between next neighbor stator electrodes can also be varied, as can the starting position offsets of the first stator electrode trailing edge (in each zonal group of four stator electrodes) in relation to the trailing edge of the matching shuttle electrode. One can also adjust the spring or other drive method used to cause the counterclockwise radial acceleration; for example, a spring may accelerate the rotor throughout the time of the commutations, or alternatively, a very stiff spring could impart the same "kick" (total transferred radial momentum) using up only a small part of the 18.2 degrees of radial motion that the commutating rotor moves during commutation. In this scenario, the commutating rotor is in free flight during most of the time that the Commutating Circuit Breaker rotor is moving and causing commutations.

By making a few simplifying assumptions, I can model an optimized sequence for the eighteen resistor cut-ins that the 18 commutations of the Commutating Circuit Breaker of FIG. 7 allows. Table 1 gives the calculated target commutation times and inserted resistances, based on an assumed circuit inductance of 100 millihenries (realistic for a 300 kV HVDC line); 10 kA at the first commutation; an upper voltage limit of 500 kV (1.67× normal voltage); and a lower voltage limit of 360 kV during the circuit opening (1.2× normal voltage).

TABLE 1

Optimized Commutation Times & Resistance Steps for FIG. 7 Breaker

| commutation | time, ms | R (ohms) | Δtime at R, ms | amps | (inductive energy, joules) |
|---|---|---|---|---|---|
| #1 | 0 | 50.0 | not defined | 10000.0 | 5000000 |
| #2 | 0.657 | 69.4 | 0.657 | 7200.0 | 2592000 |
| #3 | 1.130 | 96.5 | 0.473 | 5184.0 | 1343693 |
| #4 | 1.471 | 134.0 | 0.341 | 3732.5 | 696570 |
| #5 | 1.716 | 186.1 | 0.245 | 2687.4 | 361102 |
| #6 | 1.893 | 258.4 | 0.177 | 1934.9 | 187195 |
| #7 | 2.020 | 358.9 | 0.127 | 1393.1 | 97042 |
| #8 | 2.111 | 498.5 | 0.092 | 1003.1 | 50307 |
| #9 | 2.177 | 692.3 | 0.066 | 722.2 | 26079 |
| #10 | 2.206 | 961.6 | 0.029 | 520.0 | 13519 |
| #11 | 2.240 | 1335.5 | 0.034 | 374.4 | 7008 |
| #12 | 2.251 | 1854.9 | 0.011 | 269.6 | 3633 |
| #13 | 2.269 | 2576.2 | 0.018 | 194.1 | 1883 |
| #14 | 2.281 | 3578.1 | 0.013 | 139.7 | 976 |
| #15 | 2.291 | 4969.5 | 0.009 | 100.6 | 506 |
| #16 | 2.300 | 6902.1 | 0.009 | 72.4 | 262 |
| #17 | 2.305 | 9586.3 | 0.005 | 52.2 | 136 |
| #18 | 2.308 | 13314.3 | 0.003 | 37.6 | 71 |
| final circuit open | 2.311 | >1E8 | | 27.0 | 37 |

I am aware that since one cannot pick where a circuit fault occurs it is not logical to take the normal system inductance as being a realistic estimate of system inductance in a fault; this means that the system inductance may not be available to slow the inrush of current in a fault. I will return to a discussion of low inductance systems later, but for now, this case allows us to consider a realistic high inductance fault; in this case the inductively stored magnetic energy that must be dissipated to open a faulted HVDC circuit at 10 kA is 5 million joules (5 MJ). A particularly common type of pulse-rated resistor in power electronics applications are carbon/alumina sintered resistors such as those of HVR International (http://www.hvrint.com/lineardiscsolid.htm); these resistors can absorb 111 J/gram in routine service, which means that 45 kg of HVR disc resistors would be needed to absorb 5 MJ of inductive energy as modeled in Table 1.

The first commutation inserts 50 ohms, which is based on limiting the voltage and current at the design basis maximum (500 kV and 10,000 amps). After the first insertion of 50 ohms resistance at time zero, with 10 kA (10 kiloamps) flowing, it takes 0.657 milliseconds (ms) for the voltage to decay from 500 kV to 360 kV; this is the time of the second commutation, after which the resistance is 69.4 ohms, and it takes only 0.473 ms for the voltage to decay from 500 kV to 360 kV, and each subsequent resistance level applies for less elapsed time than the resistance level before, because at higher resistance, the exponential decay of current is faster. Each step of this repeated exponential decay of current (i) occurs according to this equation:

$$i(t)=Ie^{-(R/L)t} \quad (1)$$

Where I is the current when the resistance R (in ohms) is first inserted, and L is the inductance (in Henries), and t refers to time (in seconds) since resistance R is first inserted. Resistance R is repeatedly reset during the operation of the Commutating Circuit Breaker (as in Table 1); this is a highly efficient way to absorb inductively stored magnetic energy during opening of a DC circuit with a lot of stored magnetic energy. By holding the voltage 20% above normal operating voltage during opening of the circuit breaker, we can guarantee that any batteries and/or capacitors that may be on the circuit will not discharge through the fault during the time the circuit is being opened. In a realistic opening, this will not be the case, since for the last few resistance levels, the inductive energy decay drops the voltage below normal system voltage in a few microseconds (and so some power from batteries or capacitors will flow to maintain voltage across the Commutating Circuit Breaker). The range of voltage from 500 kV to 360 kV is an unusually narrow control range for voltage excursions during opening of the circuit breaker (voltage switching transients), which is enabled in this case by the eighteen commutation steps that the design of FIG. 7 allows. The graph below shows how inductively stored magnetic energy and current are reduced during the set or resistance insertions defined by Table 1. (The resolution of the logarithmic graph (FIG. 16) is too low to show the repeated exponential nature of the current decay, but it does show the repeated voltage increases (from 360 kV to 500 kV) at each commutation as visible blips.)

The final open circuit condition occurs when one of the shuttle electrodes slides past the last of that zone's sequence of stator electrodes into its highly insulating final resting zone. Although in the design of FIG. 7 all six shuttle electrodes slide past the last of each zone's sequence of stator electrodes into a highly insulating final resting zone, only the first shuttle electrode to do so is part of the circuit-opening sequence of switched-in resistances; after the circuit is opened, the remaining final five commutations that occur in the other five zones merely serve to open the circuit through the other five commutating zones in a manner that can be viewed as redundancy on the final circuit opening. Note from Table 1 and the graph shown in FIG. 16 that that the Commutating Circuit Breaker with 18 commutations through resistors reduces the stored inductive energy from 5 million joules to just 37 joules at the time when the circuit is opened; the current is squeezed down from 10 kA to 27 amps at the time the circuit is opened. The time delay between some of the commutations of FIG. 7 is too short to reliably execute the delays using mechanical commutation; note though that slower commutations on the order of 0.4 milliseconds between each commutation are achievable, and that this would result in a Commutating Circuit Breaker that opens the circuit in 7.2 ms after the first commutation (about 8 milliseconds in total, including the first commutation).

In the series connected multi-stage Commutating Circuit Breaker design of FIG. 7, six commutating zones are connected in series. In each commutating zone, the shuttle electrode moves from an initial closed circuit position through a total of three commutations plus the rotation to the final open circuit condition; at each commutation an additional resistor is switched into the circuit. A "power level" is defined in terms of the time or angular displacement of the commutating shuttle over which all six component commutators go through one commutation. If the size and spacing of the stator electrodes is all the same, then a total rotation of the commutating shuttle of 4.55 degrees occurs for each power level of switching; somewhere within these 4.55 degrees of rotation, all six component resistive commutations would occur in the six different physical series connected commutators (six commutation zones). This however is not the most desirable arrangement; instead, it is more desirable to adjust the times between commutations according to the expected current flowing at a given time (as in Table 1). It is therefore desirable to offset either the shuttle electrodes slightly from a 45 degree angle, or offset the stator electrode-containing commutating zones slightly; either by varying the width or spacing of the stator electrodes or by angularly offsetting each commutation zone from 45 degrees, or both. In the realistic case of a radially accelerating commutating shuttle that then decelerates to its final resting place, computing the offsets of each electrode from the symmetrical design of FIG. 7 becomes rather complex, because of the need to account for both the motion and geometry of the shuttle.

The optimum time delay between commutations in the series connected multi-stage Commutating Circuit Breaker of FIG. 7 depends on the system inductance and voltage; the size of the resistance insertions is limited by the maximum tolerable overvoltage. It is common during switching operations to see voltage spikes that are more than twice the normal voltage; by breaking the resistance insertions into eighteen step changes in resistance, it is possible to limit the overvoltage transients during opening of the circuit to less than 70% above normal voltage. One still needs to deal with the last bit of inductive energy; in the example of Table 1, only 37 joules need to be dissipated or stored to complete the opening of the circuit after the eighteen commutations through increasing resistance; as in U.S. Pat. No. 3,534,226 this can be accomplished with a small capacitor.

Figure 15:
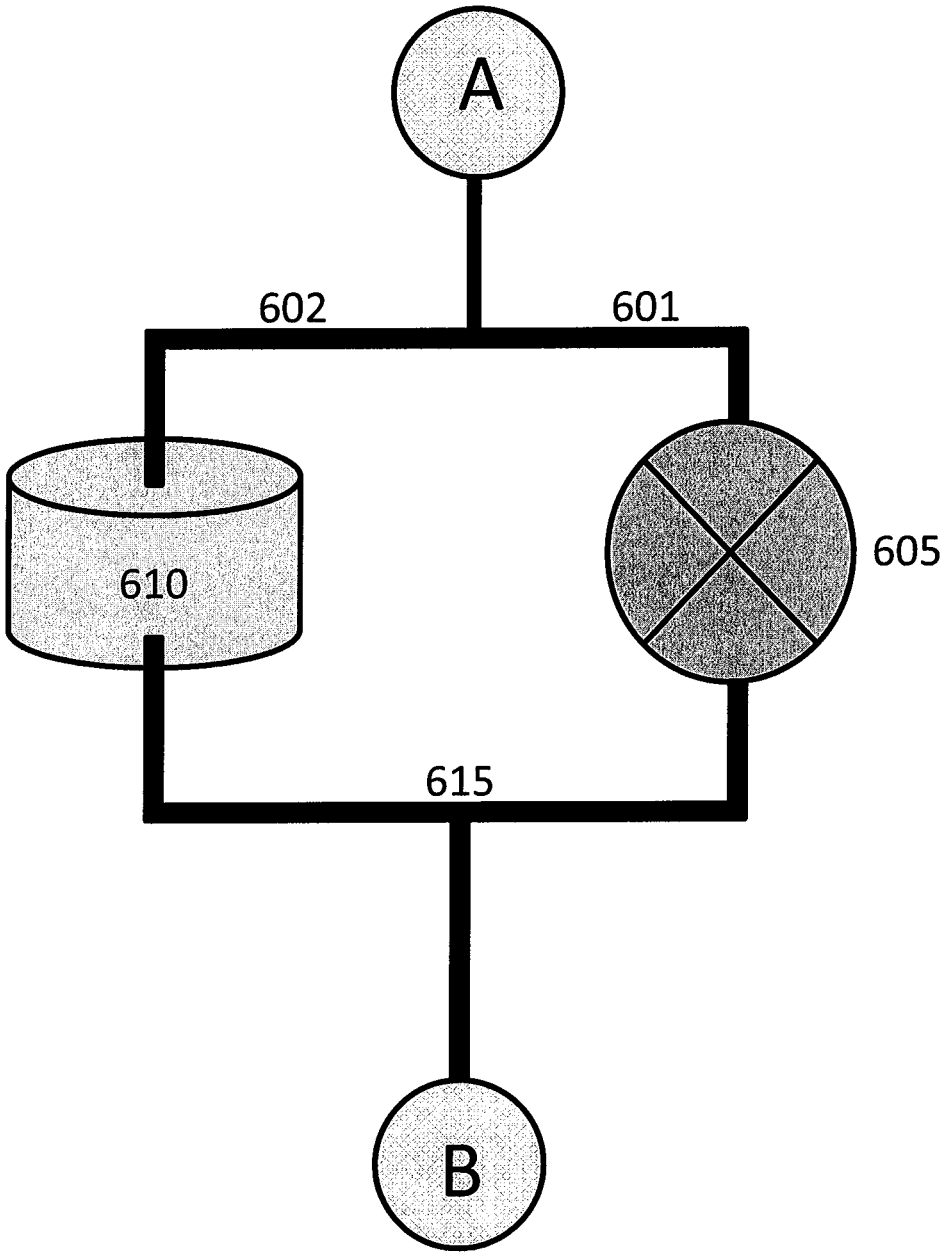
FIG. 15: Conceptual hybrid Commutating Circuit Breaker combining fast switch and Commutating Circuit Breaker

The Commutating Circuit Breakers of FIG. 6 or FIG. 7 could also be deployed in a hybrid circuit breaker design such as FIG. 15, in which the critical first commutation is done by a very fast switch (faster than one ms), which commutates current to the main commutating circuit breaker, which then finishes opening the circuit over a period of ~10 ms. At time zero, the first commutation occurs via a fast switch which is hooked up in parallel with the Commutating Circuit Breaker (see FIG. 15); this first commutation could be performed by several different kinds of switches known in the prior art, or by a specialized fast acting Commutating Circuit Breaker that is simplified to be simply a single stage, single step switch. This will be discussed in more detail below, in relation to Commutating Circuit Breakers for low inductance circuits. One general point that should be mentioned at this stage is that for rotary-motion Commutating Circuit Breakers, fast actuation favors small diameter commutating rotors. Using small diameter rotors, it is possible to reach the first commutation in less than 0.2 ms (200 microseconds).

The stator electrodes of FIG. 7 are mounted through the stator housing (not shown in FIG. 7) in such a way as to be replaceable without taking the stator assembly off the core. Two different kinds of stator electrodes are used in the design of FIG. 7, liquid metal electrodes and solid metallic or metal composite electrodes. Each of the six sets of stator electrodes has a lead stator electrode (222, 232, 242, 252, 262, and 272) that has a liquid metal surface through which most of the current flows in the on state. These lead stator electrodes carry most of the on-state current, and need to have very low resistance across the interface between themselves and the connecting rotor electrode to meet the low maximum heat generation (1000 watts) that has been adopted as a design basis for the Commutating Circuit Breaker of FIG. 7 at 600 MW transmitted power. The hybrid circuit breaker design of FIG. 15 can relax the requirement of very low resistance through the circuit breaker, since in the on state, most of the current flows through the parallel path through the fast switch. When a rotary multistage Commutating Circuit Breaker of FIG. 7 is used in that way, there is no need to use liquid metal electrodes in the Commutating Circuit Breaker, which significantly simplifies the design.

It is easier to submerge the cylindrical commutating rotor of FIG. 7 in an arc suppressing fluid compared to a linear movement Commutating Circuit Breaker because rotation of a circularly symmetrical cylinder does not produce form drag, whereas linear motion in a fluid necessarily involves form drag, which can significantly inhibit rapid motion of the commutating shuttle in a liquid. The cylindrical design also enables a liquid submerged system with a very low volume of liquid compared to a linear actuated design. Sparking can be highly inhibited by fluid surrounding the separating electrodes, especially if the fluid is held at high pressure.

Eighteen resistance insertions occur during the opening of the circuit in FIG. 7; these can be timed precisely by adjusting the exact angles of rotation at which each of the 18 separations of stator electrode and shuttle electrode occur, as the trailing edge of a shuttle electrode moves away from the trailing edge of a particular stator electrode. This fine timing adjustment of switching events down to the microsecond time scale is built into the structure of the rotating Commutating Shuttle 280, which produces a predictable sequence of switching events that occur when the circuit breaker is tripped. This switching sequence cannot be adjusted in response to precise circuit conditions that are sensed at the time of tripping the circuit breaker, as can the fast individual switches of U.S. Pat. No. 3,534,226 for example; however, by combining multiple switching functions into a single device, the inventive Commutating Circuit Breaker is far more economical than the array of fast switches envisioned in U.S. Pat. No. 3,534,226; as a result it is practical to contemplate a larger number of commutations per circuit opening than was envisioned in U.S. Pat. No. 3,534,226; the larger number of switching events in the inventive Commutating Circuit Breakers of FIG. 6 or 7 imply smaller changes in resistance level per commutation compared to the five resistive insertions envisioned in U.S. Pat. No. 3,534,226. Smaller changes in resistance per commutation causes lower voltage transients due to individual switching events.

The adjustment of the timing of individual commutations in the design of FIG. 7 can be accomplished by offsetting the shuttle electrode trailing edges slightly; approximately by multiples of the angle $\Delta q$, where $\Delta q \sim q/m$, where:

- total offset angle per commutation within a single stage q is defined as the total angular motion of the shuttle to move a point on the shuttle from the trailing edge of one stator electrode, for example 222 to the leading edge of the next stator electrode, for example 223; q is approximately equal to the total rotation of the shuttle during opening of the circuit divided by n; where n is the number of stator electrodes in each commutation zone (n=4 in the case of FIG. 7); note that the last commutation in each zone is to a very high resistance final resting position beyond the last stator electrode (such as to the left of stator electrode 225);
- total number of commutation zones=m; in FIG. 7, m=6;
- total number of commutations during opening of the circuit=m(n−1)+1 (this is because the first commutation to a highly insulating position is the last commutation from a circuit point of view, so the movement of all the other five shuttle electrodes into the highly insulated positions are electrically irrelevant after the first electrode advances into the highly insulated position, thus opening the circuit.

If the shuttle moved at constant speed, then setting $\Delta q=q/m$ would space the six component commutation times evenly; however if the shuttle 280 is accelerating during the time that commutations occur, then the angular spacing between subsequent commutations must be adjusted to compensate for the changing speed of rotation of the shuttle, in order to evenly spread the commutations out over time. (And, it is not actually desired to have even temporal spacing between the commutations, as discussed above.) One could also offset the individual commutation zones (of which there are six in FIG. 7), or even adjust the size and spacing of individual stator electrodes within a commutating zone.

Each time a commutation occurs the total voltage across the circuit breaker is redistributed over the six commutation zones proportional to the fraction of the total resistance from Pole A to Pole B that applies to the given commutation zone. When a new, higher resistance is switched into the circuit, the largest proportion of the total voltage gradient will be across the commutating zone with the highest resistance. In the design of FIG. 7, configured as a stand-alone circuit breaker (as opposed to a hybrid configuration such as that of FIG. 15), the first commutation represents such a large increase in resistance that effectively the entire 500 kV could be across the first switched-in resistor, and voltage withstand must be suitably high in that commutation zone.

On the other hand, in the case of a hybrid circuit breaker as in FIG. 15, the initial resistance of the Commutating Circuit Breaker (prior to any movement of the rotor) would be 50 ohms, which can be spread out among the six commutation zones equally by making the resistance of each of the six lowest resistance electrical links (226, 236, 246, 256, 266, and 276 in FIG. 7) 8.33 ohms, for example. When the current is diverted through the Commutating Circuit Breaker 605 by fast switch 600 in FIG. 15, Commutating Circuit Breaker 605 can be for example a rotary Commutating Circuit Breaker of FIG. 7. In this case, none of the stator electrodes in FIG. 7 needs to be a liquid metal electrode (because only a small part of the on-state current flows through the Commutating Circuit Breaker 605 of FIG. 7). The 50 ohms initial resistance would best be divided between five of the six commutation zones; the remaining commutation zone with low resistance will be the zone where the second commutation occurs (this second commutation is the first commutation caused by movement of rotary commutating shuttle 280 in the hybrid design of FIG. 15).

The properties that influence whether an arc, a small spark, or no spark at all will be struck at the moment of separation of shuttle electrode and stator electrode include strongly the current that is flowing at the moment of separation, and the dielectric strength of the fluid surrounding the separating conductors. The dielectric strength of fluids increase with pressure. FIG. 7 shows an end view of a barrel-shaped version of a rotary motion Commutating Circuit Breaker. This shape makes it quite feasible to operate a high pressure liquid-filled circuit breaker, using only a small amount of liquid because of the closely matching shape of the shuttle and the stator. Limiting the dielectric fluid to only a few cubic cm is feasible in a barrel-shaped Commutating Circuit Breaker such as that of FIG. 7. This means that high dielectric strength fluids such as perfluorocarbon fluids could be economically used. The major advantage of using high pressure lubricants in a barrel-shaped Commutating Circuit Breaker is that the standoff distance between neighboring stator electrodes can be reduced if the gap between the solid dielectrics is flooded with a very high dielectric strength high pressure fluid. This will allow more compact Commutating Circuit Breakers. It has not been practiced commercially in the prior art to operate switchgear at high liquid pressure, but the unique shape of the barrel-shaped rotary Commutating Circuit Breaker allows for a very small volume of high pressure liquid, which is not dangerous in terms of stored energy.

It is desirable to create multistage Commutating Circuit Breakers as in FIG. 6 (linear motion) and FIG. 7 (rotary motion), especially for high voltage DC applications; the multiple stages divide the voltage, thus allowing for lower voltage per stage. In order to accomplish this, commutating shuttles containing pairs of stator electrodes which are connected to each other electrically but are insulated from each other at the surface of the commutating shuttle are required. Said insulating material can comprise a polymer, an inorganic glass, a ceramic, a cementitious material, or a composite of two or more of these components. Specific examples of insulators that may be used to insulate around the stator electrodes of a commutating shuttle, but not meant to limit the invention, include:

1. fiber-reinforced composites based on a matrix phase curing polymer (such as fiberglass-epoxy, polyaramid-epoxy, boron fiber-epoxy, fiberglass-polyester, and fiberglass-maleimide polymerizing systems);
2. engineering-grade moldable plastics (defined as polymers with tensile modulus >2.5 GPa and tensile strength >40 MPa, which may be unreinforced polymers; or polymers reinforced by fillers such as chopped fibers; non-conductive nanotubes, platy fillers, or nanosheets; or self-reinforcing thermotropic liquid crystal polymers (LCP) such as Vectra™ LCP from Ticona;
3. cement composites, including fiber-reinforced and polymer latex toughened cement composites; Portland cement and magnesium phosphate cements are specifically applicable as base cements for these composites, but other types of cement such as high alumina cement or plaster of Paris-based compositions also fall within this category;
4. plasma sprayed or flame-sprayed coatings on metals;
5. insulating polymeric syntactic foam (mainly useful for its combination of low density and high compressive and shear strength);
6. nanocomposites.

Each shuttle electrode on a multistage commutating shuttle aligns with several different stator electrodes as the shuttle moves, and every shuttle electrode is also connected to a second shuttle electrode at a different location on the commutating shuttle, such that the two shuttle electrodes are insulated from each other on the surface plane.

The shuttle electrodes of a multistage commutating shuttle occupy less than half of the total surface area of the commutating shuttle, and in most cases occupy less than 10% of the surface area of the commutating shuttle. The commutating shuttle can be fabricated from previously formed metallic and insulative components; or, the commutating shuttle can be obtained by overmolding an insulator onto a metallic core. Overmolding can be accomplished via reaction injection molding (RIM) or by thermoplastic injection molding, for example.

Figure 8:
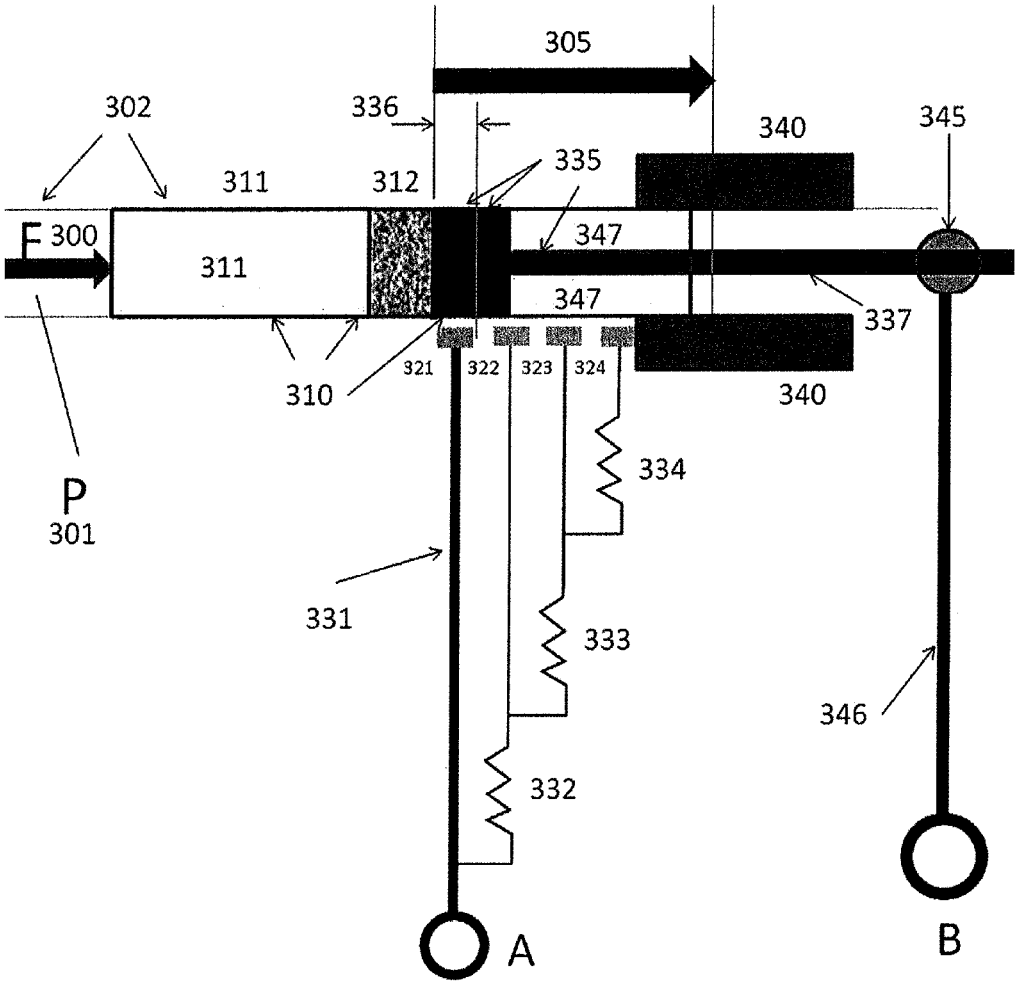
FIG. 8: Single stage commutating shuttle with electrical stress control behind moving electrode; circuit shown just prior to actuating motion of the commutating shuttle.
Figure 9:
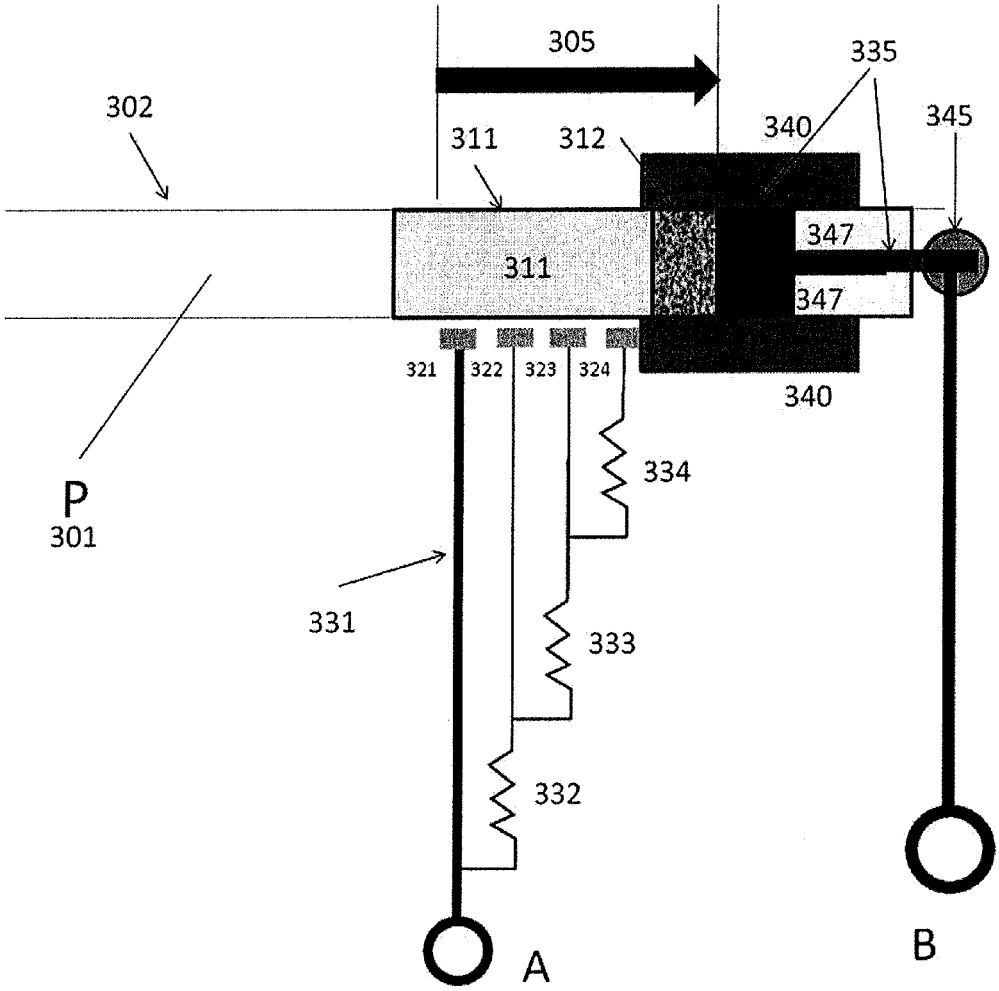
FIG. 9: Single stage commutating shuttle with electrical stress control behind moving electrode; circuit shown at the end of the motion of the commutating shuttle.

FIGS. 8 and 9 depict a Commutating Circuit Breaker with commutating shuttle 310 which is composed of a highly conductive part 335, a transition plug 312, and an insulating part 311. The commutating shuttle 310 is actuated by pressure P (301) behind the commutating shuttle insulating plug 311. Insulating plug 311 must be long enough to lie over all the stator electrodes (321, 322, 323, 324) at the end of travel of the commutating shuttle, and to overlap with insulating layer 340; in this fully open state the insulator overlap will create a total resistance between Pole A to Pole B (from Pole B through the slip ring 345 to shuttle electrode 335 to Pole A, through transition plug 312 and through a portion of layer 311 to a final connection through the stator electrodes 321, 322, 323, 324 to Pole A) greater than $10^8$ ohms in the fully open state.

FIGS. 8 and 9 depict just one commutation zone (in two different positions) to look at a single zone by itself. The simplified depiction of a single commutation zone with only three resistance insertions prior to opening the circuit makes it easier to describe and discuss certain aspects of Commutating Circuit Breakers. The single stage Commutating Circuit Breaker of FIG. 8 has only one commutation zone, with 5 resistance levels including both the closed circuit position (near zero resistance) and the open circuit position (practically infinite resistance). Power is linked from Pole B through slip ring 345 to the shuttle electrode 335, and from there through a series of different stator electrodes connected to increasing resistances given approximately by:

1. Resistance Level One: current flows primarily through stator electrode 321 and then through the minimal resistance of a lead wire with resistance 331 to the opposite Pole A of the circuit breaker.
2. Resistance Level Two: current flows primarily through stator electrode 322 and then through resistance 332 to the opposite Pole A of the circuit breaker.
3. Resistance Level Three: current flows primarily through stator electrode 323 and then through resistance 332+333 to the opposite Pole A of the circuit breaker.
4. Resistance Level Four: current flows primarily through stator electrode 324 and then through resistance 332+333+334 to the opposite Pole A of the circuit breaker.
5. Resistance Level Five is the open circuit condition in which total resistance $>10^8$ ohms; in this case the resistance is 332+333+334+resistance through the leakage path from 335 to 324 through 311 and 340 (see FIG. 9).

Actuation of the circuit breaker begins with the commutating shuttle 310 (composed of components 311, 312, 335, and 347) in the closed circuit state of FIG. 8; the resistance through the Commutating Circuit Breaker in the closed circuit case is also known as the "on-state resistance" of the circuit breaker. The on-state resistance of the circuit breaker of FIG. 8 is actually comprised of two component resistances R1 and R2 through parallel circuits:

R1 is resistance of slip ring 345+lead resistances 346+337+contact resistance between shuttle electrode 335 and stator electrode 321+lead wire resistance 331

R2 is resistance of slip ring 345+lead resistances 346+337+contact resistance between shuttle electrode 335 and stator electrode 322+resistance 332;

the total on state resistance is then given by:

$$Rtotal = \frac{R1 \times R2}{R1 + R2} \tag{1}$$

Thus, in general, when the shuttle electrode 335 is touching two stator electrodes, the actual resistance should be calculated as a parallel path resistance. In the on-state closed circuit condition, R2>>R1 (because R2 includes resistance 332, the first in a series of inserted resistances); most of the current goes through the low resistance path R1, and the total resistance Rtotal is only a little less than the resistance through this path alone. Just to make this concrete, consider the case of a normal full load of 1200 amps, and a design basis maximum heat loss in the on state due to ohmic losses ($I^2R$) of 100 watts; this requires that Rtotal in the closed circuit case (on state) can be no more than 69 micro-ohms; the first inserted resistance would be ~0.40 ohms, so equation 1 implies that the resistance of the parallel circuit would only be 0.017% lower than the simple connection through only one resistive path (R1).

During commutation, equation 1 implies that as the contact area between shuttle electrode 335 and stator electrode 331 goes to zero, the resistance through R1 increases until is surpasses R2, just before commutation [because contact resistance scales with 1/(contact area)]. (I will follow up on this concept later, and show that by grading the resistivity of the trailing edges of the electrodes this effect can be further enhanced to prevent sudden shut off of flowing current at the time of commutation.) The Commutating Circuit Breaker of FIGS. 8 and 9 is designed so there are two paths such as R1 and R2 through metal electrodes at all times during a commutation event, except at the very end (as the Commutating Circuit Breaker approaches its fully opened state).

In the design of FIG. 8, the portion 336 of the shuttle electrode 335 that is initially in contact with stator electrode 321 needs to be made of a high conductivity material to minimize the on state resistance; stator electrode 321 should also be made of a high conductivity material as well, perhaps comprising a liquid metal electrode in part (to achieve low on-state resistance), but need not have the same composition as the shuttle electrode 335. The other stator electrodes 322, 323, 324 can be formed from less expensive and/or less conductive metals or carbon.

There is an interesting design trade-off in re the trailing edge 336 of shuttle electrode 335: to minimize on-state losses it is desirable that the entire portion of the shuttle electrode 335 that is in contact with stator electrode 321 should be highly conductive; however, it is also desirable to have the trailing edge 336 of the shuttle electrode 335 have reduced conductivity to soften the transition from conductive electrode to insulator electrically; in the design of FIGS. 8 and 9, the desired gradation of conductivity is accomplished by the separate semiconductive polymeric transition plug 312, which is electrically part of the moving electrode, even though it need not be bonded to the metal portion of the commutating shuttle 335 at all. As discussed below, the trailing edge of the metal portion of the commutating shuttle 335 could also be a relatively low conductivity metal which has the effect of smoothing the transition between the metallic shuttle electrode 335 and the transition plug 312, though this is not envisioned in FIGS. 8 and 9.

As the commutating shuttle 310 moves to the right from the initial position of FIG. 8, there will also be an electric current path through transition plug 312 to a sequence of stator brushes (321, 322, 323, and 324). This means that at some points during the opening of the circuit breaker there will be electrical paths through three different stator brushes, with the leftmost connection being through the transition plug 312. It is important to avoid conditions in which excessive heating occurs in the transition plug 312, as will be obvious to a person skilled in the art of electrical engineering. When shuttle electrode 335 leaves contact with stator electrode 321, there is a sudden increase in resistance through 321 and 331 as current through this path must then pass through the transition plug 312 after the metal electrodes 335 and 321 separate, which quickly commutates the current to the path through R2, but much more softly than if the trailing (left) edge of shuttle electrode 335 would abut an insulator such as 311 rather than semiconducting polymer transition plug 312. An important consideration during this commutation is that current through the semiconducting transition plug 312 must not cause melting or damage to the material used to create semiconducting transition plug 312. This can be avoided by making the resistivity of transition plug 312 high enough so that only a minor portion of the current flows through transition plug 312 in every commutation except the last one. At the end of the motion of commutating shuttle 310, semiconducting transition plug 312 performs the final quench of the last of the inductive energy. At the final commutation, as shuttle electrode 335 moves to the right of stator electrode 324, the only electrical connection remaining between Pole A and Pole B goes through the semiconducting transition plug 312. Because of the graded resistivity in transition plug 312, a soft shut off can be provided if current and voltage is low enough to not damage the semiconducting material that makes up transition plug 312 during the shut off. In effect, the last several commutations occur as different resistivity layers within transition plug 312 pass the trailing edge of stator electrode 324. (Note that the size of transition plug 312 could just as easily be as long as insulating plug 311, provided that the total movement 305 is increased enough so that insulating plug 311 lies over all the stator electrodes (321, 322, 323, 324) at the end of travel of the commutating shuttle, and overlaps with insulating layer 340 at the end of the commutating shuttle 310 displacement to the right, to achieve greater than $10^8$ ohms in the fully open state.)

Figure 16:
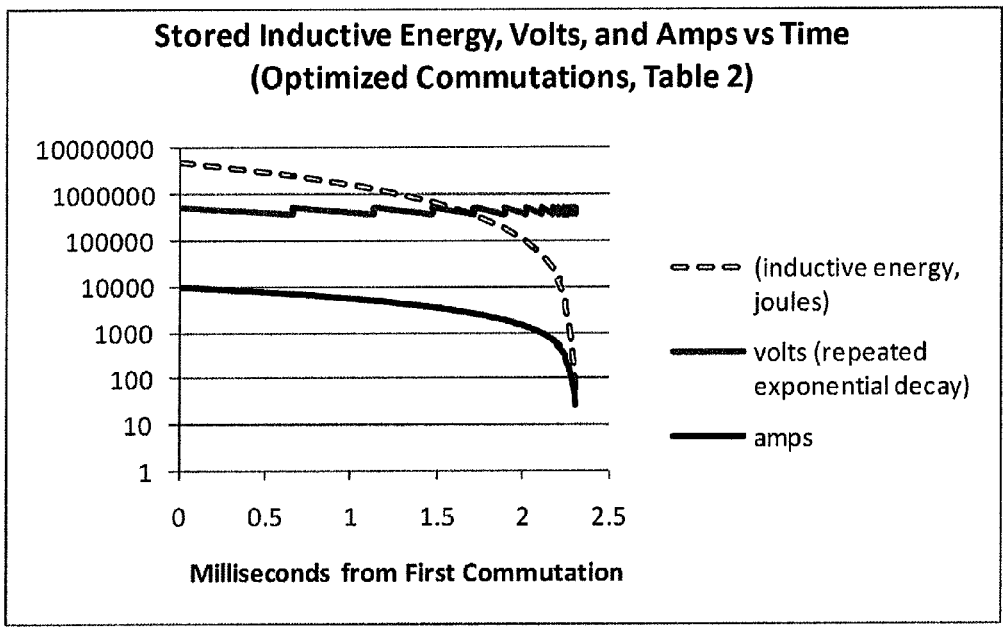
FIG. 16: Quenching of current and energy for an optimized 18-stage Commutating Circuit Breaker; also shows excellent voltage control during quench.

Consider FIG. 16, which shows voltage, current, and energy data from a particular Commutating Circuit Breaker similar to that of FIG. 7, in a relatively high inductance circuit that corresponds to a regional 300 kV HVDC transmission line with eighteen commutations that are each optimally timed to achieve fast circuit opening with less than 70% overvoltage during opening. Each commutation inserts enough resistance to shift the voltage up to 67% above normal, then just enough time is allowed for the voltage to decay to 20% above normal, at which time, the next insertion of resistance (commutation) increases the voltage back up to 67% above normal, and so on (see Table 1 for details). This is a relatively small voltage swing per commutation, but even at this narrow voltage range, only 13.93% of the initial 5 megajoules of inductive energy remains after three resistance insertions; these three insertions+subsequent exponential decay periods take 1.47 ms, not including the time before the first commutation. If instead of allowing the voltage to decay only to 20% above normal voltage, each exponential decay period following a commutation is long enough to allow the voltage to decay to normal line voltage (300 kV in the example of FIGS. 7 and 16, and Table 1), then only 4.67% of the initial 5 megajoules of inductive energy remains after three resistance insertions (still based on maximum over-voltage of 67%); these three insertions+subsequent exponential decay periods to drop voltage to line voltage take 3.06 ms, not including the time before the first commutation. Now consider that the simplified Commutating Circuit Breaker of FIGS. 8 and 9 can perform the eighteen commutations defined by Table 1; the first three commutations are via stator electrodes 322, 323, and 324 and the connected resistors 332, 333, and 334; these three commutations occur over a time period of 1.47 ms, after which the inductive energy has been reduced to 13.93% of the original; then the next fifteen virtual commutations occur within semiconducting transition plug 312 over an elapsed time of 0.84 ms. By using a larger voltage swing per commutation, the inductive energy can be squeezed down to about 1-5% of its original value by only three commutations through stationary resistors; after that, it is far more feasible to perform the remaining 15 commutations via a variable resistance portion of the commutating shuttle, as in FIG. 1 (component 110) or FIGS. 8 and 9 (component 312); this is so because the mass of variable resistors required to absorb the remaining portion of the inductively stored energy in the system has been greatly reduced by the first three commutations over stationary resistors.

At equilibrium in the Commutating Circuit Breaker of FIGS. 8 and 9 (which can only occur when the shuttle electrode 310 is stationary), the current is partitioned between all parallel-connected resistive paths in inverse proportionality to the path resistance. During a commutation a true equilibrium does not actually pertain, but it is nonetheless useful to consider a pseudo equilibrium condition which is evaluated moment by moment during opening of the Commutating Circuit Breaker. In general, electrical equilibration is fast compared to mechanical motion of the commutating shuttle, or resistive heating of conductive shuttle components, so this pseudo-equilibrium condition is at least reasonable. This sort of analysis is discussed in re the examples in the next section.

It is desirable to minimize the inductance of the resistive paths shown in FIGS. 8 and 9, since each pathway will store an amount of energy $L_{path} \cdot I^2$ when the current is flowing which must be dissipated in order to commutate the current to a different path. In this case, Lpath refers just to the inductance of the current path from the point where the current turns from another alternative path to go through the given path, such as L331, which is the inductance from stator electrode 321 through connector 331 to Pole A, or L332, which is the inductance from stator electrode 322 through resistor 332 and its lead wires to Pole A. It is thus desirable in particular that resistors 332, 333, and 334 have relatively low inductance, as will be familiar to a person skilled in the art of electrical engineering.

Lets step through the actuation process for the device of FIGS. 8 and 9: pressure 301 creates force 300 by acting on the surface area of insulator 311 which is normal to the barrel 302; the force 300 moves the shuttle to the right inside the barrel 302, for a total distance 305; the electrical resistance increases in stages which are punctuated by these commutations:

1. prior to the first commutation the resistance is the parallel path resistance from R1 and R2 as defined by equation 1 above including contact resistances between stator electrode 321 and shuttle electrode 335 and between stator electrode 322 and shuttle electrode 335;
2. after the contact between shuttle electrode 321 to 335 is lost, the resistance is R2 for a time;
3. next there is a period in which the resistance corresponds to a parallel path between R2 and R3 (resistance of slip ring 345+lead resistances 346+337+contact resistance between shuttle electrode 335 and stator electrode 322+ resistance 332);
4. after the contact between shuttle electrode 322 to 335 is lost, the resistance is R3 for a time (and so on through the sequence of resistive connections).

As described previously, the application of equation 1 to calculating the actual resistance through parallel paths as described above only slightly modifies the resistance steps defined at the beginning of the discussion of FIGS. 8 and 9. The designation of the two poles in FIGS. 8 and 9 as Pole A and Pole B may equally well be reversed; the polarity through a Commutating Circuit Breaker may be reversed due to the arbitrary nature of the poles. For any of the figures shown, Pole A can be exchanged with Pole B and the Commutating Circuit Breaker will still work. Depending on which pole is live after the Commutating Circuit Breaker has opened the circuit, there will be different portions of the Commutating Circuit Breaker that are de-energized in the case of a one directional power flow (as in power delivery to a motor) when the circuit is opened. If the power source is on the A side of the breaker of FIGS. 8 and 9 then when the circuit breaker is open as in FIG. 9, shuttle electrode 335 and the slip ring 345 are de-energized (which facilitates maintenance of the slip ring 345). If on the other hand the power source is on the B side of the breaker of FIGS. 8 and 9, then when the circuit breaker is open as in FIG. 9, the stator electrodes 321-324 will be de-energized (which facilitates maintenance of the stator electrodes 321-324).

Three particularly desirable kinds of material for dielectric insulating plug 311 are:

1. Rigid syntactic foam is especially desirable for insulating plug 311, which can be thought of as a piston; It is highly desirable a very high strength to density ratio, in terms of both compressive strength and shear strength; shear strength is particularly important if the design requires a self-supporting column of syntactic foam behind transition plug 312, which is itself behind the shuttle electrode 335.

2. A hollow insulating tube that is quite strong and rigid, and capped with a strong end at the boundary with transition plug 312 could also work as insulating plug 311.
3. A highly insulating elastomeric plug which is compressed when pressure is applied to drive the commutating shuttle forward may also be used for insulating plug 311; said highly insulating elastomeric plug may also comprise an elastomeric-matrix syntactic foam to minimize mass of insulating plug 311.

As mentioned previously, elastomers are especially desirable for transition plug 312, both because of the convenience of preparing chemically similar elastomer layers with controlled resistivity, and because compression of an elastomer layer such as transition plug 312 results in a pressure against the wall which will inhibit arcing. It is optionally possible for insulating plug 311 and semiconducting transition plug 312 to be bonded together into a single physical plug comprising a first portion 311 that is a good insulator (resistivity $>10^{12}$ ohm-m), and a second portion 312 with graded conductivity from $\sim 10^{4}$ to $10^{12}$ ohm-m.

The relative convenience of creating a stack of layers of uncured elastomer compounds which are:

1. mutually cure compatible;
2. mechanically similar;
3. all with good sliding properties makes it fairly inexpensive to process, mold and fabricate elastomer plugs such as may be used in transition plug 312 with graded resistivity from $10^{-2}$ to $10^{12}$ ohm-m; it is much easier than creating all those layers in a plastic, for example. Two compatible elastomer masterbatches can be used to create the graded resistance parts. It is a conventional, known method to blend two elastomer masterbatches in various ratios to get elastomers ranging from being good insulators to being semiconductive with resistivity as low as $10^{-2}$ ohm-meter, but more conveniently down to 0.1 ohm-meter. It is generally impossible to create truly intimate contact between two sliding polymers that maintain their independent identities, or between a sliding polymer and a metal or ceramic surface. It is very helpful to have a lubricant available to fill the surface voids that always are present in sliding friction. This interfacial layer between the shuttle and the stator can be thinner if the mating surfaces of the shuttle and the stator are smooth, and match each other's shape. Insofar as the surfaces of the shuttle and the rotor are not perfectly smooth, the boundary layer can be thinner if the stator is somewhat flexible and is pressed against the rotor.

Figure 10:
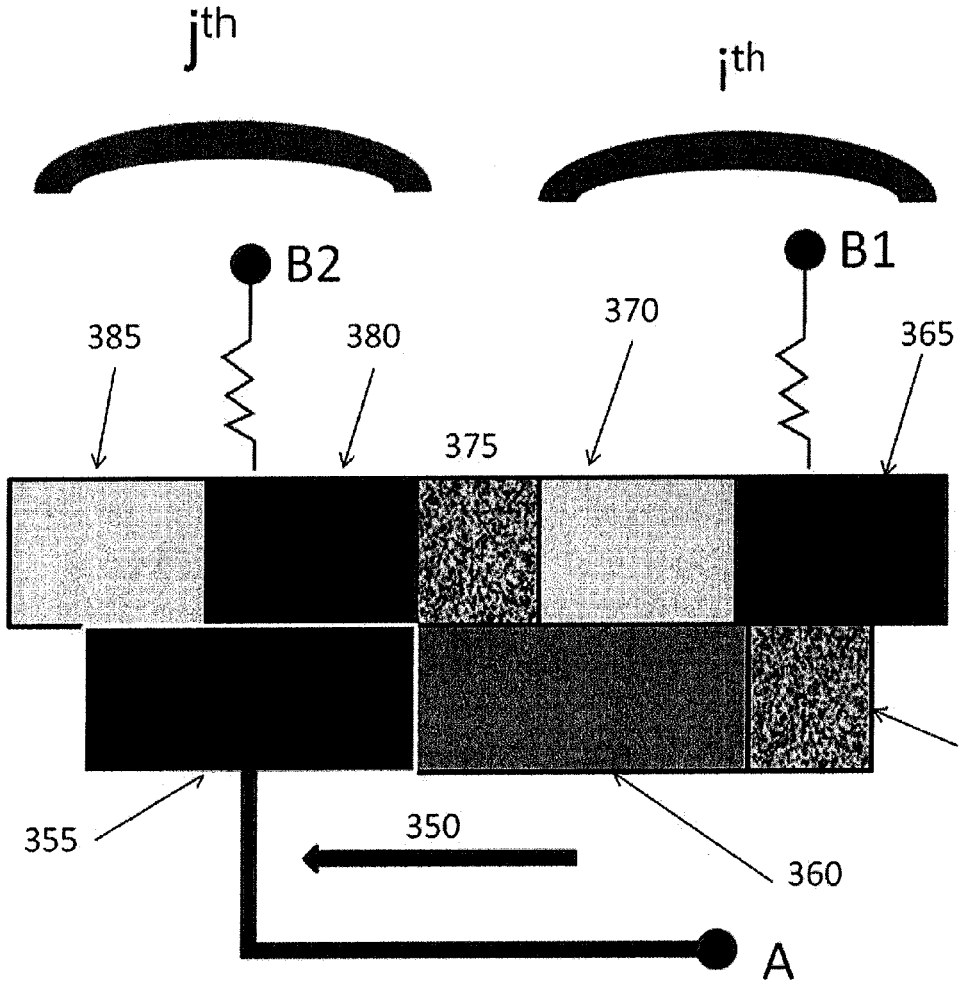
FIG. 10: Shuttle electrode/stator electrode interface showing increased resistivity trailing edges.

The concept of graded resistivity in the trailing parts of separating electrodes is one way to inhibit arcing as the electrodes separate. FIGS. 8 and 9 show that the electrically smoothing features of the trailing edges need not be a part of the electrodes themselves; in FIGS. 8 and 9, the resistivity-graded transition plug 312 serves to spread out the transition from full electrical contact between shuttle electrode 335 and the first stator electrode 321 and no contact at all (there must always be some path from shuttle electrode to each stator electrode; I disregard any paths with resistance above a threshold of $10^{8}$ ohms) as the shuttle moves to the right; in the case illustrated by FIGS. 8 and 9, the electrical smoothing element is transition plug 312, which is not a part of either the shuttle electrode nor the stator electrode. FIG. 10 illustrates another case for how the electrical smoothing layers may be implemented, showing the case where electrical smoothing elements are connected to the trailing edges of both a shuttle electrode and two stator electrodes.

A useful design feature of a commutating shuttle or a variable resistance shuttle is to use a polytetrafluoroethylene (PTFE) coated elastomer on some of the sliding surfaces between the shuttle and the stator such as on the outside of an elastomer cylinder like 311. Pure or formulated PTFE can be sintered and then skive cut to create a PTFE film which can then be used to create a sleeve. PTFE and/or PTFE compounds can also be ram extruded to form a thin-walled tube that can then be cut in lengths to use as a sleeve. Such a sleeve may then be adhered to an elastomer by first chemically etching it (http://www.actontech.com/fluor7.htm), and then co-molding it with a curing elastomer. It is however not nearly as easy to vary the resistance level of a PTFE layer as is the case for ordinary elastomers, so PTFE coating of elastomer surfaces is more desirable in the arc suppressing insulative sleeve of FIG. 4 (153) or in purely insulating segments, such as 311 of FIG. 8, rather than for the semiconductive components such as transition plug 312 of FIG. 8 or 500 of FIGS. 12 & 13.

The transition plug 312 may in the most general case contain one or more carbon-based or silicon-based layers, then several elastomer layers so as to have a layer for each decade of resistivity; for example. One could also have the first several conductivity steps occur in the metal sliding shuttle electrode 335, wherein the first part of the metal electrode could be comprised of a high conductivity metal or composite; then just behind this could be a higher resistivity nickel-chromium alloy "Nichrome," or a titanium alloy, or molybdenum for example. Then a metal matrix cermet resistor may optionally also be attached to the metal electrode behind the Nichrome portion thereof. After the metal electrode comes the electrically graded transition plug 312. The entire sequence of resistivity in going from the leading edge of electrode 335 (at the right side in FIG. 8) to the trailing edge of transition plug 312 at the left side of the 312/311 boundary between adjacent components of commutating shuttle 310 in FIGS. 8 and 9 may have many steps, as follows:

1. Cold sprayed silver (resistivity $\sim 1.5\times10^{-8}$ ohm-meter), or other low resistivity metal or composite;
2. Nichrome alloy (resistivity $\sim 1.5\times10^{-6}$ ohm-meter) or another high resistivity metallic alloy or composite (part 2 of shuttle electrode 335);
3. Cermet resistor (resistivity $\sim 1.3\times10^{-6}$ ohm-meter) or another high resistivity metallic alloy or composite (part 2 of shuttle electrode 335);
4. Carbon layer #1 (resistivity $\sim 10^{-4}$ ohm-meter) (could be part of the trailing edge of electrode 335, or the leading edge of transition plug 312);
5. Carbon layer #2 (resistivity $\sim 10^{-3}$ ohm-meter);
6. Conductive filled elastomer layer #1 (resistivity $\sim 10^{-2}$ ohm-meter);
7. Conductive filled elastomer layer #2 (resistivity $\sim 10^{-1}$ ohm-meter);
8. Conductive filled elastomer layer #3 (resistivity $\sim 10^{0}$ ohm-meter);
9. Conductive filled elastomer layer #1 (resistivity $\sim 10$ ohm-meter);
10. Conductive filled elastomer layer #1 (resistivity $\sim 10^{2}$ ohm-meter);
11. Conductive filled elastomer layer #1 (resistivity $\sim 10^{3}$ ohm-meter);
12. Conductive filled elastomer layer #1 (resistivity $\sim 10^{4}$ ohm-meter);
13. Conductive filled elastomer layer #1 (resistivity $\sim 10^{5}$ ohm-meter);

14. Conductive filled elastomer layer #1 (resistivity ~$10^6$ ohm-meter).

These same 14 levels of resistivity or a subset thereof can be deployed in components 355, 360, 365, 370, 380, and 385 of FIG. 10 as well. It may not be necessary to have this many resistivity steps in order to inhibit arcing; I anticipate that fewer steps will work, but it is also quite convenient to use however many steps are needed, even if more steps or different steps prove to be optimal. It is desirable to form a large part of the electrically graded transition that occurs at the trailing edges of separating electrodes from elastomeric component layers that all use a common base elastomer, so that all the layers stick very well to each other. Transition plug 312 is desirably but not necessarily composed of elastomeric layers with graded resistivity. It is also desirable but not essential to use very strong elastomers that retain good strength at formulation hardness from 80 Shore A to 95 Shore A harness, such as HNBR and polyurethane elastomers. It is also desirable but not essential to keep the stiffness of all the elastomeric layers approximately equal. Highly desirable elastomer formulation ingredients to aid slippage against the portion of the relatively moving mating interface; either a stator surface (FIGS. 4 and 10) or a shuttle surface (FIGS. 8.9, and 10); include (beside the needed conductive fillers and reinforcing fillers) PTFE, and other fluoropolymers, and $MoS_2$. It is also desirable to use a dry lubricant such as $MoS_2$ that has intermediate resistivity compared to good conductors and good insulators (the resistivity of $MoS_2$ can range from ~$10^{-2}$ to $10^{-7}$ ohm-m) to further reduce the sliding friction of an elastomeric transition plug 312 against the insulating tube shaped stator 302, or indeed to reduce the sliding friction of any shuttle electrode against any stator electrode except for liquid metal stator electrodes.

Transition plug 312 of FIGS. 8 and 9 is essentially similar to the graded resistivity layer 360 in FIG. 10, except that in FIG. 10 the variable resistivity layer 360 is bonded to the moving shuttle, and is most likely either a cermet or a highly loaded, stiff, slippery polymer, whereas transition plug 312 need not be physically attached to the metal portion of the stator electrode.

FIG. 10 shows a shuttle electrode/stator electrodes sliding interface with increased resistivity trailing edges. To prevent damaging sparks from forming when the shuttle electrode and stator electrode separate, it is highly desirable to squeeze the current down to milliamps prior to the final separation of the shuttle electrode from the stator electrode. This can be accomplished by the shuttle electrode/stator electrode combination of FIG. 10, in which the resistivity of the last half of both the shuttle electrode and the stator electrode increase by orders of magnitude prior to the final separation of the trailing edges of the shuttle electrode and the stator electrode.

FIG. 10 shows diagrammatically a sliding connection between two stator electrodes and one moving shuttle electrode: 365 and 370 together form the $i^{th}$ stator electrode, and 380, 385 together form the $j^{th}$ stator electrode, with insulator 375 between them; the $i^{th}$ stator electrode connects through resistive path B1, while the $j^{th}$ stator electrode connects through a different resistive path B2, which has higher resistance than B1. A sliding shuttle electrode (composed of the two layers 355 and 360) is electrically connected to both the $i^{th}$ and the $j^{th}$ stator electrode at the moment shown in FIG. 10. The shuttle electrode slides to the left below the stator electrodes and its trailing edge (the right hand edge of 360) is about to lose electrical connection to the highly conductive first portion of the $j^{th}$ stator electrode 365. One can see that this event will not open the circuit connection through the $i^{th}$ stator electrode to resistor B1, since the circuit is still open through the semiconductive electrode portions 360 and 370. By the time the final opening of the circuit through resistor B1 occurs, when the two semiconductive portions of the electrodes 360 and 370 separate, the current flowing through B1 will have been reduced to less than one ampere.

In reality the semiconductive portions of the electrodes of FIG. 10 (360, 370, and 385) will usually consist of multiple resistive layers following the highly conductive sections 355, 365, and 380 in order of increasing electrical resistivity. An example of a complete semiconductive sliding electrode could for example have these layers:

1. Nichrome alloy (resistivity ~$1.1\times10^{-6}$ ohm-meter)
2. Carbon layer #1 (resistivity ~$10^{-4}$ ohm-meter)
3. Carbon layer #2 (resistivity ~$10^{-3}$ ohm-meter)
4. Conductive filled polymer layer #1 (resistivity ~$10^{-2}$ ohm-meter)
5. Conductive filled polymer layer #2 (resistivity ~$10^{-1}$ ohm-meter)
6. Conductive filled polymer layer #3 (resistivity ~$10^0$ ohm-meter)
7. Conductive filled polymer layer #1 (resistivity ~10 ohm-meter)
8. Conductive filled polymer layer #1 (resistivity ~$10^2$ ohm-meter)
9. Conductive filled polymer layer #1 (resistivity ~$10^3$ ohm-meter)
10. Conductive filled polymer layer #1 (resistivity ~$10^4$ ohm-meter)
11. Conductive filled polymer layer #1 (resistivity ~$10^5$ ohm-meter)
12. Conductive filled polymer layer #1 (resistivity ~$10^6$ ohm-meter)

It may not be necessary to have this many resistivity steps in order to inhibit arcing; I anticipate that fewer steps will work, but it is also quite convenient to use however many steps are needed, even if more steps or different steps than the ones enumerated above prove to be optimal. It is desirable to form the entire polymeric portion of the electrically graded electrodes from a common base polymer, so that all the layers stick very well to each other. It is also desirable but not essential to keep the stiffness and wear rate of all the layers approximately equal (for long device life). In general, grading the resistivity of the trailing edges of both the shuttle electrodes and the stator electrodes as in FIG. 10 is more effective at preventing arcing than only grading the resistivity at the trailing edge of one kind of electrode, as in FIGS. 8 and 9.

The shuttle electrode is wider than the stator electrodes in FIG. 10 so that an electrical connection is always present through two neighboring stator electrodes (except at the final break, not shown in FIG. 10). The bottom shuttle electrode 355 is connected to another shuttle electrode in a different part of the moving shuttle (not shown, indicated as A); as in FIG. 6, the shuttle electrodes occur in electrically connected pairs; one of the pair in FIG. 6, 211 accepts current from a first set of stator electrodes onto the shuttle, and the second shuttle electrode 212 connects electrically with a second set of stator electrodes that move the power off the shuttle. Only a small portion of this is shown in FIG. 10. The shuttle electrode is moving at speed 350, and is composed of a metallic highly conductive leading edge portion 355, and a semiconductive trailing edge portion 360. Each stator electrode is also divided into two sections; there are two conductive metallic lead sections 365 and 380, and two more resistive trailing parts 370 and 385.

A particular stator electrode is relevant to minimizing on-state heat generation due to ohmic losses only if a shuttle electrode is in contact with that particular stator electrode when the circuit is fully closed and the shuttle is stationary (such as electrode 321 in FIG. 8). The times that the other stator electrodes 322, 323, 324 are in the circuit are limited to short times while the Commutating Circuit Breaker is tripping. The stator electrodes that carry the main current in the closed circuit state such as 321 should be highly conductive (like copper or silver, or a liquid metal electrode as discussed previously), but the other stator electrodes 322, 323, 324 can be made of a variety of metals and/or cermets, chosen more for friction, wear, cost, and corrosion resistance properties rather than especially low resistivity. Since both stator electrodes shown in FIG. 10 are shown as connected through resistors, they cannot be one of the electrodes such as 321 that carries the current when the circuit breaker is closed, but rather represent two next neighbor stator electrodes such as 322 and 323 of FIGS. 8 and 9 for example that only carry current for a period of milliseconds while the shuttle is moving; as such the metallic portions of the stator electrodes 365 and 380 need not be a very low resistivity metal such as copper or silver, but could advantageously be a metal with higher resistivity but lower cost and better frictional and wear properties than copper. Molybdenum is a particularly useful electrode material, even though it is only about 1% as conductive as copper or silver; it has much better frictional properties and corrosion resistance than copper, and can be plasma sprayed (for example) onto a different metal substrate to form just the sliding surface of an electrode. Molybdenum and its alloys can also be used in a low conductivity trailing edge of the metallic electrodes as in 355, 365, and 380 of FIG. 10.

Though it is not meant to limit the invention, the leading edge of electrodes 355, 370, and 385 should be a metal, metal alloy, or composite with resistivity ~$10^{-8}$ ohm-m; and the trailing edge of 355, 365, and 380 of FIG. 10 should be a metal, metal alloy, or composite with resistivity ~$10^{-6}$ ohm-m. Since the stator electrodes 365 and 380 are stationary, they can be formed from high density materials like copper and nickel, whereas the shuttle electrode 355 must be accelerated, so there is a strong reason for the body of the leading edge of electrode 355 to be a relatively low density aluminum alloy, with a thermal sprayed coating of molybdenum at the surface where 355 rides against stator electrodes 365 and 380. The trailing edge of metallic electrodes 355, 365, and 380 should be a metal, metal alloy, or composite with resistivity ~$10^{-6}$ ohm-m; this could be high strength titanium alloy beta-C, Nichrome, or molybdenum, for example (see Table 1). Since shuttle electrode 355 must be accelerated, a relatively low density titanium alloy is far more desirable than molybdenum for the body of the trailing edge of electrode 355; however, the density of stator electrodes 365 and 380 is less important, and these may use molybdenum in their trailing edges without slowing down the actuation of the Commutating Circuit Breaker.

Though it is not meant to limit the invention, the semiconductive electrodes 370, 385, and 360 are desirably a sequence of materials with higher and higher resistivity ranging from $10^{-4}$ ohm-m to $10^{4}$ ohm-m; the materials could be cermets, amorphous carbon, carbon-carbon composites, and conductive particle-loaded polymers of several different conductivity levels for example; these layers are functionally similar to transition plug 312 in FIGS. 8 and 9.

Though FIG. 10 indicates the use of semiconductive materials on the trailing edges of both the stator electrodes and the shuttle electrodes, one can achieve much of the desired effect by only grading conductivity on the trailing edges of the stator electrodes, which is much easier to accomplish than grading the resistivity of the trailing edges in the shuttle electrodes as well.

Figure 11:
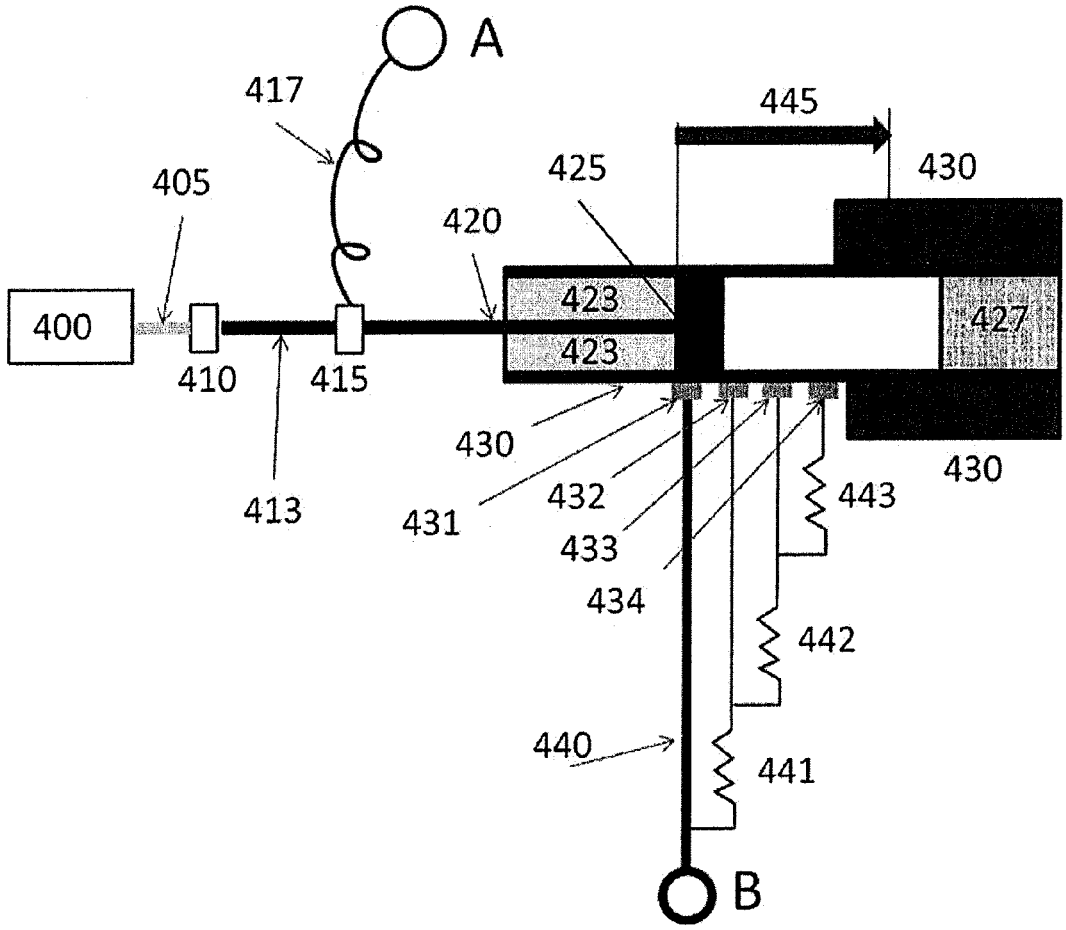
FIG. 11: Commutating Circuit Breaker with flexible wire lead from Pole A to the shuttle.

FIG. 11 shows the case where electric power is delivered to the shuttle of a commutating circuit breaker by a flexible wire 417 from Pole A. In this case, a commutating shuttle design with sharp conductor/insulator boundaries is depicted, but variable resistance electrodes as in FIG. 10 can also be used with a tethered wire attachment mechanism as in FIG. 11. The connecting wire 417 must have rather unusual properties for a wire, including high strength and very good fatigue resistance. Total movement of shuttle electrode 425 to the right is such that at the end of its travel 445 the electrode is surrounded by a high dielectric strength, high resistivity tube 430. A shock absorbing insulating element 427 is at the end of the travel of the front (right hand) face of electrode 425. In the closed state, which is depicted in FIG. 11, nearly all the current from shuttle electrode 425 flows through stator electrode 431 and then through low resistance current path 440 to a first terminal of the circuit breaker. As the shuttle moves to the right during opening of the circuit, shuttle electrode 425 also moves to right; the current is sequentially diverted through stator electrodes 432, 433, and 434 and the respective resistor sequence; at the first commutation resistance increases from 440 to 441, then to 441+442, then to 441+442+443, before the current is quenched in a small spark or by charging a small capacitor as in U.S. Pat. No. 3,534,226 (not shown) as shuttle electrode 425 passes beyond the edge of stator electrode 434. Although not depicted in FIG. 11, more than four stator electrodes linked through more than four different resistive paths can be used in such a Commutating Circuit Breaker. The actuator of motion 400 could be any suitable fast acting device; the thrust delivered by the actuator passes through a metal shaft 405 to an electrical isolation coupling 410, and from there via a non-conductive shaft 413 to the coupling 415 which links the metal shaft 420 to Pole A of the circuit breaker via the wire lead 417.

Figure 12:
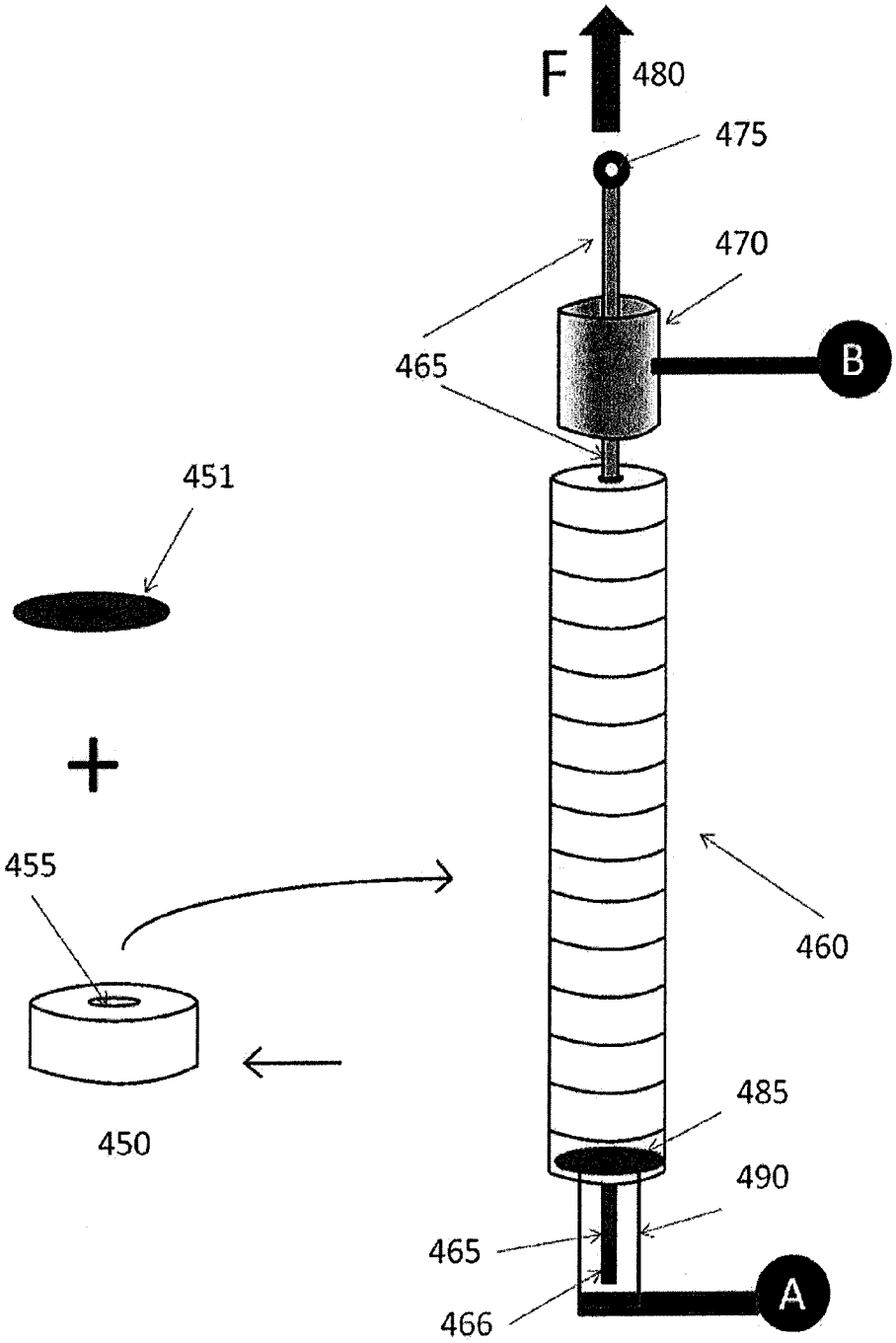
FIG. 12: Commutating Circuit Breaker with very simple commutating shuttle having the shape of a rod, tube, or wire.

FIG. 12 shows a variant on the simple Commutating Circuit Breaker concept shown in FIG. 4. A cylindrical shaped stack of hollow disc resistors 460 with metal washers 451 between each pair of next neighbor disc resistors (such as 450) is bonded together by some suitable means such as conductive adhesive, soldering, or brazing. This is simpler and less expensive to implement than the disc resistor stack of FIG. 3, based on a metal container for each disc resistor as shown in FIG. 2. The metal washers 451 are very simple examples of stator electrodes, and may have a slightly smaller hole through them than the hole 455 through the disc resistors themselves (such as 450), so that the washers protrude into the central cavity through the resistors; this protects the inner surfaces of the disc resistors from damage via direct contact with the moving shuttle electrode 465, which in this case is simply a metal rod or tube that extends clear through the stack of resistors 460. At the bottom end of the shuttle electrode is an electrical stress control device which has a similar function to 312 in FIGS. 8 and 9. In the closed circuit state, electrical connection to Pole A is made by high conductivity metal electrodes 490 that mate with the end of commutating shuttle 465. There is a parallel path from Pole A to the bottom of the stack of resistors 485. Connection from Pole B to the commutating shuttle 465 is made through electrical slip ring 470. The upper end of the commutating shuttle 475 is a feature for connecting to a force 480 that pulls the commutating shuttle out of the disc resistor stack 460 to open the circuit. Although FIG. 12 shows all the disc resistors as having the same outside diameter, that is not necessarily the case; in particular, because the first disc resistors inserted into the circuit absorb far more inductive energy than subsequent resistors. It is desirable that the lowest disc resistor in FIG. 12 (this is the first one inserted into the circuit) should have the greatest mass and therefore the largest outside diameter.

The circuit breaker of FIG. 12 has several unique features. It uses the simplest possible commutating shuttle, a metal rod or tube. The maximum force 480 that can be applied to the rod or tube depends on the strength of the material, and the cross-sectional area of the tube. If all the force on the commutating shuttle originates from acceleration, then the maximum acceleration that is possible for any given material is strictly a function of the strength/density ratio of the material forming the commutating shuttle, and the length of the commutating shuttle. If σ is the tensile yield strength of a material in pascals, D is its density in kg/m$^3$, and L is the commutating shuttle length in meters, then the maximum acceleration $A_{max}$ that can be applied to a commutating shuttle like 465 is given by:

$$A_{max}=\sigma/LD \quad (2)$$

Results from this equation appear in Table 2. The maximum feasible acceleration for a 2 meter long column of metal pulled from one end as in FIG. 12 varies from around 1000 m/s$^2$ for sodium to 100,000 m/s$^2$ for a strong titanium alloy. Table 2 also shows the mass of various metals at 20° C. that are needed to create a 2 meter long 25 micro-ohm column of material; at this loss level the 2 meter long notional commutating shuttle would transmit 2000 amps with 100 watts of $I^2R$ waste heat production. (Waste heat scales linearly with conductor mass, one tenth as much mass conductor means ten times as much heat generation, for example.) The mass of metal required to create a 25 micro-ohm column of material varies from 3.7 kg of sodium up to 618 kg for the strongest alloy shown, titanium beta-C alloy (which enables maximum acceleration among the materials of Table 2). Table 2 also contains data on additional metals that are discussed in different parts of this document in reference to electrode surfaces, for example.

first commutation very fast if the system inductance in a fault is low than if the system inductance in a fault is high). The device of FIG. 12 can also be deployed in a parallel circuit with a fast switch of a different kind, as in FIG. 15; in that scenario, the vital first commutation is handled by a different kind of device; in this case, the initial position of commutating shuttle 465 would be up inside the stack of resistors and slip ring 490 would not be needed to deliver power through the stack with low loss.

The fastest actuation Commutating Circuit Breaker of FIG. 12 using a material from Table 2 would be based on the highest strength/density ratio material, titanium beta-C alloy; such a breaker is completely impractical, however, because it would take 618 kg of titanium beta-C allow to pass 2000 amps at the specified basis resistance level of 25 micro-ohms. Using only the list of materials shown in Table 2, a desirable combination of fast actuation combined with a reasonably low total mass to accelerate can be obtained by making commutating shuttle 465 from a high strength titanium alloy shell with sodium inside. Among the single component potential material solutions for commutating shuttle 465, pure aluminum and pure magnesium have essentially equal mass to meet the 25 micro-ohm resistance target, but pure aluminum is stronger and so is a better solution for commutating shuttle 465. The penultimate column in Table 2 is a dimensionless figure of merit M that compares (yield strength)/(density*resistivity), normalized to the ratio of these properties for annealed copper (which is defined to have a figure of merit of 1.0); the higher the value of M, the more suitable is a given material for commutating shuttle 465. Aluminum alloy 6061-T6 (an aircraft structural alloy) has the best properties for a single component commutating shuttle (465 in FIG. 12) from the choices shown in Table 2 for this particular application. Aluminum alloy 6061-T6 can be accelerated 4.4 times as fast as pure aluminum, and so can make a faster circuit breaker per the design of FIG. 12.

TABLE 2

Data Related to Accelerating a Conductor as in FIG. 4 and FIG. 12

| Conductor | Density kg/m^3 | tensile yield strength (Pa) | maximum acceleration | resistivity ohm-m | kg to pass 2 kA | movement 4 ms (cm) | Figure of Merit M | max force, pascals |
|---|---|---|---|---|---|---|---|---|
| sodium | 971 | 1.00E+06 | 5.15E+02 | 4.76E−08 | 3.7 | 0.41 | 0.047 | 1.905E+03 |
| calcium | 1550 | 1.11E+07 | 3.56E+03 | 3.36E−08 | 4.2 | 2.85 | 0.456 | 1.485E+04 |
| magnesium | 1738 | 2.00E+07 | 5.75E+03 | 4.39E−08 | 6.1 | 4.60 | 0.564 | 3.512E+04 |
| Magnesium AM60A,B | 1800 | 1.30E+08 | 3.61E+04 | 1.20E−07 | 17 | 28.89 | 1.294 | 6.240E+05 |
| Magnesium AZ91 C,E T6 temper | 1800 | 1.45E+08 | 4.03E+04 | 1.51E−07 | 22 | 32.22 | 1.147 | 8.758E+05 |
| aluminum | 2700 | 5.01E+07 | 9.28E+03 | 2.82E−08 | 6.1 | 7.42 | 1.415 | 5.651E+04 |
| 6061 aluminium alloy, T6 temper | 2700 | 2.21E+08 | 4.09E+04 | 3.99E−08 | 8.6 | 32.74 | 4.411 | 3.527E+05 |
| Aluminum matrix alumina-fiber wire (3M ACCR) | 3294 | 7.50E+08 | 1.14E+05 | 7.62E−08 | 20.1 | 91.07 | 6.424 | 2.286E+06 |
| AlSiC-9 (CPS Technologies) | 3000 | 4.88E+08 | 8.13E+04 | 2.07E−07 | 49.7 | 65.07 | 1.690 | 4.041E+06 |
| copper (annealed) | 8960 | 7.00E+07 | 3.91E+03 | 1.68E−08 | 12.0 | 3.13 | 1.000 | 4.704E+04 |
| copper (cold worked) | 8960 | 2.20E+08 | 1.23E+04 | 4.20E−08 | 30.1 | 9.82 | 1.257 | 3.696E+05 |
| titanium elemental | 4506 | 3.20E+08 | 3.55E+04 | 4.20E−07 | 151 | 28.38 | 0.363 | 5.371E+06 |
| titanium beta-C alloy | 4830 | 1.03E+09 | 1.07E+05 | 1.60E−06 | 618 | 85.41 | 0.287 | 6.602E+07 |
| Tantalum | 16600 | 2.10E+08 | 6.32E+03 | 1.35E−07 | 179 | 5.06 | 0.201 | 1.134E+06 |
| Invar 36 | 8050 | 2.07E+08 | 1.29E+04 | 8.23E−07 | 530 | 10.28 | 0.067 | 6.810E+06 |
| Nichome (20% chromium) | 8400 | 3.54E+08 | 2.10E+04 | 1.30E−06 | 874 | 16.84 | 0.070 | 1.839E+07 |
| molybdenum | 10240 | 4.80E+08 | 2.34E+04 | 1.44E−06 | 1,180 | 18.75 | 0.070 | 2.765E+07 |

The best overall solution for a commutating shuttle 465 as in FIG. 12 depends on the relative cost for materials versus structure (including springs and triggers), and critically, on the needed acceleration. The structural cost scales with the mass of conductor that must be accelerated times the acceleration. Acceleration limits time to the critical first commutation, so there is a good reason to push towards high acceleration in order to minimize the time to first commutation, if and where that is important (it is more important to get to the A major consideration in accelerating and decelerating the shuttle of a Commutating Circuit Breaker is the mechanical integrity of the shuttle under a given acceleration. The setups shown in FIGS. 1, 4, and 12 move the shuttle linearly strictly with a pulling force; in such a method of acceleration of the shuttle, there is no tendency for the shuttle to buckle, regardless of the slenderness ratio of the shuttle (length/radius for a circular cylindrical commutating shuttle). Note though, that during deceleration the long, slender shuttles of FIGS. 1, 4, and 12 could have a high tendency to buckle (if braking force is applied at the front) which would limit the maximum deceleration to a lower value than the maximum acceleration. Buckling of a long slender commutating shuttle such as 465 in FIG. 12 can be prevented by surrounding the commutating shuttle with a strong stiff stator that surrounds the shuttle; however making the stator perform a mechanical function in addition to its primary electrical function (greatly reducing the volume where arcing can occur) will make the entire device more expensive. This is one major advantage of a rotary motion Commutating Circuit Breaker such as that of FIG. 7 versus a design in which the shuttle moves linearly.

It is desirable to minimize the mass of the non-essential parts of a commutating shuttle, such as the insulation and trailing edge electric field control technology described elsewhere in this invention disclosure. Only the conductor is absolutely required. Therefore, the lowest possible mass insulation is highly desirable. One of the best ways to insulate is a high vacuum which adds nothing to the weight of the commutating shuttle. Simply pulling a conductive tube so fast that one comes to the engineering limit for maximum tensile strength of the material (see Table 2 "maximum acceleration" column) is the fastest theoretical way to accelerate a linear motion commutating shuttle. Because of the high strength & good conductivity of carbon fiber, carbon fiber/metal composites are theoretically the best commercially available materials in terms of the relevant figure of merit M:

$$M=\{(\text{strength})/[\text{density}\times\text{resistivity}]\}/\{(\text{strength})/[\text{density}\times\text{resistivity}]\text{ for annealed copper}\}$$

This figure of merit M is indexed to a reference value for annealed copper of 1.00; of the single component materials (not composites or fabricated structures) shown in Table 2, cold worked copper has a modestly improved figure of merit M (1.257) compared to copper, and all the forms of magnesium and aluminum examined also have slightly higher M value than annealed copper, ranging from 1.147 to 4.411 for high strength aluminum alloy 6061-T6. The highest figure of merit M in Table 2 (43.4) is for a cermet wire, composed of alumina glass fibers in a matrix of pure aluminum. Similar wires that are comprised of carbon fiber reinforced aluminum have also been reported, but are much more difficult to prepare, and are not (as far as I know) commercially available at present. This cermet wire is the mechanical strength element (replacing steel in the more standard ASCR aluminum steel core reinforced wire) in 3M™ Aluminum Conductor Composite Reinforced (3M ACCR) wire, that is commercially available from 3M. Such a cermet wire can in principle serve as both conductor and actuator of the motion of the commutating shuttle 465 in FIG. 12. Because the modulus of the cermet wire is so high (4550 MPa), stretching it just a few percent can store a large amount of elastic energy (comparable to a very stiff spring) that could supply force 480 while obviating the need for slip ring 470. This design could be used for a very fast actuating design capable to very high voltage. In the most extreme version, it is possible to stress a cermet ACCR wire up to close to its breaking strength (1400 MPa), with the wire strung through a resistive stack such as that shown in FIG. 12, then cause the wire to fracture with fast laser pulse to open the circuit. Although this type of circuit breaker would not be resettable, it would still be useful as a form of fast fuse (but one not requiring explosives to actuate).

Table 2 shows that for a commutating shuttle in which the conductor is also the primary source of mechanical strength, that high strength aluminum alloys and aluminum-matrix cermets are especially desirable.

The needed separation distance between next neighbor commutating electrodes depends mainly on the voltage change that occurs during the commutation step that occurs as current flowing through one resistive path is shunted to the next path when the actual separation of the shuttle electrode and stator electrode occurs. The voltage difference between these two alternate paths carrying the same current is a reasonable estimate of the actual voltage difference driving arc formation as two electrodes separate; this part of the driving force to form an arc has little to do with the medium surrounding the electrodes (vacuum, gas, or liquid) but whether an arc actually does form also depends on the dielectric strength of the fluid surrounding the separating conductors. This in turn depends on such factors as the pressure and chemical composition of the fluid and the dissolved gases present in the fluid if it is a liquid. Particularly desirable fluids to surround the separating shuttle electrode and stator electrode include paraffinic hydrocarbons, including mineral oil and kerosene; vegetable oils; methyl esters of fatty acids; perfluorocarbon fluids; and liquid or gaseous sulfur hexafluoride (including gas mixtures). Sulfur hexafluoride-containing gas mixtures are well known in the prior art for their high dielectric strength (for a gas) and excellent arc quenching properties, but liquid phase sulfur hexafluoride is not used commercially at present as far as I know as an intentional liquid dielectric. The low liquid volume required in rotary design Commutating Circuit Breakers such as that of FIG. 7 make it feasible to use $SF_6$ in the liquid state as a dielectric fluid.

Figure 13:
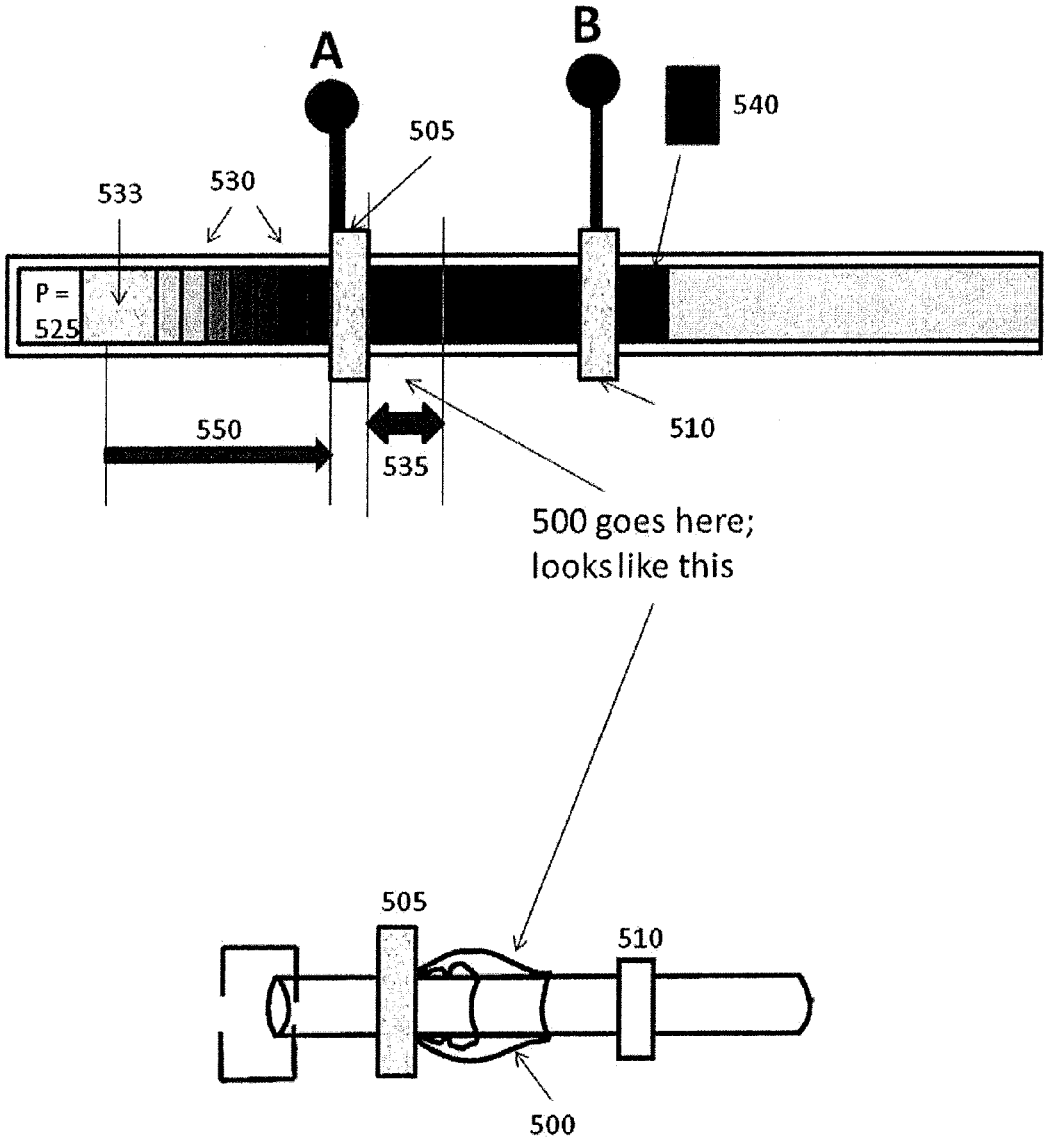
FIG. 13: Pressure actuated variable resistance shuttle with semiconductive elastomer sleeve for voltage stress control.

FIG. 13 shows a variable resistance shuttle design of the commutating circuit breaker with two significant changes from the similar design of FIG. 1: first, a continuously variable resistance shuttle core 530 is used rather than the step-graded core 110 of FIG. 1. Second, a new feature is shown, the trailing edge elastomeric semiconductive sleeve 500, which reduces the voltage gradients that occur as relatively more conductive material 540 exits the first stator electrode 505 into the region shown as 535, in this case a circularly symmetrical sliding electrode. The sleeve inhibits arcing and makes it possible to operate the commutating circuit breaker of FIG. 13 in open air, because by the time the variable resistance material is exposed to the air upon exiting the elastomeric sleeve, the voltage gradient at that point is greatly reduced compared to what the voltage gradient would have been upon exiting electrode 505 without the semiconductive elastomer sleeve 500. The voltage gradient at the air interface (where the variable resistance core 530 exits the semiconductive elastomer sleeve 500) is reduced because of voltage smoothing that occurs in the elastomer sleeve 500 between the end of the metallic stator electrode 505 and the end of the semiconductive elastomer sleeve 500, which is a distance 535 from the end of sliding stator electrode 505 (see FIG. 14 for a more detailed view). The downstream stator electrode 510 does not need a sleeve like 500, because the current only flows between Pole A and Pole B. The total movement of the shuttle core 550 is far enough so that the highly insulative cylinder 535 fills a zone that extends from left of stator electrode 505 to the right of elastomer sleeve 500. FIG. 13 also provides an example of actuation of motion of the shuttle with gas pressure 525.

Figure 14:
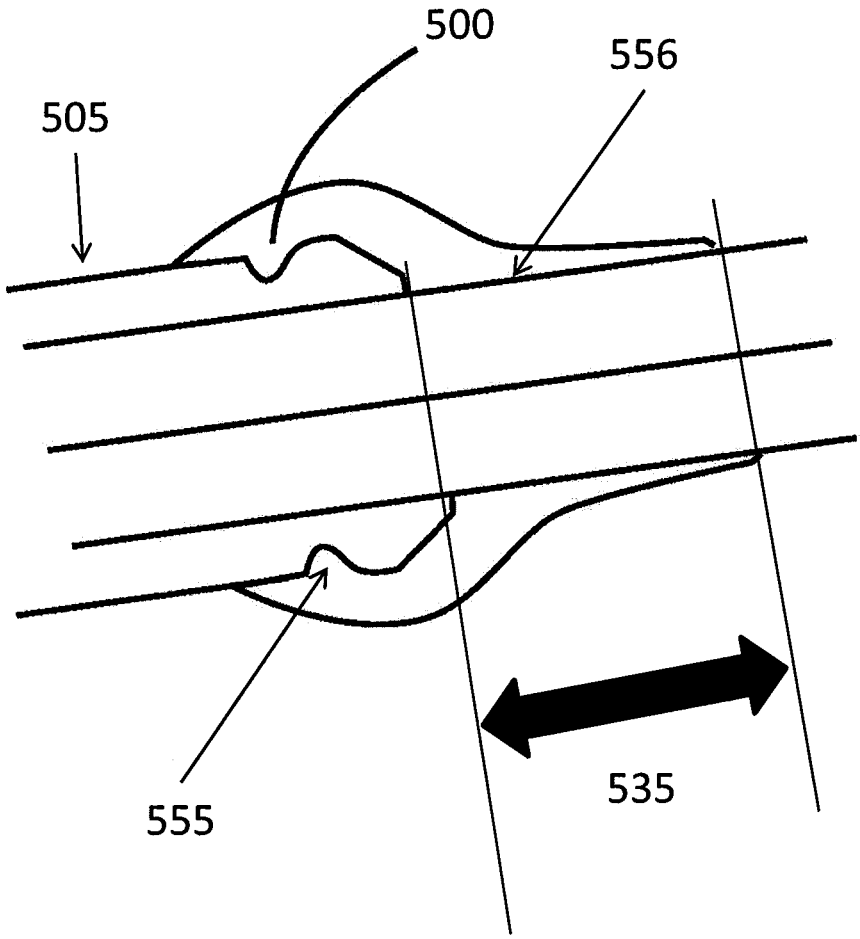
FIG. 14: Semiconductive elastomer sleeve for voltage stress control following stator electrode.

FIG. 14 shows a blown up view of the electrode trailing edge semiconductive elastomer sleeve 500 as it is assembled over the trailing edge of electrode 505, and riding on the shuttle core. The sleeve 500 fits around the circular cross-section of the tube-shaped stator electrode, and has a lip feature 555 to attach the semiconductive elastomer sleeve 500 to the trailing edge of stator electrode 505. The shape of 500 as molded will be substantially different than how it looks in the deformed state shown in FIG. 14. As will be familiar to one skilled in the art of design of rubber boots for mechanical devices (steering boots and the like), it is possible to work backwards from the final deformed shape of the semiconductive elastomer sleeve (FIG. 14) to calculate the dimensions of the mold to make the rubber sleeve. An example of an appropriate design criterion would be to set the extension ratio λ at the interface between the elastomer sleeve and the shuttle 556, which is the ratio of diameter in the deformed state to diameter as molded. For this sleeve an appropriate λ at position 556 is about 1.1 to 1.25.

In the sleeve application of FIG. 14, stress relaxation of the elastomer must be considered. This could also be the case for an elastomer plug like 310 if the plug is extended axially and then released inside the tube (this is not the only way in which such an elastomer plug 310 can be deployed though it is a very useful way to deploy this technology, because this method results in a plug that always fits tightly against the walls of the stator, even when it is not being compressed). If there is no pre-stress on the elastomer plug 310 in normal use (not counting the time that the shuttle is accelerating), then stress relaxation is unimportant, and even fast relaxing elastomers like ionomers and polyurethanes can be used. In the case of sleeve 500 of FIG. 14, stress must be maintained for the life of the elastomer part, so slow relaxing elastomer types, such as peroxide cured elastomers with carbon-carbon crosslinks are preferred. In addition, the sleeve of FIG. 14 will have to last many years in a potentially high ozone environment around electrical equipment, in an extended state. Therefore this sleeve also must be highly ozone resistant; for these reasons, peroxide crosslinked EPR (ethylene-propylene rubber) and EPDM (ethylene-propylene-diene monomer) are particularly appropriate as base elastomers for sleeve 500.

Commutating Circuit Breakers for relatively high power circuits (more than about one MW) are preferably made with a commutating shuttle that connects the current through a sequence of increasing resistance paths by making sequential contacts through stator electrodes connected with multiple stationary resistors, as in FIGS. 4, 6, 7, 8, 9, 11, and 12. This is especially true in the case of circuits with high system inductance (such as HVDC transmission lines), since the inductively stored energy must be dissipated as heat during opening of the circuit, which can imply a need for hundreds of kilograms of resistors. A "commutating shuttle" as that term is used herein is a movable shuttle that has a first shuttle electrode on its surface that is connected to Pole A of the power circuit, and a second shuttle electrode also on a surface of the commutating shuttle, that connects to Pole B of the Commutating Circuit Breaker. One or both of the shuttle electrodes connect to a pole of the Commutating Circuit Breaker through a sequence of stator electrodes connecting through different resistive pathways. One of said shuttle electrodes can connect to either Pole A or Pole B by a flexible wire as in FIG. 11 or a conductive slip ring as in FIGS. 8, 9 and 12, or other types of conductive sliding electrodes. Said shuttle electrodes are often, though not necessarily surrounded by a solid insulating material, which covers most of at least one surface of the commutating shuttle (as in FIGS. 8, 9 and 11 for example). The commutating shuttles of FIGS. 4 and 12 are exceptions to the usual situation in that the commutating shuttle (147 or 465) is simply a conductive pipe or rod that is pulled up around or inside a stack of disc resistors so that increasing numbers of disc resistors are inserted into the circuit as the commutating shuttle moves up. In FIGS. 2, 3, and 4 the first shuttle electrode is the outside of the conductive pipe 147, and the second shuttle electrode is the inside of the pipe 147 that surrounds the stack of resistors. This configuration and the alternative version of FIG. 12 are perhaps the simplest possible versions of a Commutating Circuit Breaker with a commutating shuttle.

As the commutating shuttle moves, the shuttle electrode or shuttle electrodes thereupon pass by stationary stator electrodes that are held against the shuttle electrodes on the shuttle at a selected contact pressure by springs, elastomeric members, gas pressure or some similar means as the shuttle electrode passes by the stator electrode. The shuttle electrodes are at least large enough that they can bridge between two neighboring shuttle electrodes as the shuttle moves (so that the current always has another way to go when it loses contact with a particular electrode, and it need not form an arc to continue flowing). The distance between next neighbor sets of electrodes that is required to prevent a spark from following a moving shuttle electrode as the shuttle moves away from a stator electrode needs to be determined experimentally, but increases with voltage and decreases with the dielectric strength and arc quenching properties of the fluid that surrounds the shuttle electrode and stator electrode. However, as pointed out earlier, the best way to prevent a powerful spark at the time of separation of the shuttle electrode and stator electrode is to have a zone of graded and increasing resistivity material on the trailing edge of each shuttle electrode and stator electrode as in FIG. 10. This graded resistivity zone can also squelch the last bit of inductively stored energy when there is no longer a parallel path through a parallel-connected second stator electrode (the final commutation). It is vital that the current is reduced low enough to dissipate the remaining inductive energy as the last commutation occurs.

The aforesaid shuttle electrodes on a commutating shuttle engage with more than one set of conductive stator electrodes that are disposed within a stator assembly that is designed to fit closely with said commutating shuttle while still allowing the shuttle to move freely. The shape of the stator assembly desirably matches that of the commutating shuttle, which can be a cylinder which moves axially as in FIGS. 1, 6, 8, 9, 11, and 13, a tube that engages with the outside of the stator as in FIG. 4, or inside of the stator as in FIG. 12; or a circular cylinder that moves radially as in FIG. 7. As the commutating shuttle moves, at least one of the two electrically connected shuttle electrodes makes contact with a series of different stator electrodes, which accomplishes commutation through a range of different resistive paths, culminating in a position where the connection between the two terminals of the Commutating Circuit Breaker is finally broken, and any remaining magnetic energy is absorbed in a small spark, a capacitor, a graded resistivity trailing portion of the separating electrodes, and/or a varistor with clamping voltage slightly above the highest voltage that occurs during the operation of the Commutating Circuit Breaker. The final resting place of the shuttle must have a resistance high enough to effectively shut off the current to a value such that less than one microamp flows through the opened Commutating Circuit Breaker for each amp that flows through the breaker at normal full load; this usually implies a total resistance through the "open position" Commutating Circuit Breaker $>10^8$ ohms.

In the simplest options, as in FIGS. 4, 8, 10, and 11, a single conductive electrode remains in an electrically connected state to one of the terminals of the Commutating Circuit Breaker with low resistance (typically <0.01 ohm from the terminal to the commutating shuttle) at all times.

In FIGS. 8, 9 and 11, the resistance insertion into the circuit occurs as one shuttle electrode moves between sets of stator electrodes, commutating the power over a series of stator electrodes connected to different resistance paths through a single shuttle electrode on only one side of the electrical connection through the Commutating Circuit Breaker. FIGS. 6 and 7 show multistage versions of Commutating Circuit Breakers in which the commutating shuttles have two and three pairs of electrically connected shuttle electrodes respectively (one pair of electrically connected shuttle electrodes per commutating stage); each shuttle electrode connects to complementary sets of stator electrodes mounted in or on the stator assembly. In these multistage designs, the commutating shuttle moves power onto the shuttle (+), then off of the shuttle (−) repeatedly; it is desirable in such cases to syncopate the commutations so that the (+) side commutations occur around halfway between the (−) side commutations, to minimize voltage spikes due to switching transients. Splitting the commutations up into two separate series of commutations through different sets of resistors on the (+) side zone and (−) side zone of a single commutation stage divides the voltage between the two sets of resistors, which are in series.

One way to deploy a Commutating Circuit Breaker is in a parallel circuit with a fast commutating switch 605, as in FIG. 15. In this scenario, the Commutating Circuit Breaker could have an initial resistance level corresponding to expected maximum current and acceptable maximum voltage in a short circuit; for example, in the scenario of Table 1 and FIG. 16, the expected maximum current in a short circuit is 10 kA, the maximum acceptable voltage is 500 kV, and therefore the initial resistance to be inserted is 500 kV/10 kA=50 ohms. This resistance is already present in the parallel circuit 602 through the Commutating Circuit Breaker 610 in the on state, though very little current will flow through the path 602 through the Commutating Circuit Breaker 610 as long as the much lower resistance path 601 through the fast switch 605 is a closed circuit. As soon as the fast commutation switch 605 opens, the current is redirected through the Commutating Circuit Breaker via parallel path 602. At the moment of commutation by switch 605, the voltage across the switch 605 is equal to IR (current times resistance) through parallel path 602; the maximum voltage withstand of the switch 605 may well limit the inserted resistance to be less than the 50 ohms that would be ideal for controlling a dead short as fast as possible. I have already discussed in the text describing FIG. 7 that in the case that the Commutating Circuit Breaker of FIG. 15 (610) is a three-stage rotary Commutating Circuit Breaker as in FIG. 7, it is desirable to distribute the initially inserted resistance (in this case, the initially inserted resistance is the on-state resistance of Commutating Circuit Breaker 610) over five of the six commutation zones of the Commutating Circuit Breaker of FIG. 7, and to arrange the geometry so that the second commutation (the first resistance switched into the circuit by the motion of the commutating rotor of FIG. 7) be done by the remaining commutation zone that has no intentional on-state resistance; according to Table 2, this second inserted resistance would be 19.4 ohms (inserted in series with previous 50 ohms, so that total resistance goes to 69.4 ohms). From this point forward, all subsequent commutations and resistance insertions would be handled by the Commutating Circuit Breaker 610.

The resistance of the fast switch 605 of FIG. 15 could be as low as 50 micro-ohms, in which case only a very small part of the current flows through the Commutating Circuit Breaker under normal closed circuit conditions, so on-state losses are small (and slightly smaller than would be the case with the fast switch alone in the circuit). The fast switch commutates power to the Commutating Circuit Breaker in less than one micro-second, and then the Commutating Circuit Breaker shuttle begins to move and may take 5-50 ms to fully open the circuit, but is instantaneously able to clamp the current inrush due to a dead short to protect the connected components, such as a VSC (voltage source converter), or a transformer for example. This fast commutation feature is particularly important in a multi-terminal HVDC grid.

The fast commutating switch shown in FIG. 15 can in principle be a semiconductor switch (although this implies high on state losses compared to a mechanical switch); a fast mechanical switch of a different type than the Commutating Circuit Breakers of this invention, such as that of U.S. Pat. No. 6,501,635; a superconducting fault current limiter (SFCL; this is the fastest option) or a group of SFCLs to allow for rapid recovery from a fault condition (as in U.S. Pat. No. 7,545,611); a MEMS (Micro-Electro-Mechanical Systems) switch (GE has numerous patents on these; see for example U.S. Pat. No. 7,903,382); a vacuum circuit breaker (see for example U.S. Pat. No. 7,239,490); an electron tube including the type of cold cathode vacuum tube mentioned in U.S. Pat. No. 7,916,507; a mercury arc valve as described in U.S. Pat. No. 3,534,226; or a fast acting Commutating Circuit Breaker with a faster actuation time than that of FIG. 7 because it has only one step between low and high resistance (as in FIG. 18).

Figure 17:
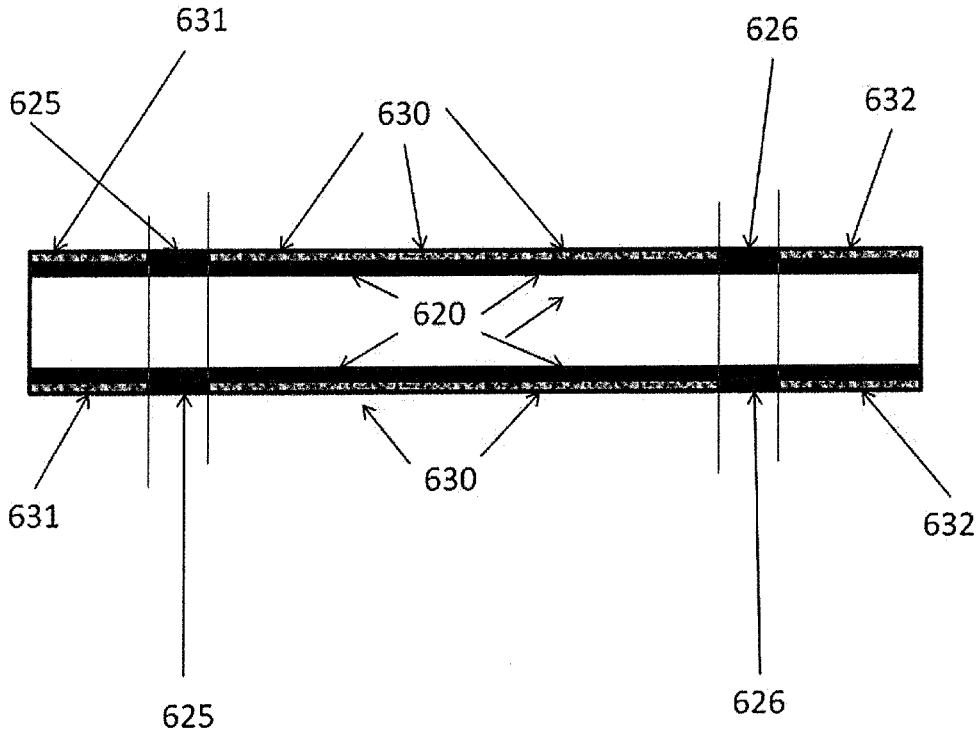
FIG. 17: Pipe-shaped commutating shuttle formed by plasma spray onto a substrate pipe, then polishing.

FIG. 17 illustrates a simple method to create a linear motion commutating shuttle that is functionally similar to a single stage 219 of the two stages of the linear actuated Commutating Circuit Breaker shown in FIG. 6. Commutation stage 219 of FIG. 6 includes two commutation zones 161 and 162, each of which includes four stator electrodes. The design of FIG. 17 is based on a piece of metallic or metal-matrix cermet pipe 620, onto which sleeves 625, 626, 630, 631, and 632 are fitted and/or attached. Said sleeves are of two types: sleeves 625 and 626 (which correspond to shuttle electrodes 211 and 212 in FIG. 6) are metallic sliding electrodes. Sleeves 630, 631, and 632 are electrically insulating sleeves (630 corresponds to the insulating material surrounding conductor 210 in FIG. 6). Said sliding metallic electrodes can be mechanically and electrically bonded to the pipe-shaped core 620 by a friction fit based on assembling accurately machined parts at different temperatures (shrink fit); by using solder or brazing; or by plasma or flame sprayed metal applied directly to the pipe-shaped core 620. The electrically insulating sleeves can be glazed onto the metallic substrate 620 as a glass; a preformed insulating sleeve that is accurately machined can be placed over the pipe-shaped core 620 by a friction fit based on assembling accurately sized parts at different temperatures (shrink fit); by plasma or flame sprayed ceramic insulation applied directly to the pipe-shaped core 620; or, an insulating, adherent polymer coating can be applied to the metallic substrate 620 to insulate it everywhere except at the sliding electrodes 625 and 626.

It is particularly appealing to use a simple extruded and heat treated aluminum tube that is flame sprayed, plasma sprayed, or cold sprayed:

- in the electrode areas with molybdenum, tungsten, cold sprayed silver, or another appropriate metal or alloy for sliding electrical contacts, and
- in other areas by alumina or aluminum nitride for example for a compact thin insulation layer The method of using a flexible insulating material pressed into close contact with a moving electrode just behind a brush electrode to suppress sparks in a commutator was first described by Nikola Tesla in U.S. Pat. No. 334,823, using a mica board just behind the brushes of a DC motor. I have invented an improved version of this concept having a tight-fitting elastomeric insulating layer just behind the electrical stator electrodes to inhibit arcing as the stator electrodes and stator electrodes separate. By creating contact pressure, such an elastomeric plug (310) increases the intimacy of contact between the outer surface of transition plug 312 and the inner surface of the insulated barrel 302. Alternatively, an extended elastomeric sleeve 500 can fit around the back side of a circular stator electrode 505 (FIGS. 13 and 14). FIG. 13 shows the case of a graded variable resistance trailing edge for a stator electrode in which elastomers are used downstream of the first stator electrode to provide an arc-suppressing semi-conductive elastomer sleeve that trails behind the circularly symmetrical stator electrode.

The motion of the variable resistance elements or the commutating shuttle core implies rapid acceleration, which will cause a mechanical jolt unless two equal and opposite motions are combined into a single circuit breaker. In order to minimize fatigue of the connections between the breaker and its enclosure, or the mounting fasteners holding the enclosure to the building or vehicle structure, and to reduce noise and vibration due to opening a Commutating Circuit Breaker, it is desirable to have two opposed and balanced motions, so that the momentum that must be transferred to the circuit breaker enclosure and the structural supports of the enclosure are minimized.

Several mechanisms to contain the momentum effects of Commutating Circuit Breaker actuation within the stator (housing of the Commutating Circuit Breaker moving core, whether the moving core is a variable resistive element or a commutating shuttle) are visualized:

1. firing two linear commutating shuttles in opposite directions within a common stator housing (which is capable of absorbing the shock loading that will result when the shuttle cores reach the end of their travel and must be arrested) which will contain the momentum effects of two symmetrical and balanced cylinders which move axially in opposite directions;
2. in the case of rotating shuttles (which may comprise rotating variable resistors or shuttle commutators), balancing the momentum effects perfectly would require coaxial counter-rotating discs; it is much easier however, to use two opposed counter-rotating shuttles on a common support base plate; the modest twisting forces due to having the centers of rotational momentum of the two disks offset slightly can be tolerated; this precession force is small compared to the rotational momentum required to accelerate and decelerate the rotating commutating shuttles, which can be balanced.

It is essential in most DC circuit breakers to deal with the inrush of current in a dead short. This is particularly true when a DC grid has a lot of battery power or capacitor banks online. A complete analysis requires an understanding of the entire electrical system in which the circuit breaker is imbedded, including especially system voltage response, capacitance, resistance, and inductance in a fault. The rate at which current can increase in a fault is moderated primarily by inductance, and it is always possible in principle to add inductance to slow the inrush of current in an anticipated fault. There is a trade-off between speed of operation that is required for the circuit breaker and system inductance. Adding inductance can allow the insertion of resistance to be slower while still clamping the current inrush at an acceptable level, but at a cost: both for the inductor per se, but also adding inductance can increase the mass of resistors that are needed to squelch the current. In general, The Commutating Circuit Breakers of the present invention work best when the ratio of system voltage V (in volts) to inductance L (in Henries) is less than 4 E7 at most; more preferably the ratio of V/L should be less than or equal to 8 E6.

It is highly desirable to have some form of snubber circuit integrated into the Commutating Circuit Breaker that has the effect of minimizing the voltage spike that occurs when the contacts slide off the connection (whether direct or indirect) to one set of resistors onto the next set of resistors of higher resistivity. I have discussed using graded resistivity on the trailing edge of the electrodes to soften the voltage spikes due to commutation, but there are also numerous known snubber circuits that can reduce or "filter" voltage transients, such as varistors, Zener diodes, capacitors, capacitors connected to the circuit through diodes, and other known types of snubber.

Examples of the Invention

I now consider several specific design approaches (rotary actuation and axial actuation) to solve the challenge of creating illustrative designs for a medium voltage DC (MVDC) Commutating Circuit Breaker for 2 kA AND 6 kV. These basis assumptions are used in developing Examples 1, 2, and 3:

- Full load=2000 amps;
- 6 kV voltage source; two cases were modeled: Case #1 has no voltage sag due to internal resistance (a worst case assumption, similar to a large capacitor bank); Case #2 has the current come from a large battery bank with realistic internal resistance of 0.36 ohms);
- normal full load resistance of 6 kV/2 kA=3 ohms
- Maximum design amps in dead short=10 kA (this determines how fast the commutation to switch in the first resistance level must be);
- First resistance switched in is (max voltage)/(max amps in a fault)=1.2 ohms (just high enough to clamp the current and reverse dI/dt)
- 1.0 microhenries is the assumed worst case system inductance $L_0$ in a dead short;
- Additional inductance is $L_X$ is added as needed to slow the inrush of current;
- Maximum voltage during commutation=12 kV (due to switching in resistance).

The general approach of this section is to define needed operating characteristics of a Commutating Circuit Breaker for several inductance levels. Table 3 shows calculated times to go from full load (2 kA) to maximum overload (10 kA) in two different overload cases:

- Case #1: a worst case dead short, zero resistance, no voltage sag; the increase of current with time follows equation (3)
- Case #2: power supplied by lithium ion batteries, battery resistance=0.36 ohms; the increase of current with time follows equation (4)

At time zero, resistance goes to zero in Case #1 (a worst case dead short), after which only the system inductance constrains the current rise dI/dt. In Case #1, the current is a linear function of time after the fault, so at time zero I(t) given by (3); on the other hand if the circuit contains resistance R (Case #2), the increase of current with time follows equation (4):

(Case 1)

$$I(t)=Vt/L \rightarrow dI/dt=V/L \tag{3}$$

(Case 2)

$$I(t)=(V/R)\{1-\exp[-t/(L/R)]\} \tag{4}$$

Figure 18:
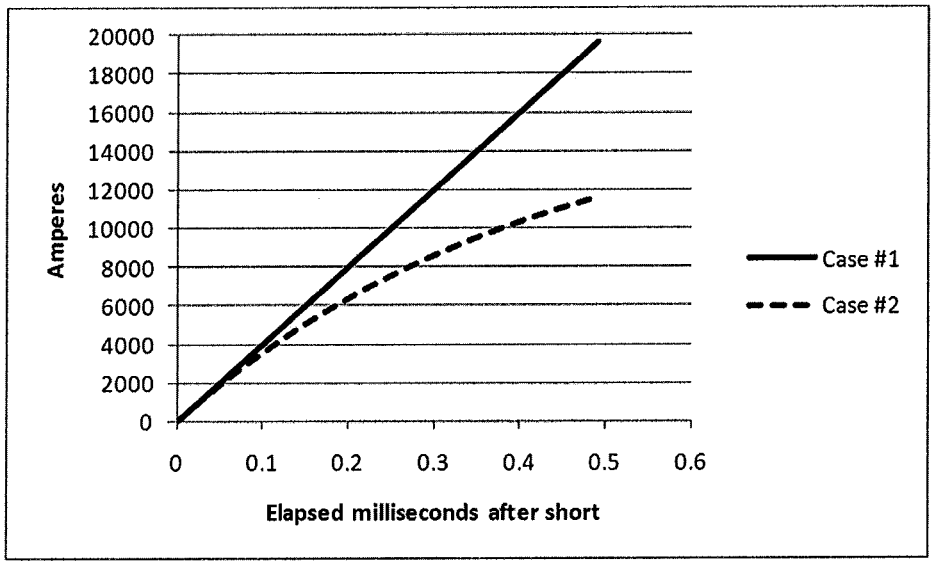
FIG. 18: Semilogarithmic plot comparing current versus time in a worst case dead short (no voltage sag, no resistance) versus a typical lithium ion battery pack string.

FIG. 18 shows a plot of these two equations for the intermediate inductance case (150 microhenries) of Example 2; up to normal full load of 2 kA, the two plots are nearly the same, but they diverge significantly at higher current, longer time. Given the very low assumed value of minimum system inductance L (1.0 microhenries), in the absence of added inductance, dI/dt (change of current with time in a dead short) is six billion amps/second. In order to limit this current rise to no more than 10 kA (starting from 2 kA, normal full load), it would be necessary to insert the first resistance at 1.33 microseconds. This is simply impossible for a mechanical system; only hybrid designs such as FIG. 15 with the very fastest types of switches (IGBT transistors or cold cathode vacuum tubes) can work in less than two microseconds as is needed if system inductance is only one microhenry. Table 3 gives the time delays for a system initially carrying full load (2 kA) going to 10 kA of current flow.

TABLE 3

Time to max amps (10 kA) for Various System Inductances (6 kV, 2 kA circuit)

| System inductance, mH | Time (2 kA→10 kA), ms Case #1 | Time (2 kA→10 kA), ms Case #2 |
|---|---|---|
| .001 | .00133 | .00163 |
| .150 | .200 | .333 |
| .750 | 1.00 | 1.63 |
| 3.750 | 5.0 | 8.17 |

Time to the first resistance insertion (commutation) is an important attribute of a Commutating Circuit Breaker, because the first resistance reverses or greatly slows the increase of current; this is true whether it is a standalone Commutating Circuit Breaker or a hybrid design as in FIG. 15; or indeed for any DC circuit breaker based on sequential insertions of resistance. If the first inserted resistance is (max voltage)/(max amps in a fault)=1.2 ohms in this case, and if this resistance is inserted on or before the time when the design maximum 10 kA current in the circuit is reached (Table 3), the first voltage spike will be less than or equal to the maximum design voltage, and current will decay back from that point onwards. If current=10 kA, then after switching in the 1.2 ohm resistor, the voltage across the resistor will be 12 kV. The selected resistance for the first insertion is just high enough to clamp the current and reverse dI/dt, but without causing voltage to increase above 12 kV. As discussed in detail above around FIG. 7 and Table 1 (which relate to a high inductance transmission system), one then must allow enough time for the current to decay down to some desired level before the next commutation. Adding in extra inductance $L_X$ slows down not only the inrush of current in the short (as in Equations 3 and 4), but also extends the time until the circuit is opened (since current decays as exp[−t(R/L)]/, as the following examples will show.

As mentioned above, Commutating Circuit Breakers (which are mechanical devices) cannot reach their first commutation within ~1.5 microseconds, as is necessary to control current inrush in a very low inductance system such as the one microhenry system cited in Table 3; however if coupled with a very fast commutating switch of a different type in a hybrid design such as FIG. 15, it is still possible to use a Commutating Circuit Breaker in such a low inductance system (Example 1). Commutating Circuit Breakers of very special designs can get to a first commutation within ~200 microseconds, as would be required if the system inductance is 150 microhenries per Table 3, as discussed in Example 2. At one ms (1000 microseconds) to the first commutation (as would be required if the system inductance is 750 microhenries per Table 3), the first commutation can either be by a simple Commutating Circuit Breaker of specialized design (Example 3), or a hybrid design such as FIG. 15 can be used with a slower Commutating Circuit Breaker to perform all but the first commutation; in this hybrid Commutating Circuit Breaker, the first commutation (via fast switch 605 in FIG. 15) can be accomplished via the electrodynamically driven fast switch of U.S. Pat. No. 6,501,635, for example; or the fast-acting commutating switch of Example 2 may also be used as the fast switch 605 in a hybrid Commutating Circuit Breaker. At 5-8 ms to the first commutation (as would occur in the example circuit of Table 3) if the system inductance is 3.75 millihenries; For this case, all the commutations including the critical first commutation can be performed by a simple Commutating Circuit Breaker, as discussed below in Example 4.

Example 1

Consider a circuit breaker of the style of FIG. 15, in which the fast switch is a cold cathode vacuum tube of the type disclosed in U.S. Pat. No. 7,916,507 to Curtis Birnbach. Such a tube would have an on-state voltage drop of about 10 volts, which implies energy loss of about 1/6000 or ~0.17% of transmitted power (better than an IGBT and not needing water cooling). This kind of tube can switch in less than 0.1 microsecond, easily commutating power to the Commutating Circuit Breaker before the current inrush passes the 10 kA maximum level, even at one microhenry inductance.

In this case, the vacuum tube is doing the "heavy lifting" and if the system inductance really is only one microhenry, then there is very little inductive energy to dissipate: only 100 joules if the current is interrupted at 10 kA, so it appears that a small capacitor or varistor could be used to absorb this energy. The advantages offered by the Commutating Circuit Breaker would be negligible in this case, except if (as is often the case) the inductance of the fault could be highly variable depending on its location. In the scenario of highly variable inductance in a fault, one can rely on the vacuum tube for fast switching to clamp down on the inrush in case of a low inductance fault, and the Commutating Circuit Breaker can be optimized for the maximum expected inductance, so as to minimize voltage spikes during opening of the circuit breaker. In particular, voltage spikes can be kept below the voltage that would be experienced if a varistor were used to absorb the inductive energy.

Example 2

Consider the case of minimum inductance in a fault being 150 microhenries. This implies very fast actuation and movement of a Commutating Circuit Breaker to get to a first commutation in 200-333 microseconds (depending on resistance of the circuit; 200 microseconds is an absolute worst case, and 333 microseconds is based on power being supplied by a lithium ion battery pack with internal resistance=0.36 ohms) for the circuit characteristics of Table 3. As shown below, this is so fast that (as is the case for Example 1) only a hybrid Commutating Circuit Breaker in a parallel circuit with a fast electronic switch (as in FIG. 15) can feasibly reach the first commutation within 200 microseconds, but that the 333 microseconds that are available to reach the first commutation in the case of a battery-powered circuit can just barely enable a fast commutating circuit breaker to get to the first commutation within this time (333 microseconds). These calculations are predicated on use of the fastest known method to actuate release of a rotating commutating circuit breaker, a piezoelectric actuator that moves 20 microns in 20 microseconds. The release of the rotor which is under high torque is assumed to occur within 50 microseconds of the fault, which includes 30 microseconds for the control computer to detect the fault and fire a pair of piezoelectric actuators to release the normal force clamping against a polished metal or ceramic brake that is also part of the rotary commutating shuttle, but outside the region where the shuttle electrodes are found, and on the opposite side of the rotary commutating shuttle from the device that applies the torque. Ordinary springs will not suffice to apply the torque for such fast motion; only elastic stress in a very stiff material can keep up with the needed motion; for example, a twisted titanium alloy tube or a tube-shaped carbon fiber reinforced composite that is the same diameter as the rotary commutating shuttle can supply the spring force and keep up with the motion of the rotary commutating shuttle.

Figure 19:
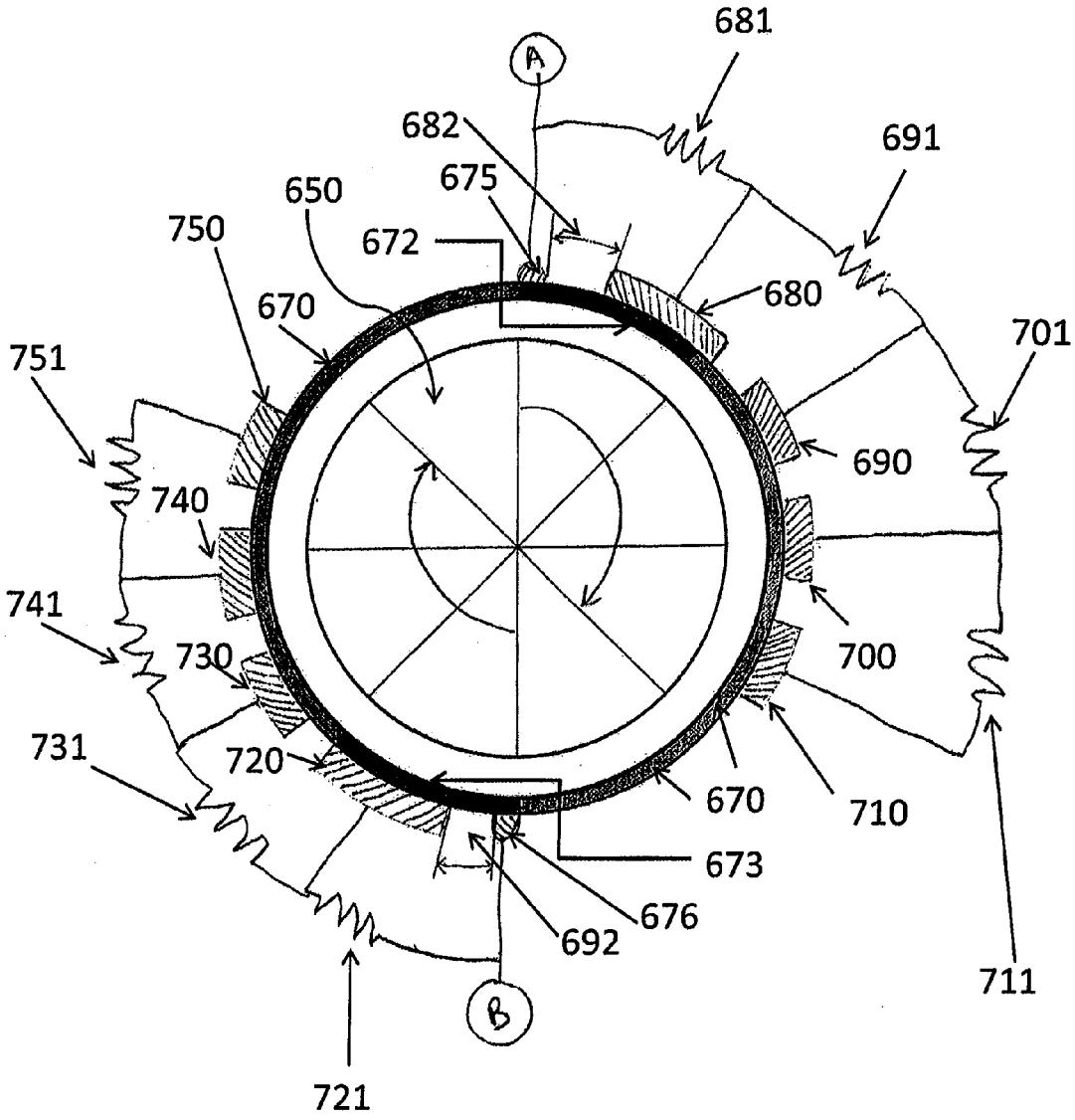
FIG. 19: Rotary fast-acting Commutating Circuit Breaker, single pole, ten commutation steps.

In the case of a rotary device, the torque required per unit angular acceleration scales with radius squared, whereas the circumferential distance (available for placing electrodes) scales with radius. Therefore, for a given available torque the fastest actuation will occur for the smallest workable radius of commutating rotor. To push the limits of a rotary Commutating Circuit Breaker design towards the fastest possible actuation, it is essential to minimize the radius of the commutating shuttle. This in turn means minimizing the number of stator electrodes, the width of the stator electrodes, and the standoff distance between the stator electrodes, because each stator electrode and each separator between neighboring stator electrodes must fit along the circumference of the rotating shuttle. The wider is each stator electrode, and the higher the number of stator electrodes, the longer must be the circumference. As this example is designed to probe the limits of speed of action of a Commutating Circuit, it uses several simultaneous tricks, as detailed below and shown in FIG. 19. FIG. 19 is similar to FIG. 7 in that it depicts an end-on view of a circular rotary commutator and the mating parts of the stator, but it is designed to have a smaller and simpler rotating commutating shuttle, to push up the speed of actuation.

The compact circular cross-section of the outermost surface of the commutating rotor 650 of FIG. 19 is smooth on its outer surface, which enables it to fit snugly inside a stator assembly 652, which also has a smooth inner surface in contact with the commutating shuttle. A lubricating interfacial film 654 desirably resides between the rotor and stator. Said lubricating film may desirably contain micronized molybdenum disulfide particles. The stator assembly is desirably held against the shuttle with a uniform pressure 656, which can originate from an elastic force, a pressure on the outside of the flexible inner part of the stator, or both.

The commutating rotor 650 is mostly composed of a round metallic tube 658 which is coated on its outer perimeter with an adherent electrically insulating shell 670, for example a ceramic such as plasma-sprayed alumina or quartz glass, or a polymer, except that the insulating shell is interrupted in the two shuttle electrode regions 672, 673 where the metallic tube is coated with a thin layer of conductive metal that is the same thickness as the insulating layer, but which is conductive and has good properties as a sliding electrode; two particularly desirable metals for the major part of shuttle electrodes 672, 673 are silver and/or molybdenum.

In the on state, the trailing edge of each of the shuttle electrodes 672, 673 is wetted by a liquid metal stator electrode (675 or 676). Surface resistance for liquid metal electrodes is typically in the range of $10^{-4}$ to $10^{-7}$ ohm-cm$^2$; for electrodes without oxidation in contact with liquid metal, surface resistance is less than or equal to $10^{-7}$ ohm-cm$^2$; that means that only a very small contact area (less than or equal to 0.1 cm$^2$) is required to pass 2000 amps with acceptable contact resistance through a liquid metal interface (the neighboring regions around the liquid metal contact typically contribute more to the resistance than the interface per se). For purpose of calculation I took the axial length of all the electrodes as 10 cm, which implies a needed circumferential overlap of the rotor electrodes with the liquid metal stator electrodes of less than one mm in the closed circuit on state; this may be too small a contact area for accurate routine alignment of the electrodes in an industrial circuit breaker; therefore, for purposes of this discussion I have taken the circumferential width of the liquid metal stator electrodes (675, 676) to be 2.0 mm, which allows for modest misalignment between the rotor electrode trailing edge and the leading edge of the liquid metal electrode. At the selected outer radius of the rotating shuttle (2 cm), this implies that the shuttle must rotate by 5.73 degrees to the first commutation (where the shuttle electrodes 672, 673 slide off the liquid metal electrodes 675, 676); in order to achieve that movement in 150 microseconds, the radial acceleration must be 2.82 E6 radians/second. This would require a torque of 416 newton-meters which is higher than the maximum torque that can be applied to the rotary commutating shuttle. (For purposes of calculation, the entire rotor which contains the 10 cm long rotary commutator is assumed to be equivalent to a 20 cm long titanium beta-C alloy tube, 4 cm in outside diameter, wall thickness 0.4 cm, and 20 cm long.) In the case of a battery-powered circuit, the internal resistance of the batteries delays the crossing of 10 kA in a dead short, so that 283 microseconds is available to reach the first commutation; this reduces the needed angular acceleration to 795,000 radians per second and the required torque to 216 newton-meters, which is just barely within the strength limitations of the assumed titanium alloy rotor. This is not really a practical design, but it does show that it is technically feasible to reach the first commutation within 333 microseconds using the rotary design of FIG. 19.

Example 3

Consider the case of minimum inductance in a fault in the circuit of Table 3 being 750 microhenries. I will continue the discussion based on FIG. 19, a good bit of which has already been discussed above. Increasing minimum inductance in a fault to 750 microhenries increases the time for current to rise to 10 kA from the presumed starting current of 2 kA by a factor of five: for the worst case, zero resistance fault this gives 1.0 milliseconds to reach the first commutation, and for the battery powered circuit, 1.63 milliseconds. Using the same assumptions described above for Example 2 (50 microseconds for releasing the brake, rotary moment of inertia equivalent to a 20 cm long titanium beta-C alloy tube, 4 cm in outside diameter, wall thickness 0.4 cm, and 20 cm long), this drops the needed angular acceleration to 70,500 radians/second for the worst case fault, and 25,500 radians/second for the fault in a battery-powered circuit. The corresponding torque for these accelerations is 10.11 and 3.66 newton-meters; well within a range of practical torques. Note though that the speed of actuation required here will still rule out conventional multi-turn coil springs for actuation; a fast acting spring will still be needed though not quite as fast as in Example 2.

After the first commutation away from the liquid metal electrodes in FIG. 19 (which has been the focus of the discussion for Examples 2 and 3), the other eight stator electrodes are not liquid metal electrodes, and as a consequence have to be wider than the liquid metal electrode in order to carry the fault current safely and without damage to the electrodes. Further, as is illustrated by FIG. 16 for a different but similar case, the optimum interval between commutations also changes as the current and stored inductive energy are quenched by repeated resistance insertions. I have not taken the step to couple the equation of motion of the rotor 650 with optimized times for resistance insertion (as in Table 1 and FIG. 16 for a different specific case), so as to calculate the optimal width of each particular stator electrode for the assumed worst case fault (10 kA, zero system resistance). I note though that this is a straightforward calculation once the details of the torque source and the rotor are known. FIG. 19 illustrates this principle by the fact that the first two metal sliding stator electrodes 680 and 720 are wider (one cm wide in the circumferential direction) than either the initial liquid metal stator electrodes 675, 676 (which are 0.2 cm wide) or the three subsequent stator electrodes 690, 700, 710, 730, 740, 750 (which are 0.6 cm wide). In this case, the two sets of stator electrodes (those in commutation zone 760 and those in commutation zone 760 are equal in size to their counterpart electrode in the opposite commutation zone. Syncopation of switching between commutating zone 760 and 770 is accomplished by making the width of the first insulating gap 682 in commutation zone 760 0.45 cm, whereas all the other insulating gaps are 0.30 cm; this offsets the commutations off of the metal sliding electrodes (680, 690, 700, 710) in commutation zone 760 by 4.30 degrees behind the corresponding commutations off of the metal sliding electrodes (720, 730, 740, 750) in commutation zone 770. Using this method to create the syncopated commutations has the advantage of standardizing the stator electrode widths, and allowing the commutating rotor to have a symmetrical design. This is not an optimized configuration, but illustrates the principle of using different stator electrode widths to compensate for a time-varying anticipated current at different times during operation of a Commutating Circuit Breaker; and altering the gap spacing between only one set of stator electrodes can achieve syncopated commutations between commutating zone 760 and commutating zone 770 (this is also discussed above in reference to FIG. 7).

The best available conductors near room temperature are silver and copper; silver-silver electrodes in which silver is infiltrated into a sintered porous metal substrate of chromium or tungsten are well known, for example. If silver or copper is used in contact against liquid metal electrodes, it can react; silver reacts with gallium and mercury, so even if one made silver-mercury electrodes for example, the surface of the silver electrode will be a silver-mercury amalgam. Silver can be used with the sodium-potassium low melting eutectic, but this introduces safety concerns. A particularly desirable way to use silver in the shuttle electrodes 672, 673 so that the electrode surface is compatible with a gallium alloy is to cold spray silver onto a non-oxidized aluminum or aluminum composite substrate in a moderate thickness layer 100-2000 microns thick, and then to polish the surface smooth before applying a molybdenum layer, which can desirably be accomplished by physical vapor deposition (PVD) methods to lay down a fairly thin film (1-5 microns) on the polished silver surface, which PVD-applied film reflects the surface finish of the silver substrate below. Plasma spray techniques can also be used to apply a thicker molybdenum surface layer on a copper or silver substrate in principle; plasma co-spraying of silver and molybdenum can be used to create a fuzzy boundary layer between silver and molybdenum to reduce the chance of delamination. However, a thick layer of molybdenum on a silver, copper, or aluminum substrate is intrinsically unstable due to the difference in thermal expansivity of the molybdenum compared to the substrate, and is therefore less favored than a thinner coating of molybdenum applied by PVD. In either case, the reason to apply a surface film of molybdenum is to coat the solid electrode with a non-oxidizing metal (below about 600° C.) which does not react with gallium or mercury to form an amalgam.

Because the electrode layers 672, 673 on the surface of the commutating rotor 650 of FIG. 19 are relatively thin (less than one mm), and also for simplicity of manufacturing, it is desirable for the entire thickness of the electrodes to be composed of molybdenum that is plasma sprayed onto the substrate metal tube 651. In this scenario, the insulating layer 670 could logically be a plasma sprayed alumina layer (the surface of the commutating rotor would in this case be ground smooth after plasma spaying). Because molybdenum and alumina both have low thermal expansivity compared to conductive metals, it is desirable to minimize the thermal expansivity of the substrate conductive tube or shaft 650 in the commutating circuit breaker of FIG. 19. Two potential materials for the core of a rotary Commutating Circuit Breaker such as that shown in FIG. 19 were considered:

Solid shaft made of AlSiC-9 infiltrated composite (this is the version depicted in FIG. 19);

Hollow titanium shaft for high shock loading capabilities.

These two shaft materials have very similar thermal expansivities. AlSiC-9 is an aluminum-infiltrated silicon carbide composite from CPS Technologies that has 8-9 ppm (parts per million) thermal expansivity from 30° C. to 200° C. (less than half the thermal expansivity of aluminum), and titanium has 8.6 ppm (parts per million) thermal expansivity from 30° C. to 200° C. Both materials form bonds with plasma sprayed alumina and molybdenum which are more resistant to thermomechanical fatigue than similar thickness plasma-sprayed alumina or molybdenum layers on aluminum, copper, silver, or their alloys. Using a solid shaft made of AlSiC-9 for the core of the commutating rotor 651 in FIG. 19 leads to a resistance between the two shuttle electrodes of about 0.0026 micro-ohms, with a corresponding resistive heat dissipation of only 0.01 watts. To compare a solid AlSiC-9 shaft to a hollow titanium tube, I calculated the tube wall thickness that gave the same moment of inertia about the axis of rotation as the solid AlSiC-9 shaft; in this case the mechanism to accelerate both tubes can be the same, as is desirable in comparing the two options economically. The titanium tube wall thickness (pure titanium) that matches the moment of inertia of a solid AlSiC-9 shaft (outside diameter of both is 4.00 cm), is only 0.149 cm thick. At a pure titanium tube wall thickness of 0.149 cm, the resistance between the two shuttle electrodes would be about 88.5 micro-ohms, which implies on state losses at maximum full load (2000 amps) around 350 watts just from resistance heating of the 10 cm long titanium shaft section between electrodes 672 and 673. I also calculated the same type figures for a titanium beta-C alloy tube with the same rotary moment of inertia as a pure titanium tube; because of the slight density difference from titanium (see Table 2), the wall thickness is a little less for a titanium beta-C alloy tube (0.138 cm): the resistance between the two shuttle electrodes would in this case be about 365 micro-ohms, which implies on state losses at maximum full load (2000 amps) around 1,460 watts just from resistance heating of the 10 cm long titanium shaft section between electrodes 672 and 673. (Though I consider this to be unacceptable, it only corresponds to 0.01% of the transmitted energy, far less than would be dissipated by an IGBT switch or even a cold cathode tube switch.) I should note that the resistance for a titanium tube core rotating electrode can be greatly reduced by inserting an aluminum tube core inside the titanium tube shell in such a way as to avoid any oxides at the interface.

In the case where very fast actuation is required, such as Example 2, which also implies shock loading, it is necessary to use a very strong, shock resistant material as the substrate for the commutating rotor 650 of FIG. 19, such as titanium or a titanium alloy tube electrically bonded to an aluminum alloy core. In any scenario where the commutating shuttle can be protected from shock loading, AlSiC-9 will be a more appropriate material for the core of a rotating shuttle such as 651 of FIG. 19.

Example 4

Figure 20:
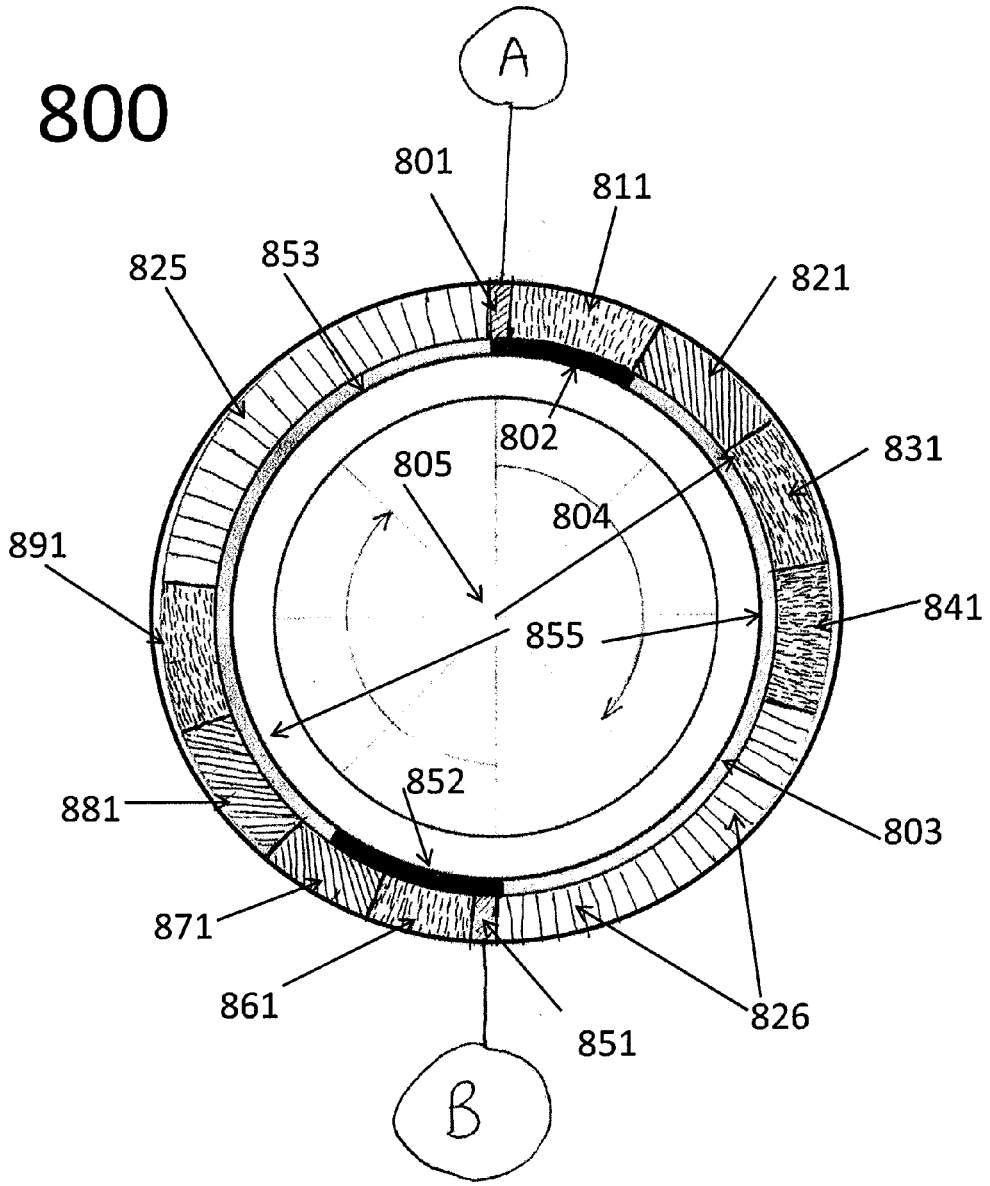
FIG. 20: Simplified rotary fast-acting Commutating Circuit Breaker in which the Stator Electrodes and resistors make up wedge-shaped keystone sections of the stator wall, and are held against the rotary commutating shuttle by a pressure pushing in the keystones towards the rotor.

FIG. 20 shows a simplified type of rotary Commutating Circuit Breaker similar to that of FIG. 19, but wherein single keystone-shaped components we will call "stator electrode resistors" act as both stator electrodes and resistors; these keystone-shaped stator electrode resistors actually form the inner walls of the stator and contact the commutating rotor (which is identical to that of FIG. 19). The stator electrode resistors take the form of the wedge shaped pieces of a hollow keystone (as described in U.S. Pat. No. 3,909,501). This attenuated wedge shape is easy to fabricate by numerous prior art methods. Resistive commutation occurs on both sides of the rotary commutating shuttle as the shuttle electrodes 802 and 852 turn clockwise out of contact with the liquid metal electrodes 801 and 851 (this is the first commutation, synchronized on the A and B sides of the circuit breaker). The liquid metal electrodes 801 and 851 are connected to Pole A and Pole B of the circuit breaker, and also electrically connected to the neighboring stator electrodes 811 and 861, which may be made of Nichrome alloy or amorphous carbon, for example. In a similar manner, stator electrode resistors 811 and 861 are also electrically connected to stator electrode resistors 821 and 871 and so on, up to the final stator electrode resistors 841 and 891. In each of these two series (Pole A side: 801 to 811 to 821 to 831 to 841; Pole B side: 851 to 861 to 871 to 881 to 891) the resistivity of the material forming each sequential stator electrode resistor increases compared to the prior stator electrode resistor in the series. After the commutating through all the stator electrode resistors, there is a highly insulating portion of the stator (825, 826); the shuttle electrodes rotate under this highly insulating portion of the stator when the circuit is opened.

(Note that as the terms "Pole A" and "Pole B" are used herein do not connote the two poles of a DC circuit (the "+" pole and the "−" pole), but mean rather the power coming onto the shuttle ("Pole A") and off of the shuttle ("Pole B"). All of the Commutating Circuit Breakers shown so far (up to FIG. 20) are single pole breakers.)

In the rotary Commutating Circuit Breaker 800 of FIG. 20, 135 degrees of rotation occurs around the axis of the device 805 in a clockwise manner to break the circuit. The rotor shaft 855 is made of a conductive metal or metal-containing composite (such as aluminum/silicon carbide, aluminum/boron carbide, or aluminum/alumina). As in FIG. 19, the outer surface of the rotor shaft 855 is coated with an insulating ceramic, glass, or polymer layer 803, 853 over most of its surface, but also is coated in two shuttle electrode regions 802 and 852 with suitable metals, as previously described. The outer wall of the commutating rotor extends out to radius 804, and is polished smooth so that there is at most only a very small unevenness in going from an insulating part of the wall (803, 853) to the neighboring conductive parts of the wall (802, 852). An inward pressure is desirably delivered to the outer edges of the keystone-shaped pieces forming the inner part of the stator (801, 811, 821, 831, 841, 826, 851, 861, 871, 881, 891, and 825) by an elastic retractile force or by gas pressure, to maintain pressure at the rotor/stator interface, which occurs at radius 804.

Example 5

Many medium voltage DC circuits are arranged with a "floating neutral" which means (unlike a car battery and an automotive electrical system for example) that both poles are considered "hot" and any circuit breaker must simultaneously cut of power from both poles to isolate a device or circuit. One desirable way this can be done has already been mentioned: two single pole Commutating Circuit Breakers can be simultaneously be triggered, one for the relatively positive side of the circuit, one for the relatively negative side of the circuit. In this case, it is especially desirable if the necessary acceleration of the shuttles can be done in such a way that a paired set of Commutating Circuit Breakers are simultaneously triggered so that the momentum effect due to accelerating and decelerating the shuttle mass of the first Commutating Circuit Breaker is counteracted by the momentum effect of accelerating and decelerating the shuttle mass of the second Commutating Circuit Breaker so that the momentum that must be transferred to the mounting system for the pair of commutating circuit breakers is greatly reduced.

It is also sometimes desirable to place two separate Commutating Circuit Breakers on a single common shuttle. For example, the two stage axial circuit breaker of FIG. 6 can readily be modified to break two circuits simultaneously by eliminating the connection between the two stages 182 and wiring the two now electrically independent halves to break the circuit on the positive side and the negative side of the DC circuit simultaneously. Similarly, a rotary Commutating Circuit Breaker can also be designed to open two circuits simultaneously. Such a rotary 2-pole circuit breaker cannot use a conductive shaft that is in the circuit as in FIGS. 19 and 20, but would instead need to maintain electrical separation between the stages, similar to FIG. 7.

The invention claimed is:

1. A commutating circuit breaker for use in an electrical circuit that defines an electrical path wherein current flows through the commutating circuit breaker when it is in an on state, the commutating circuit breaker comprising:

a stator having one or more stator electrodes;

a shuttle having one or more shuttle electrodes, the shuttle movable with respect to the stator and configured such that during such motion the shuttle electrodes slide against the stator electrodes;

wherein at least one of the stator and shuttle electrodes has an increasing resistivity along its length, with a higher resistivity on a trailing edge that comprises a portion of one electrode that last touches another electrode when the shuttle moves relative to the stator;

a series of resistors electrically coupled to one or both of the stator and shuttle; and a launching system arranged to move the shuttle relative to the stator between an on state position where the commutating circuit breaker presents a relatively low electrical resistance in the electrical circuit, and an open position where the commutating circuit breaker presents a very high electrical resistance in the electrical circuit;

wherein as the shuttle moves between the on state position and the open position, the current flowing through the commutating circuit breaker is shunted into paths of increasing resistance.

2. The commutating circuit breaker of claim 1 wherein at least some of the shuttle and stator electrodes are substantially surrounded by insulating material such that there are no gaps between the shuttle electrodes and the stator electrodes as the shuttle moves relative to the stator.

3. The commutating circuit breaker of claim 1 further comprising a pressurized electrically insulating fluid surrounding the shuttle.

4. The commutating circuit breaker of claim 1 wherein power passes onto the shuttle through a first series of stator electrodes that define a series of paths with increasing resistance as the shuttle moves, to a shuttle electrode that is on the outside surface of the shuttle, through an insulated path to a second shuttle electrode on a different portion of the shuttle, but surrounded by insulation at the surface of the shuttle, and then off the shuttle from said second shuttle electrode to a second series of stator electrodes that connect the power through a series of paths with increasing resistance as the shuttle moves.

5. The commutating circuit breaker of claim 1 wherein the breaker is arranged in a parallel power circuit with a fast commutating switch that is used to perform a first commutation of the current to the breaker at an initial resistance level that is able to control the inrush of current in a dead short.

6. The commutating circuit breaker of claim 1 wherein the shuttle comprises a plurality of stages which are electrically coupled in series and mechanically move together as a rigid body.

7. The commutating circuit breaker of claim 1 wherein the stator further comprises a low friction high dielectric strength material that creates force against the shuttle by an elastic member.

8. The commutating circuit breaker of claim 1 further comprising a shuttle latching mechanism that comprises piezoelectric actuators that relieve force on an interface of high modulus materials to achieve very rapid actuation of the onset of movement of the shuttle.

9. The commutating circuit breaker of claim 1 further comprising correlated magnetic domains on the shuttle and the stator that are constructed and arranged to hold the shuttle in position relative to the stator.

10. The commutating circuit breaker of claim 1 wherein the shuttle moves in a linear fashion with power coming onto the shuttle through one connection, then off the shuttle through a shuttle electrode that connects with a series of stator electrodes that connect the power through a series of paths with increasing resistance as the shuttle moves.

11. The commutating circuit breaker of claim 10 wherein the shuttle is generally cylindrical and there are a plurality of commutation zones along the longitudinal axis of the shuttle.

12. The commutating circuit breaker of claim 1 wherein the shuttle moves in a circular rotary fashion, with power coming onto the shuttle through a first electrical connection, then off the shuttle through a second electrical connection that is electrically connected to said first electrical connection, but surrounded by insulation at the surface of the shuttle, and which connects with a series of stator electrodes as the shuttle rotates.

13. The commutating circuit breaker of claim 1 in which at least some of the shuttle and stator electrodes comprise molybdenum.

14. The commutating circuit breaker of claim 2 wherein all of the shuttle and stator electrodes are substantially surrounded by insulating solids.

15. The commutating circuit breaker of claim 12 wherein the shuttle moves in a circular arc of less than 180 degrees, and commutates the power through a plurality of series- connected sequences of resistors.

* * * * *